US008104850B2

(12) United States Patent
Hager et al.

(10) Patent No.: US 8,104,850 B2
(45) Date of Patent: Jan. 31, 2012

(54) FURNITURE STORAGE UNIT

(75) Inventors: Allen C. Hager, Grand Rapids, MI (US); Robert E. Jeffers, Ada, MI (US); William K. Hofman, Ada, MI (US); Brian L. Bultsma, Byron Center, MI (US); Scott Michael Miller, Middleville, MI (US); Marvin C. Knauf, Conklin, MI (US); Karl Heinz Mueller, Rosenheim (DE); John R. Hamilton, Grand Rapids, MI (US); Karl J. Mead, East Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 824 days.

(21) Appl. No.: 12/129,097

(22) Filed: May 29, 2008

(65) Prior Publication Data

US 2008/0296457 A1 Dec. 4, 2008

Related U.S. Application Data

(60) Provisional application No. 60/940,913, filed on May 30, 2007, provisional application No. 60/940,879, filed on May 30, 2007, provisional application No. 60/940,899, filed on May 30, 2007, provisional application No. 60/940,891, filed on May 30, 2007.

(51) Int. Cl.
*A47F 5/08* (2006.01)
*A47B 47/00* (2006.01)

(52) U.S. Cl. ..... 312/245; 312/323

(58) Field of Classification Search ..... 312/242, 312/245, 246, 257.1, 263, 265.5, 265.6, 322, 312/323, 327; 52/36.4, 36.5, 36.6; 108/106, 108/107, 108; 248/201, 220.21, 220.31, 248/220.41, 220.43, 225.21, 243, 246
See application file for complete search history.

(56) References Cited

U.S. PATENT DOCUMENTS

| | | | |
|---|---|---|---|
| 359,094 | A | 3/1887 | Perkins |
| 360,611 | A | 4/1887 | Mix |
| 367,436 | A | 8/1887 | Orum |
| 579,722 | A | 3/1897 | Petersen |
| 620,594 | A | 3/1899 | Ketchum |
| 669,907 | A | 3/1901 | Wemicke et al. |
| 688,390 | A | 12/1901 | Casler |
| 715,243 | A | 12/1902 | Casler |
| 726,117 | A | 4/1903 | Tobey |
| 726,957 | A | 5/1903 | Macey |
| 739,007 | A | 9/1903 | Kershaw |
| 742,751 | A | 10/1903 | Taylor |
| 761,312 | A | 10/1903 | Luellen |

(Continued)

*Primary Examiner* — James O Hansen
(74) *Attorney, Agent, or Firm* — Price Heneveld LLP

(57) ABSTRACT

An office furniture unit has an outer face with slotted hangers, and a removable storage unit assembly including a bottom panel positioned in a generally horizontal orientation along the office furniture unit, and a top panel disposed above and generally parallel with the bottom panel. First and second panels are disposed at opposite ends of the top and bottom panels and are connected therewith to define a rigid, box-shaped case having an open back portion. The first and second end panels have rear portions with multiple vertically spaced slots. First and second hanger brackets have a rear portion with first hooks selectively received in the slotted hangers of the office furniture units, and a forward portion with second hooks selectively received in the slots in the rear portions of the first and second end panels to detachably support the case against the outer face of the office furniture unit.

25 Claims, 59 Drawing Sheets

U.S. PATENT DOCUMENTS

| | | | | |
|---|---|---|---|---|
| 769,705 | A | | 9/1904 | Mauro |
| 781,562 | A | | 1/1905 | Senge |
| 795,931 | A | | 8/1905 | Pierce |
| 880,132 | A | | 2/1908 | Ewing |
| 884,550 | A | | 4/1908 | Wilmot |
| 887,369 | A | | 5/1908 | Wilmot |
| 890,207 | A | | 6/1908 | Anderson |
| 899,049 | A | | 9/1908 | Honor |
| 972,412 | A | | 10/1910 | Taussig |
| 984,793 | A | | 2/1911 | Blomberg |
| 1,124,570 | A | | 1/1915 | Woltz |
| 1,203,589 | A | | 11/1916 | Curtenius |
| 1,327,426 | A | | 1/1920 | Erickson |
| 1,342,083 | A | | 6/1920 | Amold |
| 1,348,680 | A | | 8/1920 | Woltz |
| 1,629,270 | A | | 5/1927 | Hammer |
| 1,654,470 | A | | 10/1927 | Alheit |
| 1,720,050 | A | | 7/1929 | Morris et al. |
| 2,010,660 | A | | 8/1935 | Ferris |
| 2,092,531 | A | | 9/1937 | Dimick |
| 2,123,264 | A | | 7/1938 | Walter |
| 2,427,335 | A | | 3/1945 | Antonia et al. |
| 2,480,965 | A | | 9/1949 | Remke et al. |
| 2,481,935 | A | | 9/1949 | Larson |
| D157,076 | S | | 1/1950 | Nemes |
| 2,504,765 | A | | 4/1950 | Von Palmenberg |
| 2,506,642 | A | | 5/1950 | Jacobi |
| 2,558,852 | A | | 7/1951 | Jacobi |
| 2,571,622 | A | | 10/1951 | Schmidt |
| 2,612,663 | A | | 10/1952 | Pearse |
| 2,618,682 | A | | 11/1952 | Thumim |
| 2,629,248 | A | | 2/1953 | Burdick |
| 2,688,525 | A | | 9/1954 | Lindstrom |
| 2,694,614 | A | | 11/1954 | Dent |
| 2,744,714 | A | | 5/1956 | Parke |
| 2,772,846 | A | | 12/1956 | Skar |
| 2,776,735 | A | | 1/1957 | Bancroft |
| 2,781,558 | A | | 2/1957 | Tarzia |
| 2,845,187 | A | | 7/1958 | Bianchi |
| 2,903,316 | A | | 9/1959 | Schmidt |
| 2,936,147 | A | | 5/1960 | Stewart |
| 2,942,924 | A | | 6/1960 | Stangert |
| D188,318 | S | | 7/1960 | Niederman |
| 2,948,141 | A | | 8/1960 | Vahlstrom |
| 3,002,787 | A | | 10/1961 | Ziegenfuss |
| 3,009,739 | A | | 11/1961 | Hamilton |
| 3,018,861 | A | | 1/1962 | Somville |
| 3,051,427 | A | | 8/1962 | Alvarez |
| 3,067,882 | A | | 12/1962 | Ribbens et al. |
| 3,074,772 | A | | 1/1963 | Kessler et al. |
| 3,169,281 | A | | 2/1965 | Clements, Jr. |
| 3,261,640 | A | | 7/1966 | Straits |
| 3,294,461 | A | | 12/1966 | Barnard et al. |
| 3,296,745 | A | | 1/1967 | Johnson et al. |
| 3,312,443 | A | | 4/1967 | Levigne |
| 3,325,130 | A | | 6/1967 | Smith et al. |
| 3,342,514 | A | | 9/1967 | Ivanhoe et al. |
| 3,349,536 | A | | 10/1967 | Halko, Jr. et al. |
| D209,758 | S | | 1/1968 | Blink et al. |
| 3,371,454 | A | | 3/1968 | Anderson |
| 3,425,729 | A | | 2/1969 | Bisbing |
| 3,456,995 | A | | 7/1969 | Nyquist |
| 3,464,161 | A | | 9/1969 | Jonsson |
| 3,465,488 | A | | 9/1969 | Miller |
| 3,472,543 | A | | 10/1969 | Biro |
| 3,489,479 | A | | 1/1970 | Sulentic |
| 3,491,820 | A | | 1/1970 | Ostling |
| 3,533,190 | A | | 10/1970 | Hilfinger et al. |
| 3,553,916 | A | | 1/1971 | Lickliter et al. |
| 3,563,626 | A | | 2/1971 | Ferdinand et al. |
| 3,606,419 | A | | 9/1971 | Virkler et al. |
| 3,620,588 | A | | 11/1971 | Ferdinand et al. |
| 3,659,445 | A | | 5/1972 | Eads et al. |
| 3,662,981 | A | | 5/1972 | Hogrebe |
| 3,664,275 | A | | 5/1972 | Kleinert |
| 3,697,363 | A | | 10/1972 | Martinez |
| 3,698,114 | A | | 10/1972 | Hirsch et al. |
| 3,712,698 | A | | 1/1973 | Propst et al. |
| 3,713,257 | A | | 1/1973 | Beavers |
| 3,729,113 | A | | 4/1973 | Lopatka |
| 3,748,005 | A | | 7/1973 | Chovanec et al. |
| 3,748,006 | A | | 7/1973 | Levit et al. |
| 3,754,806 | A | * | 8/1973 | Nakagawa ..... 312/265.5 |
| 3,771,847 | A | | 11/1973 | Aylworth |
| 3,771,849 | A | | 11/1973 | Barber |
| 3,779,623 | A | | 12/1973 | Motohashi |
| 3,794,401 | A | | 2/1974 | Dean et al. |
| D231,430 | S | | 4/1974 | Steinhauser |
| 3,811,728 | A | | 5/1974 | Redemske |
| 3,814,491 | A | | 6/1974 | Kackley |
| 3,818,672 | A | | 6/1974 | Moore, Sr. |
| 3,825,215 | A | | 7/1974 | Borglum |
| 3,834,659 | A | | 9/1974 | Siegal |
| 3,853,294 | A | | 12/1974 | Albinson et al. |
| 3,862,524 | A | | 1/1975 | McCrackin |
| 3,875,711 | A | | 4/1975 | Palmer |
| 3,886,698 | A | | 6/1975 | Raith et al. |
| 3,915,328 | A | | 10/1975 | Hawes et al. |
| 3,936,107 | A | | 2/1976 | Gourdeau et al. |
| RE28,994 | E | | 10/1976 | Aylworth |
| 3,991,877 | A | | 11/1976 | Kraft et al. |
| 4,013,254 | A | | 3/1977 | Boundy et al. |
| 4,018,019 | A | | 4/1977 | Raith et al. |
| 4,020,604 | A | | 5/1977 | Legler et al. |
| 4,040,588 | A | | 8/1977 | Papsco et al. |
| 4,042,287 | A | | 8/1977 | Hallen |
| 4,052,100 | A | | 10/1977 | Nikitits et al. |
| 4,054,268 | A | | 10/1977 | Sher |
| 4,060,277 | A | | 11/1977 | Leib |
| 4,067,548 | A | | 1/1978 | Murphy |
| 4,092,751 | A | | 6/1978 | Burkholder et al. |
| 4,097,014 | A | | 6/1978 | Boundy |
| 4,103,981 | A | | 8/1978 | Donahue et al. |
| 4,106,476 | A | | 8/1978 | Harsha |
| 4,119,287 | A | | 10/1978 | Mollenkopf |
| 4,120,124 | A | | 10/1978 | Temple et al. |
| 4,122,617 | A | | 10/1978 | Nielsen |
| 4,123,879 | A | | 11/1978 | Blodee et al. |
| 4,141,612 | A | * | 2/1979 | Rowe ..... 312/245 |
| 4,147,393 | A | | 4/1979 | Nelson et al. |
| 4,154,419 | A | | 5/1979 | Breidenbach |
| 4,190,926 | A | | 3/1980 | Cronin |
| 4,193,650 | A | | 3/1980 | Gray et al. |
| 4,205,470 | A | | 6/1980 | Kapnek |
| 4,205,815 | A | | 6/1980 | Sauer et al. |
| D256,297 | S | | 8/1980 | Gera et al. |
| 4,222,542 | A | | 9/1980 | Wilson et al. |
| 4,228,906 | A | | 10/1980 | Jones |
| 4,237,636 | A | | 12/1980 | Matthews |
| 4,265,500 | A | | 5/1981 | Berton et al. |
| 4,265,502 | A | | 5/1981 | Blodee et al. |
| 4,295,693 | A | | 10/1981 | Viklund |
| D263,097 | S | | 2/1982 | Poole |
| 4,320,852 | A | | 3/1982 | Nagelkirk |
| 4,320,935 | A | | 3/1982 | Nagelkirk |
| 4,322,958 | A | | 4/1982 | Eigemeier |
| D265,952 | S | | 8/1982 | Theodore |
| 4,349,113 | A | | 9/1982 | Schreiner |
| 4,375,907 | A | | 3/1983 | Vander Kooi et al. |
| 4,377,915 | A | | 3/1983 | Zossimas et al. |
| 4,382,311 | A | | 5/1983 | Watts |
| 4,384,567 | A | | 5/1983 | Katona |
| 4,401,222 | A | | 8/1983 | Kulikowski et al. |
| 4,403,434 | A | | 9/1983 | Jenkins |
| 4,403,700 | A | | 9/1983 | Manlove |
| 4,404,776 | A | | 9/1983 | Ball et al. |
| 4,405,255 | A | | 9/1983 | Wallace |
| 4,415,091 | A | | 11/1983 | Wolff |
| D272,108 | S | | 1/1984 | Morris, Jr. |
| 4,437,712 | A | | 3/1984 | Wissinger |
| 4,457,436 | A | | 7/1984 | Kelley |
| 4,457,569 | A | | 7/1984 | Scheerhorn |
| 4,471,575 | A | | 9/1984 | Stout |
| 4,471,638 | A | | 9/1984 | Scheerhorn |
| 4,477,128 | A | | 10/1984 | Hasbrouck |
| 4,515,494 | A | | 5/1985 | Robilliard et al. |
| 4,516,813 | A | | 5/1985 | Sekerich |

4,538,936 A 9/1985 Zeidl
4,541,599 A 9/1985 Schoumaker
4,549,712 A 10/1985 Simon et al.
4,550,893 A 11/1985 Wiersema et al.
4,566,743 A 1/1986 Henriott
4,570,406 A 2/1986 DiFazio
D282,886 S 3/1986 Williams
4,586,759 A 5/1986 Wrobel
4,591,214 A 5/1986 Reuter et al.
4,600,254 A 7/1986 Whalen
4,615,570 A 10/1986 Goodman
4,618,192 A 10/1986 Kelley
4,619,727 A 10/1986 Hamisch, Jr.
4,620,743 A 11/1986 Eke
4,629,167 A 12/1986 Kimura et al.
4,631,881 A 12/1986 Charman
4,633,789 A 1/1987 Kortering et al.
4,641,896 A 2/1987 Iimura et al.
4,647,107 A 3/1987 Hoover et al.
4,655,489 A 4/1987 Bisbing
4,662,679 A 5/1987 Franck et al.
4,671,481 A 6/1987 Beard
4,677,780 A 7/1987 Shuman
4,681,289 A 7/1987 Gronlund et al.
4,688,750 A 8/1987 Teauge et al.
D292,051 S 9/1987 Martin
4,694,598 A 9/1987 Eisenloeffel
4,699,067 A 10/1987 Okopny
4,703,598 A 11/1987 Wilson et al.
4,703,603 A 11/1987 Hills
4,704,838 A 11/1987 Wendt
4,709,517 A 12/1987 Mitchell et al.
4,722,285 A 2/1988 Goodman
4,726,352 A 2/1988 Radke
4,729,612 A 3/1988 Stone
4,733,841 A 3/1988 Wilson
D295,950 S 5/1988 Johnston
4,755,010 A 7/1988 Wilson et al.
4,774,792 A 10/1988 Ballance
4,776,132 A 10/1988 Gold
D298,784 S 12/1988 Friedman
4,799,436 A 1/1989 Goodman
4,815,364 A 3/1989 Wagner et al.
4,815,797 A 3/1989 Haab et al.
4,821,375 A 4/1989 Kozon
4,824,190 A 4/1989 Bartlett et al.
4,826,115 A 5/1989 Novitski
4,826,123 A 5/1989 Hannah et al.
4,828,120 A 5/1989 Beil et al.
4,834,555 A 5/1989 Grass
4,836,478 A 6/1989 Sweere
4,841,697 A 6/1989 Hogg et al.
4,844,387 A 7/1989 Sorgi et al.
4,852,212 A 8/1989 Amann
4,852,500 A 8/1989 Ryburg et al.
4,863,124 A 9/1989 Ball et al.
4,870,793 A 10/1989 Tomlinson
4,872,567 A 10/1989 Bustos
4,873,852 A 10/1989 Neyret
4,884,375 A 12/1989 Wendt
4,910,982 A 3/1990 Dana
4,920,717 A 5/1990 Hooper, Jr.
4,925,258 A 5/1990 Ludwig et al.
4,947,601 A 8/1990 McGuire
4,949,519 A 8/1990 Jeffers
4,960,258 A 10/1990 Stocker et al.
4,961,295 A 10/1990 Kosch, Sr. et al.
4,971,281 A 11/1990 Steinbeck
D312,734 S 12/1990 Friedman
4,976,502 A 12/1990 Kelley et al.
5,005,492 A 4/1991 Ogino et al.
5,026,130 A 6/1991 Wright et al.
5,035,464 A 7/1991 Spallholtz
5,048,698 A 9/1991 Konrad
5,050,944 A 9/1991 Fricano
5,058,297 A 10/1991 McGinnis
D322,183 S 12/1991 Martin et al.
5,071,281 A 12/1991 Murphy et al.
D323,251 S 1/1992 Zapf
5,078,461 A 1/1992 Beck et al.
5,088,250 A 2/1992 DeLong et al.
5,092,063 A 3/1992 Shultz
5,092,253 A 3/1992 Grund et al.
5,094,174 A 3/1992 Grund et al.
D325,309 S 4/1992 Worrell
5,103,741 A 4/1992 Grund et al.
5,104,182 A 4/1992 Rasnick et al.
5,108,063 A 4/1992 Koerber, Sr. et al.
5,108,165 A 4/1992 Rorke et al.
D327,374 S 6/1992 Perez
5,121,976 A 6/1992 Haab et al.
5,123,549 A 6/1992 Finses et al.
D327,794 S 7/1992 Zapf
5,149,180 A 9/1992 Haab et al.
5,154,388 A 10/1992 Magaro
5,155,955 A 10/1992 Ball et al.
5,158,346 A 10/1992 Marks et al.
D330,641 S 11/1992 Zapf
D330,642 S 11/1992 Zapf
5,160,188 A 11/1992 Rorke et al.
5,172,969 A 12/1992 Reuter et al.
5,176,435 A 1/1993 Pipkens
5,183,319 A 2/1993 Pearson et al.
5,209,035 A 5/1993 Hodges et al.
5,220,871 A 6/1993 Grund et al.
5,226,705 A 7/1993 Rorke et al.
5,230,492 A 7/1993 Zwart et al.
D339,243 S 9/1993 Durling
D339,934 S 10/1993 Reuter
5,249,443 A 10/1993 Anderson
5,251,467 A 10/1993 Anderson
5,265,358 A 11/1993 Borod
5,292,177 A 3/1994 Balderi et al.
5,307,575 A 5/1994 Ivansson et al.
5,307,919 A 5/1994 Wente et al.
5,322,344 A 6/1994 Hoffman et al.
5,335,962 A 8/1994 Gera
5,335,987 A 8/1994 Hodge et al.
5,341,749 A 8/1994 Noakes
5,347,778 A 9/1994 Bray
5,348,385 A 9/1994 Berg
5,360,263 A 11/1994 Nakano et al.
5,371,985 A 12/1994 Suttles
D354,628 S 1/1995 Lee
5,383,318 A 1/1995 Kelley et al.
5,384,978 A 1/1995 Peters
D355,981 S 3/1995 Kim
5,394,658 A 3/1995 Schreiner et al.
5,398,622 A 3/1995 Lubinskas et al.
5,399,010 A 3/1995 McClung et al.
5,409,308 A 4/1995 Reuter et al.
5,410,899 A 5/1995 McConnell
D359,394 S 6/1995 Durling
5,423,450 A 6/1995 Shillington et al.
5,425,577 A 6/1995 Gembler
5,435,159 A 7/1995 Ramsauer
5,437,426 A 8/1995 MacDonald
5,448,859 A 9/1995 Walker et al.
5,450,701 A 9/1995 White
5,452,936 A 9/1995 Koehring
5,454,331 A 10/1995 Green
5,454,638 A 10/1995 Bird et al.
5,470,128 A 11/1995 Kerkham
5,470,143 A 11/1995 Gill
D366,770 S 2/1996 Mabon
5,494,246 A 2/1996 McCarthy et al.
D368,218 S * 3/1996 Klein, III ..... D8/354
5,511,349 A 4/1996 Kelley et al.
5,517,731 A 5/1996 Spykerman
5,520,451 A 5/1996 Oshima
5,524,979 A 6/1996 Carson et al.
5,530,993 A 7/1996 Hayakawa
5,538,213 A 7/1996 Brown
5,566,844 A 10/1996 Bernardin
D375,726 S 11/1996 Witte
5,571,276 A 11/1996 Kobos et al.
D376,705 S 12/1996 Stoddard et al.
5,606,920 A 3/1997 Meyer et al.

5,607,070 A 3/1997 Hellyer
5,609,317 A 3/1997 Glynn et al.
5,626,404 A 5/1997 Kelley et al.
5,630,566 A 5/1997 Case
5,632,542 A 5/1997 Krivec
5,645,333 A 7/1997 Sakurai
5,664,749 A 9/1997 Kump et al.
5,685,113 A 11/1997 Reuter et al.
D391,243 S 2/1998 Rosen
D391,262 S 2/1998 Rosen
D391,946 S 3/1998 Rosen
5,746,490 A 5/1998 Domenig
5,749,125 A 5/1998 Davis et al.
5,758,937 A 6/1998 Lammens et al.
D395,874 S 7/1998 Rosen
D395,896 S 7/1998 Rosen
D396,042 S 7/1998 Rosen
5,775,786 A 7/1998 Lieberts
5,784,843 A 7/1998 Greer et al.
5,785,401 A 7/1998 Bowyer et al.
5,791,751 A 8/1998 Meyer et al.
5,791,752 A 8/1998 Hartman
5,799,430 A 9/1998 Fremstad
5,806,942 A 9/1998 Jenkins, Jr. et al.
5,820,208 A 10/1998 Miklinevich
5,823,120 A 10/1998 Holmquist
5,833,332 A 11/1998 Marshall et al.
5,839,240 A 11/1998 Elsholz et al.
5,842,743 A 12/1998 Wright et al.
5,845,980 A 12/1998 Fricano et al.
5,852,904 A 12/1998 Yu et al.
5,870,867 A 2/1999 Mitchell
5,871,189 A 2/1999 Hoftman
D407,011 S 3/1999 Boije
5,881,518 A 3/1999 Edwards et al.
5,884,424 A 3/1999 Smith
5,890,784 A 4/1999 Domig
5,893,616 A 4/1999 MacDonald et al.
5,897,147 A 4/1999 Alyanakian et al.
5,899,035 A 5/1999 Waalkes et al.
5,904,411 A 5/1999 Hayakawa
5,904,412 A 5/1999 Lammens
5,918,432 A 7/1999 Mahone et al.
5,934,115 A 8/1999 Bernier et al.
5,941,488 A 8/1999 Rosen
5,944,398 A 8/1999 Wu
5,946,772 A 9/1999 DeBower
5,950,371 A 9/1999 Rives et al.
5,953,882 A 9/1999 Vallance et al.
5,957,530 A 9/1999 Gutgsell
5,966,893 A 10/1999 Quillin
5,971,514 A 10/1999 Hayakawa
5,975,658 A 11/1999 Verbeek et al.
5,979,118 A 11/1999 Gortsema et al.
5,980,007 A 11/1999 Singh
5,988,576 A 11/1999 Ehrlich
5,996,954 A 12/1999 Rosen et al.
6,007,036 A 12/1999 Rosen
6,007,171 A 12/1999 Varellas-Olree
6,009,675 A 1/2000 Waalkes et al.
6,019,331 A 2/2000 Hoogland et al.
6,047,509 A 4/2000 Savoie
6,048,127 A 4/2000 Kern et al.
6,053,585 A 4/2000 Osen
6,058,667 A 5/2000 MacDonald et al.
6,073,412 A 6/2000 Verch
6,076,308 A 6/2000 Lyon et al.
6,076,474 A 6/2000 Grabowski et al.
6,097,590 A 8/2000 Genevieve et al.
6,098,358 A 8/2000 Waalkes et al.
D430,743 S 9/2000 Pomeroy et al.
6,115,977 A 9/2000 Hornsberger et al.
6,123,402 A 9/2000 Bowyer et al.
D432,404 S 10/2000 Garfinkle
D432,816 S 10/2000 Hellwig et al.
6,131,347 A 10/2000 Hornsberger et al.
6,138,484 A 10/2000 Sauerland et al.
6,138,583 A 10/2000 Mahone et al.
6,138,584 A 10/2000 Waite
6,148,567 A 11/2000 DeRuiter et al.
6,161,347 A 12/2000 Yu et al.
6,167,664 B1 1/2001 Reuter et al.
6,167,665 B1 1/2001 Dame et al.
6,173,660 B1 1/2001 Emmert
6,179,263 B1 1/2001 Rosen et al.
6,196,648 B1 3/2001 Henriott
6,202,965 B1 3/2001 Chong
6,202,966 B1 3/2001 MacDonald et al.
6,223,485 B1 5/2001 Beck et al.
6,227,635 B1 5/2001 Teppo et al.
6,256,941 B1 7/2001 Yu et al.
6,273,534 B1 8/2001 Bueley et al.
6,279,278 B1 8/2001 Morris et al.
6,282,854 B1 9/2001 Vos et al.
6,296,337 B1 10/2001 Kawanabe
D450,937 S 11/2001 Pomeroy et al.
D451,004 S 11/2001 Lewis
6,330,773 B1 12/2001 MacDonald et al.
6,339,891 B1 1/2002 Cox
6,341,457 B1 1/2002 Aerts et al.
6,349,911 B1 2/2002 Feldpausch et al.
6,361,132 B2 3/2002 Kawanabe
6,363,663 B1 4/2002 Kane et al.
6,367,213 B1 4/2002 Reuter et al.
6,378,255 B1 4/2002 Eich et al.
6,393,676 B1 5/2002 Dowzall et al.
6,394,564 B1 5/2002 Mrotz, III et al.
6,394,566 B1 5/2002 Slivon et al.
6,397,533 B1 6/2002 Hornsberger et al.
6,402,644 B2 6/2002 Stanford et al.
6,408,579 B1 6/2002 Anderson et al.
D459,924 S 7/2002 Heidmann et al.
6,415,567 B1 7/2002 Mead et al.
6,416,145 B1 7/2002 Singh
6,418,671 B1 7/2002 DeRuiter et al.
6,419,209 B1 7/2002 Shepherd
6,434,905 B1 8/2002 Sprague
6,435,635 B1 8/2002 Lyon
6,438,884 B1 8/2002 Saarnia et al.
6,442,909 B2 9/2002 Waalkes et al.
6,449,909 B1 9/2002 Baloga et al.
6,453,826 B1 9/2002 Fookes et al.
6,464,423 B1 10/2002 Klein
6,471,312 B1 10/2002 Coffey et al.
6,484,647 B2 11/2002 Lininger, Jr. et al.
6,487,978 B1 12/2002 Hamberg
6,536,858 B1 3/2003 Heidmann et al.
6,536,860 B1 3/2003 Heidmann et al.
6,550,875 B1 4/2003 Compton et al.
6,554,354 B1 4/2003 Hoffman et al.
6,557,310 B2 5/2003 Marshall et al.
6,557,958 B1 5/2003 Motta et al.
6,574,835 B2 6/2003 Mulhuish
6,574,928 B2 6/2003 Mueller et al.
6,588,866 B2 7/2003 Cheng
6,591,555 B2 7/2003 King et al.
6,592,194 B2 7/2003 Lininger et al.
6,609,285 B1 8/2003 Kinney
6,625,935 B1 9/2003 King et al.
6,626,407 B1 9/2003 Miller et al.
D482,596 S 11/2003 Laabs et al.
6,640,387 B2 11/2003 Alonso
6,644,748 B2 11/2003 Tholkes et al.
6,648,047 B2 11/2003 Kimmet
6,658,677 B2 12/2003 Paul
6,658,778 B2 12/2003 Roy
6,658,805 B1 12/2003 Yu et al.
6,669,315 B2 12/2003 Heidmann et al.
D484,709 S 1/2004 Cronk et al.
6,684,929 B2 2/2004 MacDonald et al.
6,691,626 B2 2/2004 Warner
6,695,270 B1 2/2004 Smed
6,701,758 B2 3/2004 Hoffmann
6,702,372 B2 3/2004 Tholkes et al.
6,711,871 B2 3/2004 Beirise et al.
6,718,709 B2 4/2004 Koutras et al.
6,719,337 B1 4/2004 Ji
6,726,035 B2 4/2004 Zadak 6,732,988 B2 5/2004 Ihalainen et al.
6,736,360 B1 5/2004 Buczek
6,736,364 B2 5/2004 Oddsen, Jr.
6,748,710 B2 6/2004 Gresham et al.
6,748,778 B1 6/2004 Higdon et al.
6,754,998 B2 6/2004 Diffrient et al.
6,759,589 B1 7/2004 VandeVelde
6,761,004 B2 7/2004 Anglin et al.
6,764,148 B2 7/2004 Morris et al.
6,779,856 B2 8/2004 Hornberger et al.
6,783,105 B2 8/2004 Oddsen, Jr.
6,807,776 B2 10/2004 Girdwood et al.
6,817,147 B1 11/2004 MacDonald
6,817,149 B2 11/2004 Diffrient et al.
6,827,376 B2 12/2004 Fountaine
6,848,741 B2 2/2005 Ford et al.
6,851,226 B2 2/2005 MacGregor et al.
6,854,233 B2 2/2005 Pitsch et al.
6,863,358 B2 3/2005 Beyer et al.
6,896,102 B1 5/2005 Nichol
D506,630 S 6/2005 Schweikarth
6,912,818 B2 7/2005 Sprague
6,920,727 B2 7/2005 Yu et al.
6,942,306 B2 9/2005 Youngs et al.
6,964,138 B2 11/2005 Carroll et al.
6,964,410 B1 11/2005 Hansen
6,966,206 B2 11/2005 Masseth, Jr. et al.
6,968,661 B2 11/2005 Kopish et al.
6,988,780 B2 1/2006 Anderson et al.
6,990,909 B2 1/2006 Gosling et al.
6,994,410 B2 2/2006 Hogan
D517,345 S 3/2006 Verbeek et al.
7,014,155 B1 3/2006 Schnabel et al.
7,021,730 B2 4/2006 Remmers
7,036,799 B2 5/2006 Shepherd
7,055,287 B2 6/2006 Yu et al.
D525,441 S 7/2006 Pomeroy et al.
7,117,802 B2 10/2006 Hoke, Jr. et al.
7,117,927 B2 10/2006 Kent et al.
7,146,766 B2 12/2006 Finkelstein
7,146,831 B2 12/2006 Antonucci et al.
7,210,270 B1 5/2007 King et al
7,237,845 B2 7/2007 Mulmed
2001/0024984 A1 9/2001 Stanford et al.
2002/0043349 A1 4/2002 Rigby et al.
2002/0066843 A1 6/2002 Oddsen, Jr. et al.
2002/0079789 A1 6/2002 Grubb et al.
2002/0108330 A1 8/2002 Yu et al.
2002/0112411 A1 8/2002 Gravel et al.
2002/0113532 A1 8/2002 Hornsberger et al.
2002/0121755 A1 9/2002 Workman et al.
2002/0126110 A1 9/2002 Bowron
2003/0051415 A1 3/2003 Remelts et al.
2003/0085328 A1 5/2003 Oddsen, Jr.
2003/0160551 A1* 8/2003 Beyer et al. ..... 312/323
2003/0173878 A1* 9/2003 Youngs et al. ..... 312/257.1
2003/0196392 A1 10/2003 Edwards
2003/0233965 A1 12/2003 Braxier
2004/0020137 A1 2/2004 Battey et al.
2004/0035082 A1 2/2004 Hudoba et al.
2004/0036391 A1 2/2004 Vardon
2004/0055713 A1 3/2004 Kimmet
2004/0094072 A1 5/2004 Fabian
2004/0163574 A1 8/2004 Schoenbach et al.
2004/0178312 A1 9/2004 Parsons
2004/0200034 A1 10/2004 Salice
2004/0217677 A1 11/2004 Durand et al.
2004/0222725 A1 11/2004 Park et al.
2004/0239217 A1 12/2004 Patel
2004/0250480 A1 12/2004 Matthai
2004/0254020 A1 12/2004 Dragusin
2005/0006997 A1 1/2005 Yoshioka
2005/0022699 A1 2/2005 Goza
2005/0045787 A1 3/2005 Magnusson
2005/0045788 A1 3/2005 Mongeau
2005/0046243 A1 3/2005 Cimino et al.
2005/0052058 A1 3/2005 Nyo et al.
2005/0067925 A1 3/2005 Stone, III
2005/0073224 A1 4/2005 Livingston et al.
2005/0091899 A1 5/2005 Houssian
2005/0093409 A1 5/2005 Vardon
2005/0204646 A1 9/2005 Tupper et al.
2005/0264144 A1 12/2005 Verbeek et al.
2005/0280341 A1 12/2005 Vardon
2005/0284025 A1 12/2005 Balbo De Vinadio
2006/0049327 A1 3/2006 Chen
2006/0050471 A1 3/2006 Chen
2006/0050472 A1 3/2006 Chen
2006/0113443 A1 6/2006 Remmers
2006/0163981 A1 7/2006 Conrad
2006/0230705 A1 10/2006 Grandi et al.
2006/0267466 A1 11/2006 Marroquin et al.
2007/0138843 A1 6/2007 Jonsson et al.

* cited by examiner

FURNITURE STORAGE UNIT

CROSS REFERENCE TO RELATED APPLICATIONS

The present application claims benefit under 35 U.S. C. §119(e) of provisional application Ser. No. 60/940,913, filed May 30, 2007, entitled FURNITURE STORAGE UNIT AND METHOD; provisional application Ser. No. 60/940,879, entitled STORAGE UNIT ATTACHMENT SYSTEM AND METHODS, filed May 30, 2007; provisional application Ser. No. 60/940,899, entitled STORAGE UNIT DOOR APPARATUS AND METHOD, filed May 30, 2007; and provisional application Ser. No. 60/940,891 filed May 30, 2007, entitled STORAGE UNIT BACK STOP AND METHOD, and is related to co-pending application entitled STORAGE UNIT BACK STOP AND METHOD, filed on even date herewith. The entire contents of each of the aforementioned applications are incorporated herein by reference.

BACKGROUND OF THE INVENTION

The present invention relates to storage units for office furniture and the like, and in particular to an adaptable modular construction therefor.

Modular office systems are oftentimes used to convert large open floor spaces in buildings into individual workstations and other useable office settings. Due to constantly changing work environments, office systems that are versatile and allow for easy and convenient rearrangement are quite beneficial. Some panel systems require specifically configured storage components and case assemblies, and therefore lack the ability to interface with other types of furniture systems.

In an effort to increase the versatility of storage units, components that may be used across a wide variety of furniture systems and in multiple storage unit assemblies would be useful. In the past, such arrangements have proven difficult to design and costly to produce. Accordingly, a storage unit construction and associated components that can be used in multiple office environments with fewer parts and provide easy installation is desired and would be considered advantageous.

SUMMARY OF THE INVENTION

One aspect of the present invention is a storage unit assembly for office furniture units of the type having an outer face with slotted hangers extending therealong, and includes a bottom panel operably positioned in a generally horizontal orientation, and shaped to abuttingly support objects thereon. A top panel is disposed above and generally parallel with the bottom panel, and is shaped to cover at least a portion of the bottom panel. First and second end panels are disposed at opposite ends of the top and bottom panels and are connected therewith to define a rigid, box-shaped case having a generally rigid bottom portion and a generally open back portion. First and second end panels have rear portions with a plurality of vertically spaced apart slots disposed therein. First and second hanger brackets each have a rear portion with first hooks shaped for reception in the slotted hangers of an associated one of the office furniture units, and a forward portion with second hooks selectively received in the slots in the rear portions of the first and second end panels to detachably support the case in a panel-hung condition against the outer face of the associated one of the office furniture units. An up-mount bracket has a lower portion shaped for connection with an associated one of the office furniture units, and an upper portion connected with and supporting the bottom portion of the case to detachably mount the case in an up-mounted condition above a top portion of the associated one of the furniture units. A removable back panel is shaped to enclose at least a portion of the open back portion of the case, and has side portions with outwardly protruding hooks selectively received in the slots in the rear portions of the first and second end panels to detachably connect the back panel with the case and enclose at least that portion of the open back portion of the case disposed above the top portion of the associated one of the office furniture units when the case is in the up-mounted condition.

Another aspect of the present invention is an office furniture unit having an outer face with slotted hangers extending therealong, and a removable storage unit assembly including a bottom panel operably positioned in a generally horizontal orientation along the office furniture unit, and a top panel disposed above and generally parallel with the bottom panel. First and second panels are disposed at opposite ends of the top and bottom panels and are connected therewith to define a rigid, box-shaped case having a generally open back portion. The first and second end panels have rear portions with a plurality of vertically spaced apart slots disposed therein. First and second hanger brackets each have a rear portion with first hooks selectively received in the slotted hangers of the office furniture units, and a forward portion with second hooks selectively received in the slots in the rear portions of the first and second end panels to detachably support the case in a panel-hung condition against the outer face of the office furniture unit.

Yet another aspect of the present invention is an office furniture unit, and a storage unit assembly including a bottom panel operably positioned in a generally horizontal orientation along the office furniture unit. A top panel is disposed above and generally parallel with the bottom panel. First and second end panels are disposed at opposite ends of the top and bottom panels and are connected therewith to define a rigid, box-shaped case having a generally rigid bottom portion and a generally open back portion. The first and second end panels have rear portions with a plurality of vertically spaced apart slots disposed therein. An up-mount bracket has a lower portion connected with the office furniture unit, and an upper portion connected with and supporting the bottom portion of the case to detachably mount the case in an up-mounted condition above a top portion of the furniture unit. A removable back panel encloses at least a portion of the open back portion of the case, and has side portions with outwardly protruding hooks received in the slots in the rear portions of the first and second end panels to detachably connect the back panel with the case and encloses at least that portion of the open back portion of the case disposed above the top portion of the office furniture unit.

Yet another aspect of the present invention is a method for making a storage unit assembly for office furniture units of the type having a like construction with slotted hangers extending along outer faces thereof including forming a bottom panel shaped to abuttingly support objects thereon. A top panel is formed in a shape to cover at least a portion of the bottom panel. The top panel is positioned in a generally parallel, spaced apart relationship with the bottom panel. First and second end panels are formed with rear portions having a plurality of vertically spaced apertures therein. The first and second end panels are positioned at opposite ends of the top and bottom panels and interconnected with the same to define a rigid, box-shaped case having a generally rigid bottom portion and a generally open back portion. First and second hanger brackets are formed, each having a rear portion with first hooks shaped for reception in the slotted hangers of a first selected one of the office furniture units, and a forward portion with second hooks shaped for reception in the slots in the rear portions of the first and second end panels. The first hooks on the first and second hanger brackets are inserted into the slotted hangers on the first selected furniture unit. The second hooks on the first and second hanger brackets are inserted into the slots in the rear portions of the first and second end panels to detachably support the case in a panel-hung condition against the outer face of the first selected office furniture unit. An up-mount bracket is formed with a lower portion shaped for connection with a second selected one of the office furniture units, and an upper portion shaped for connection with the bottom portion of said case. The lower portion of the up-mount bracket is mounted with the second selected furniture unit. The upper portion of the up-mount bracket is connected with the bottom portion of the case to detachably mount the case in an up-mounted condition above a top portion of the second selected furniture unit. A removable back panel is formed in a shape to enclose at least a portion of the open back portion of the case, and has side portions with outwardly protruding hooks shaped for reception in the slots in the rear portions of the first and second end panels. The hooks on the back panel are inserted into the slots in the rear portions of the first and second end panels to detachably connect the back panel with the case and enclose at least that portion of the open back portion of the case disposed above the top portion of the second selected office furniture unit when the case is in the up-mounted condition.

Yet another aspect of the present invention is to provide a storage unit assembly adapted to be secured to a variety of different types of furniture systems and which includes components that can be used in a wide variety of storage unit assemblies. The kit of parts associated with these storage unit assemblies is efficient in use, economical to manufacture, capable of a long operating life, and particularly adapted for its proposed use.

These and other features, advantages and objects of the present invention will be further understood and appreciated by those skilled in the art by reference to the following written specification, claims and appended drawings.

BRIEF DESCRIPTION OF THE DRAWINGS

FIG. 107A is a side elevational view of a storage unit assembly of the instant invention in a panel hung off-module condition;

FIG. 107B is an enlarged side elevational view of a storage unit assembly of the instant invention in a panel hung off-module condition;

Figure 107A:
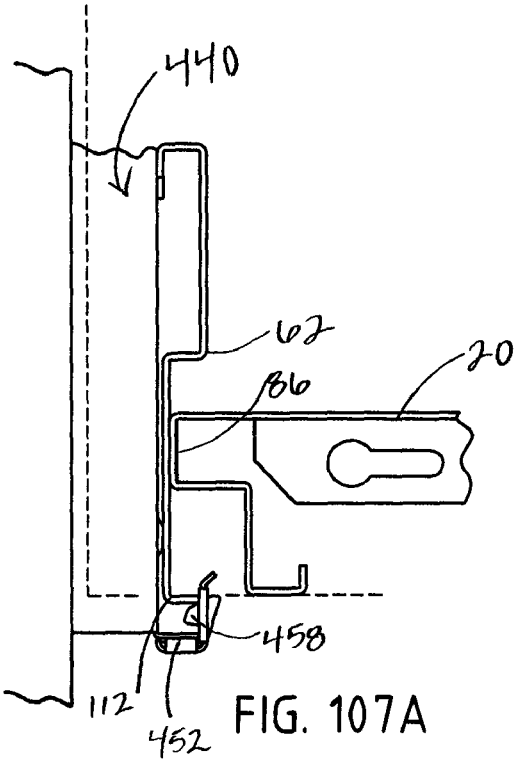
Figure 107B:
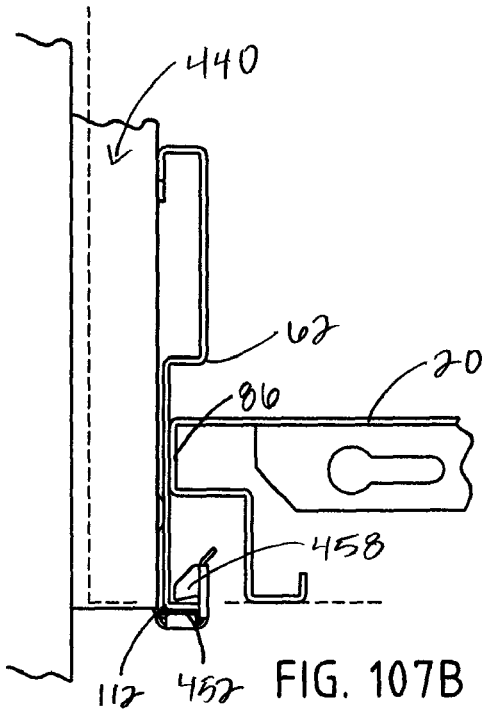
Figure 107C:
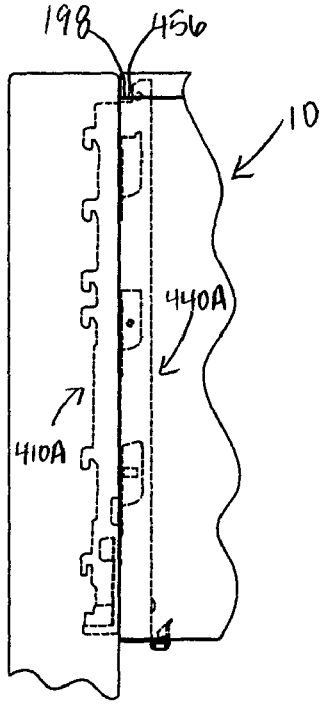
Figure 108:
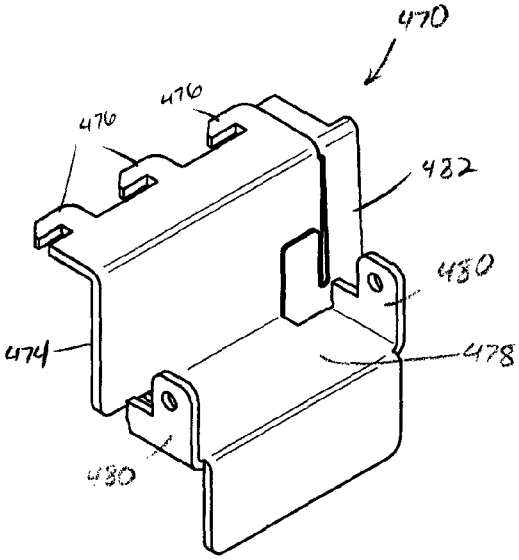
Figure 109:
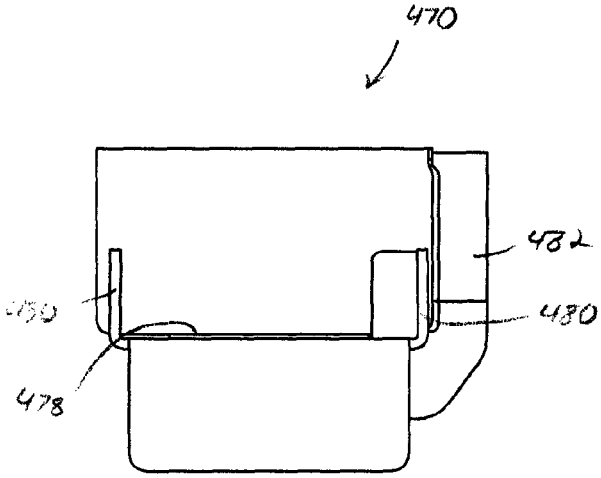
Figure 110:
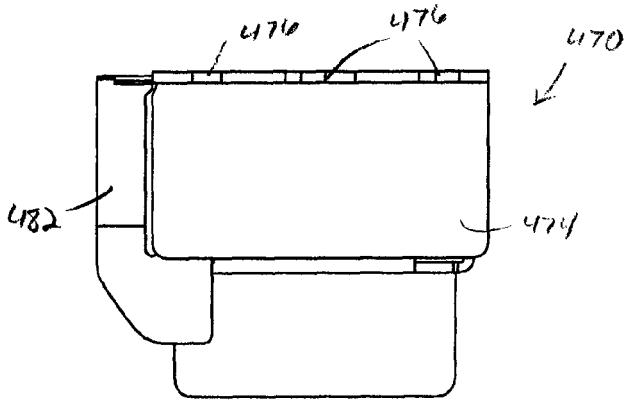
Figure 111:
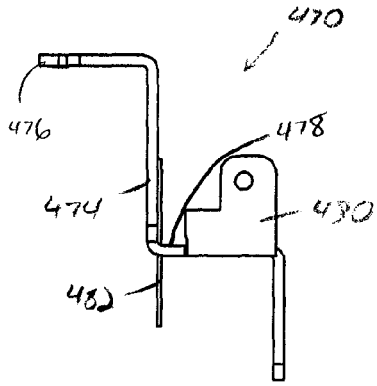
Figure 112:
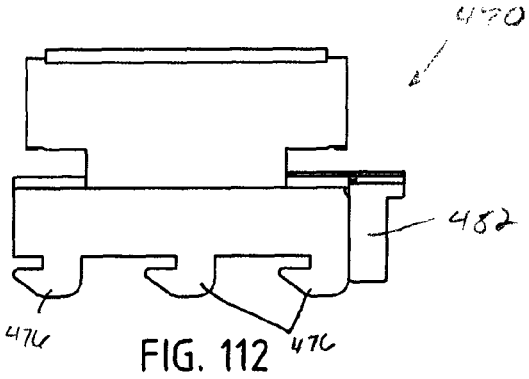
Figure 113:
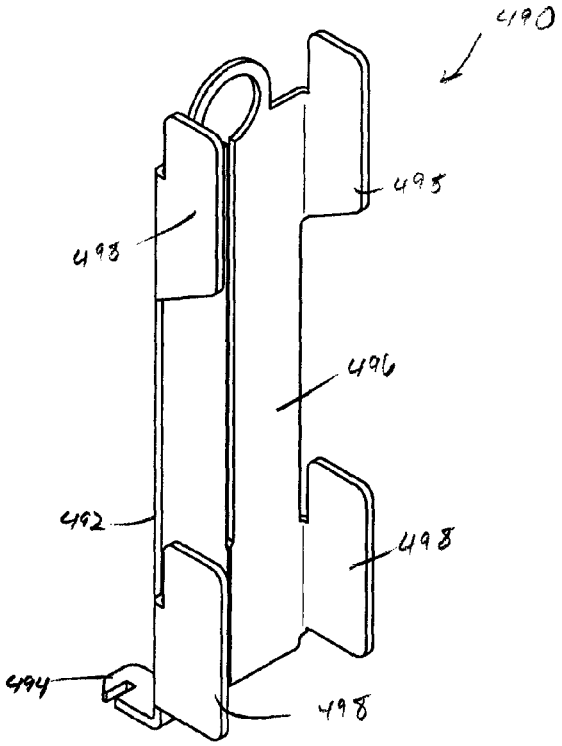
Figure 114:
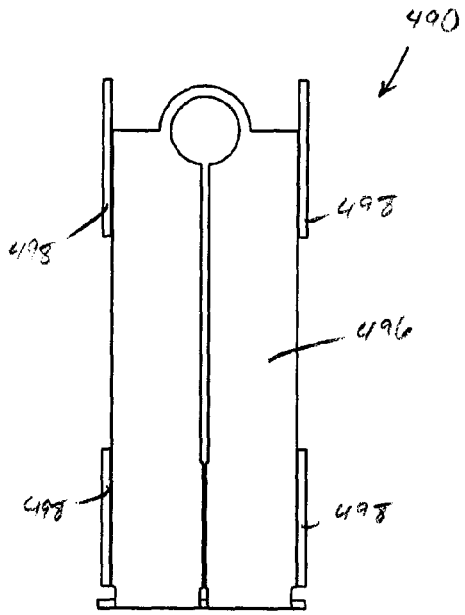
Figure 115:
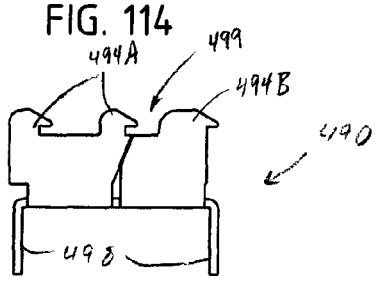
Figure 116:
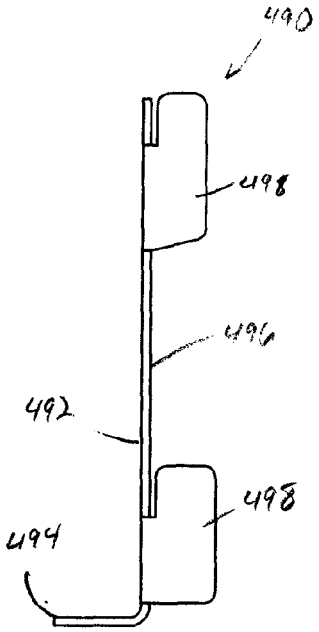
Figure 117:
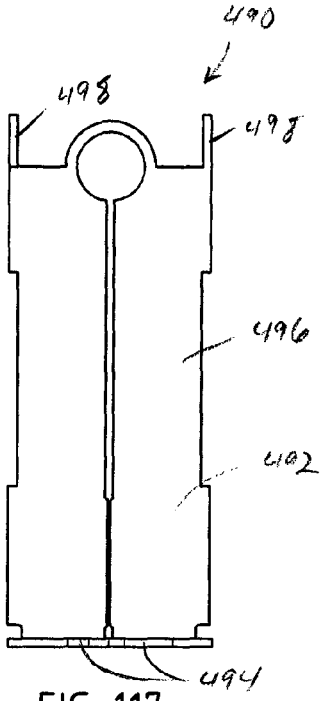
Figure 118:
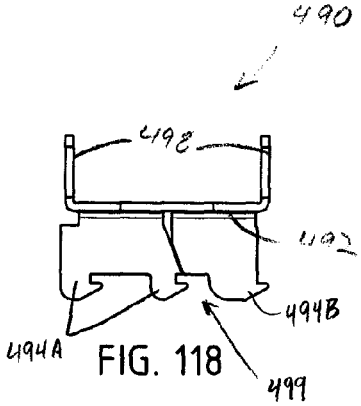
Figure 119:
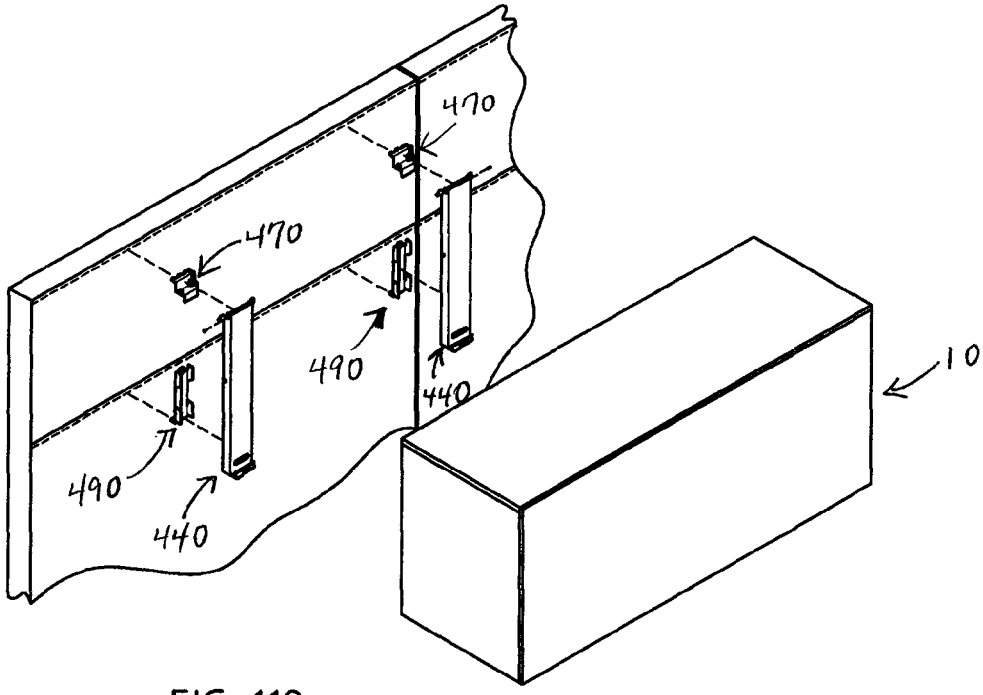
Figure 120:
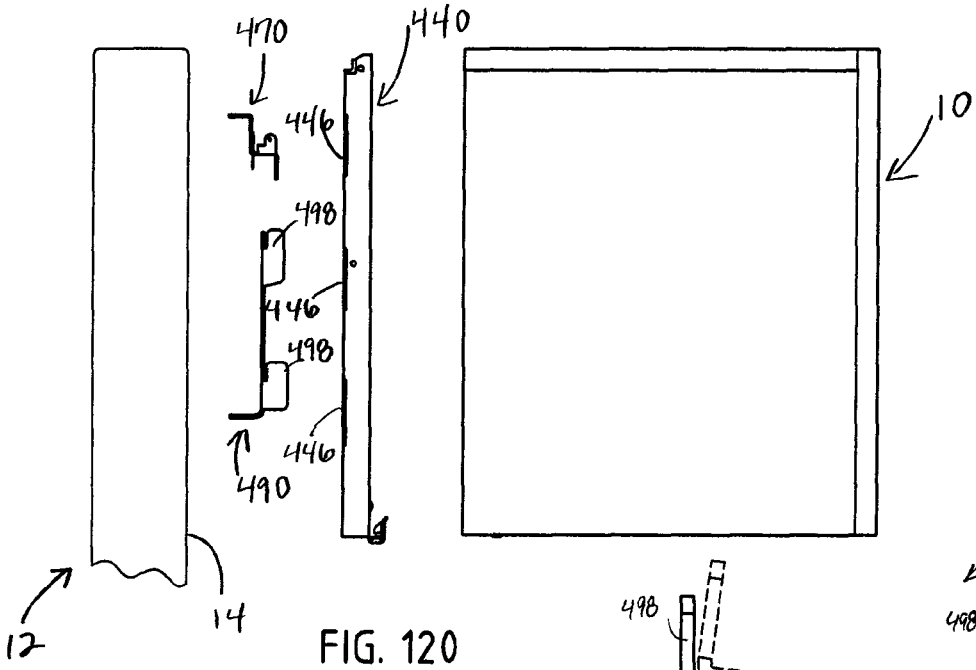
Figure 120A:
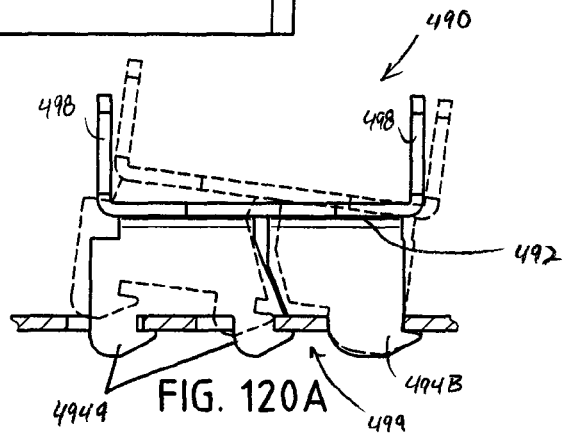
Figure 121:
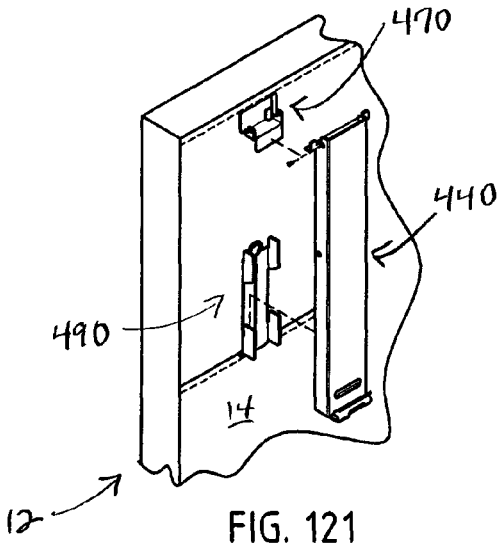
Figure 122:
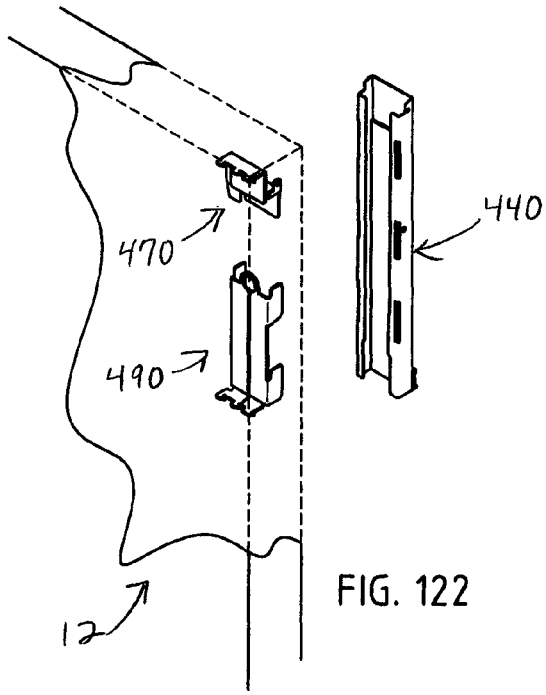
Figure 123:
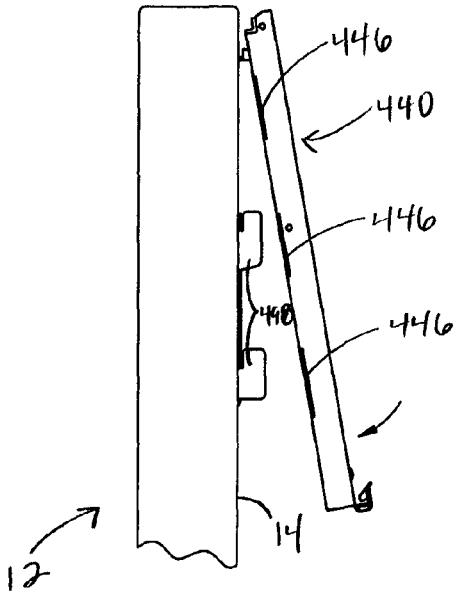
Figure 124:
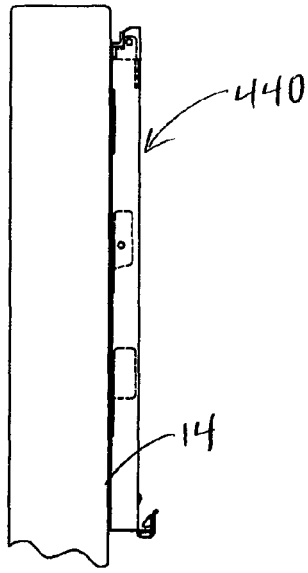
Figure 125:
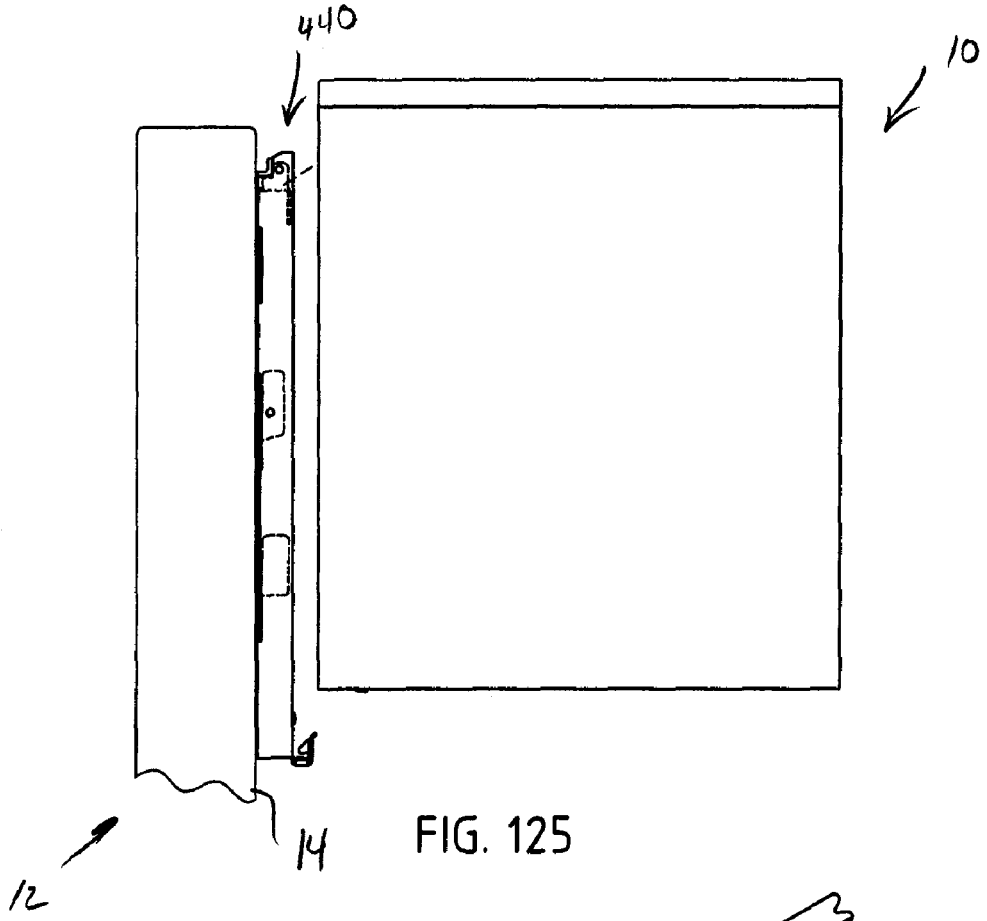
Figure 126:
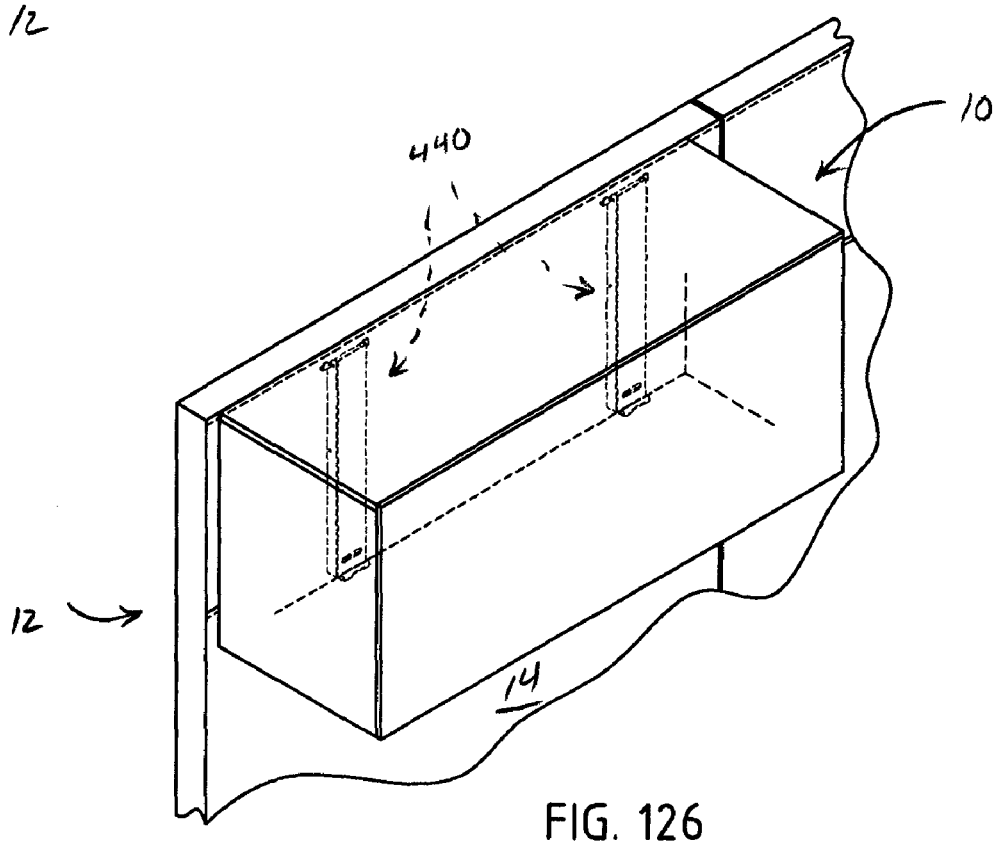
Figure 127:
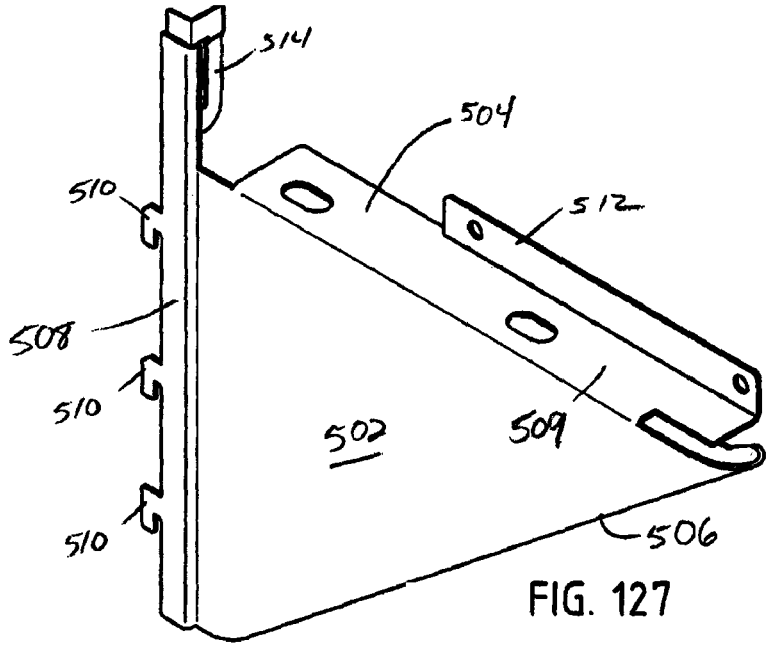
Figure 128:
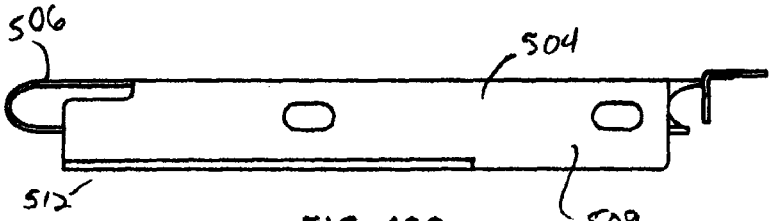
Figure 129:
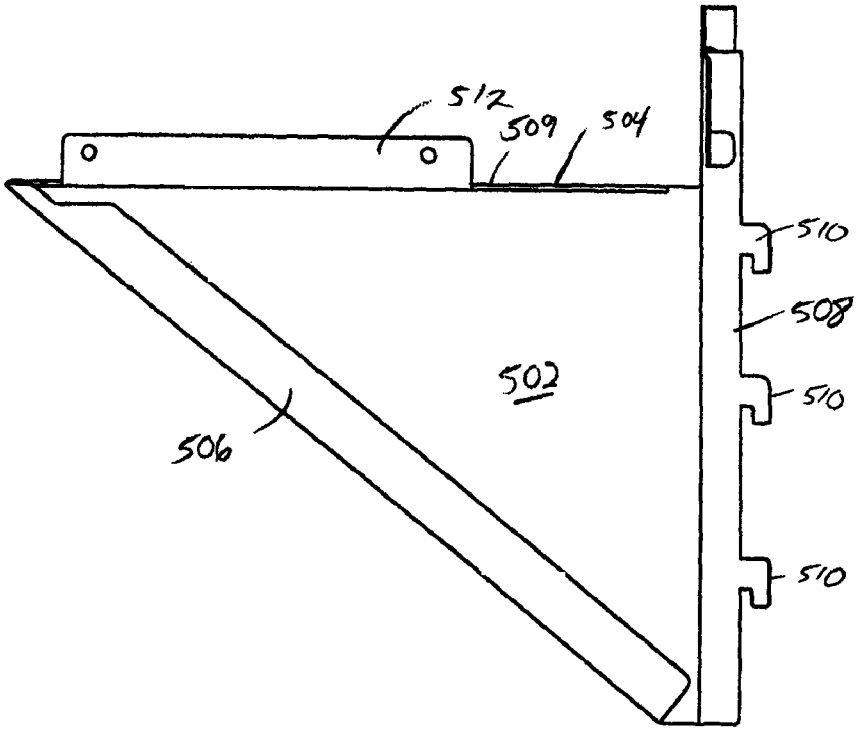
Figure 130:
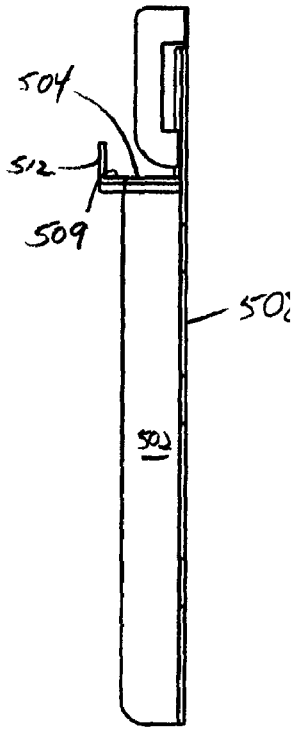
Figure 131:
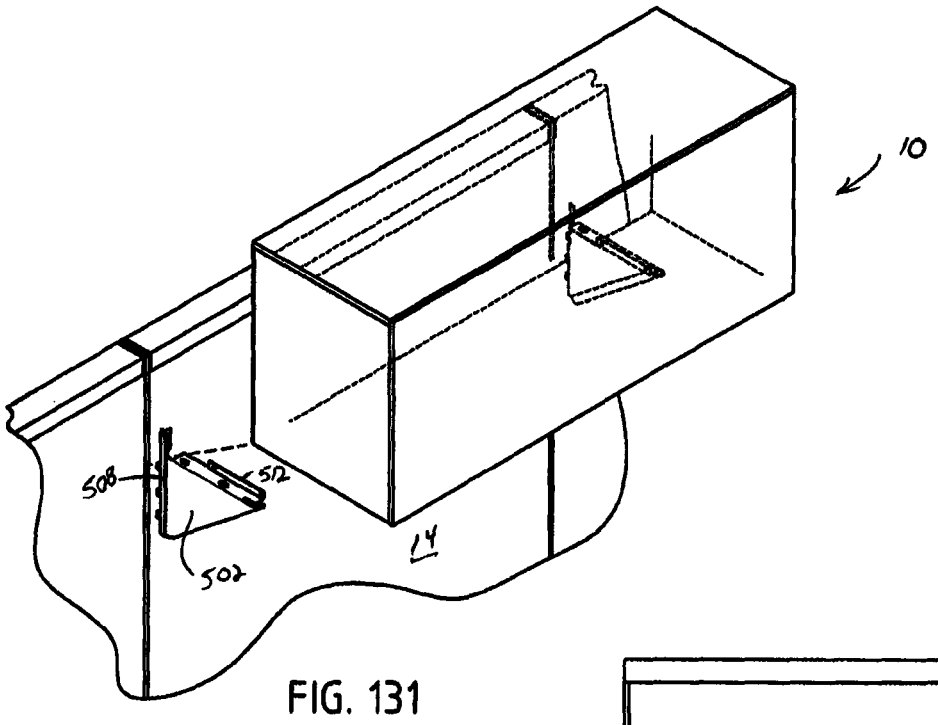
Figure 132:
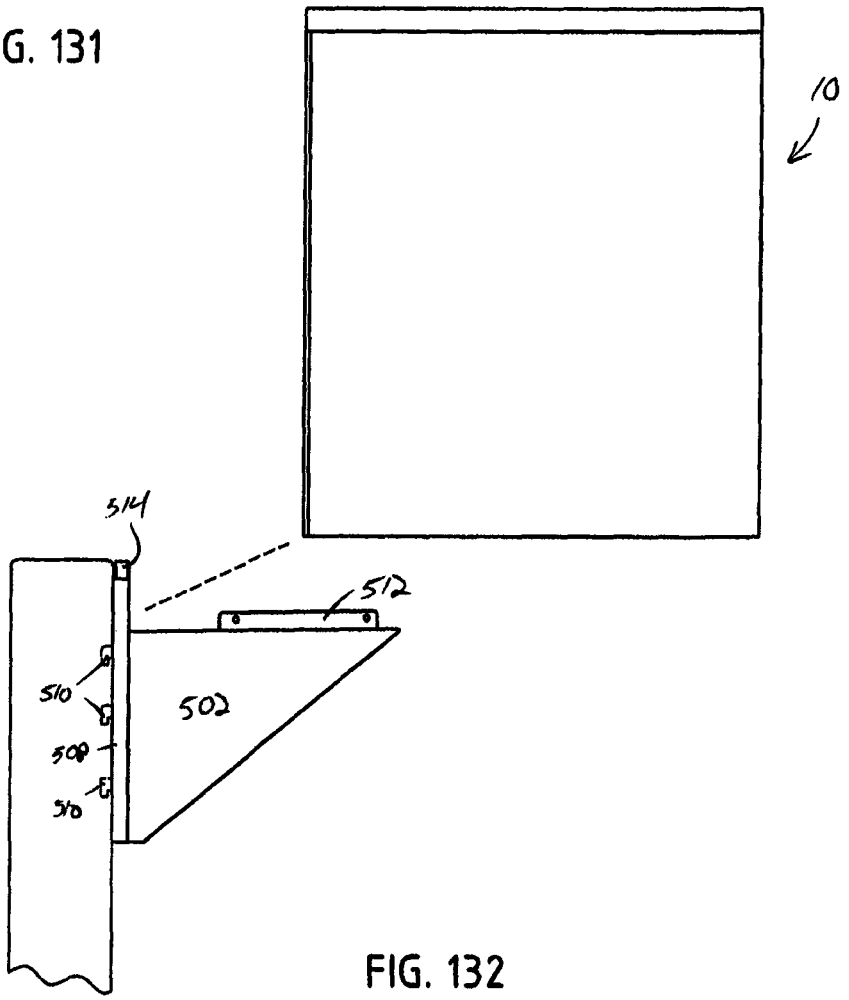
Figure 133A:
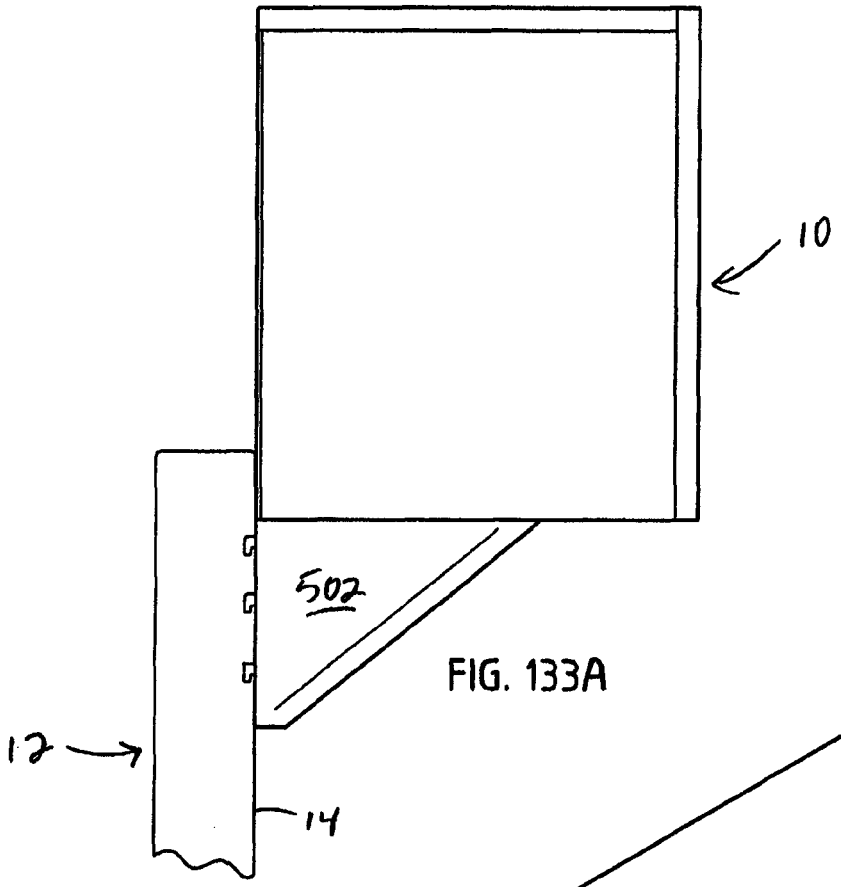
Figure 134:
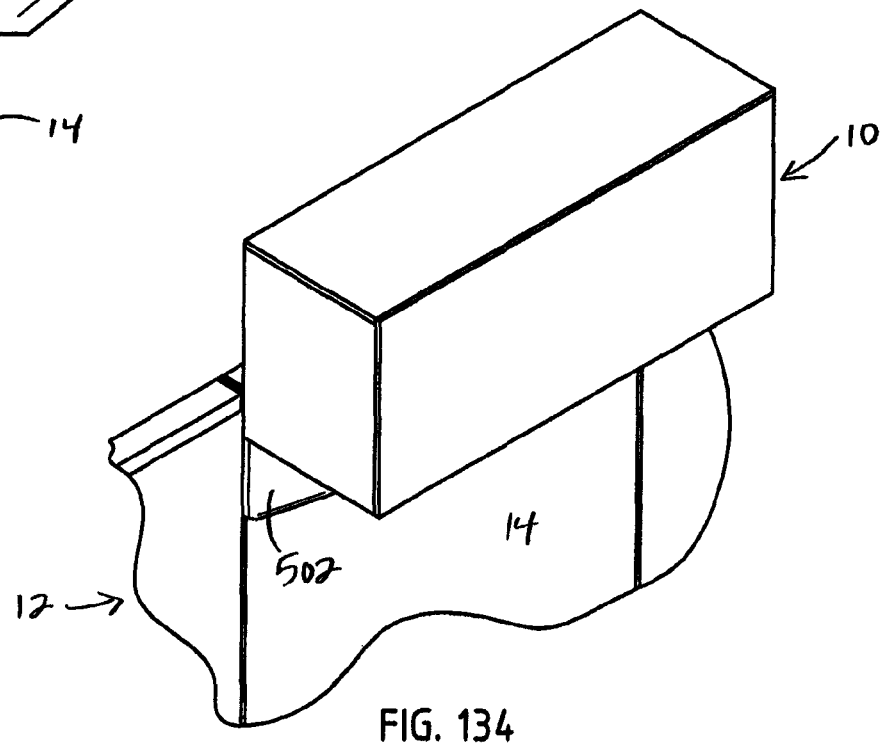
Figure 133B:
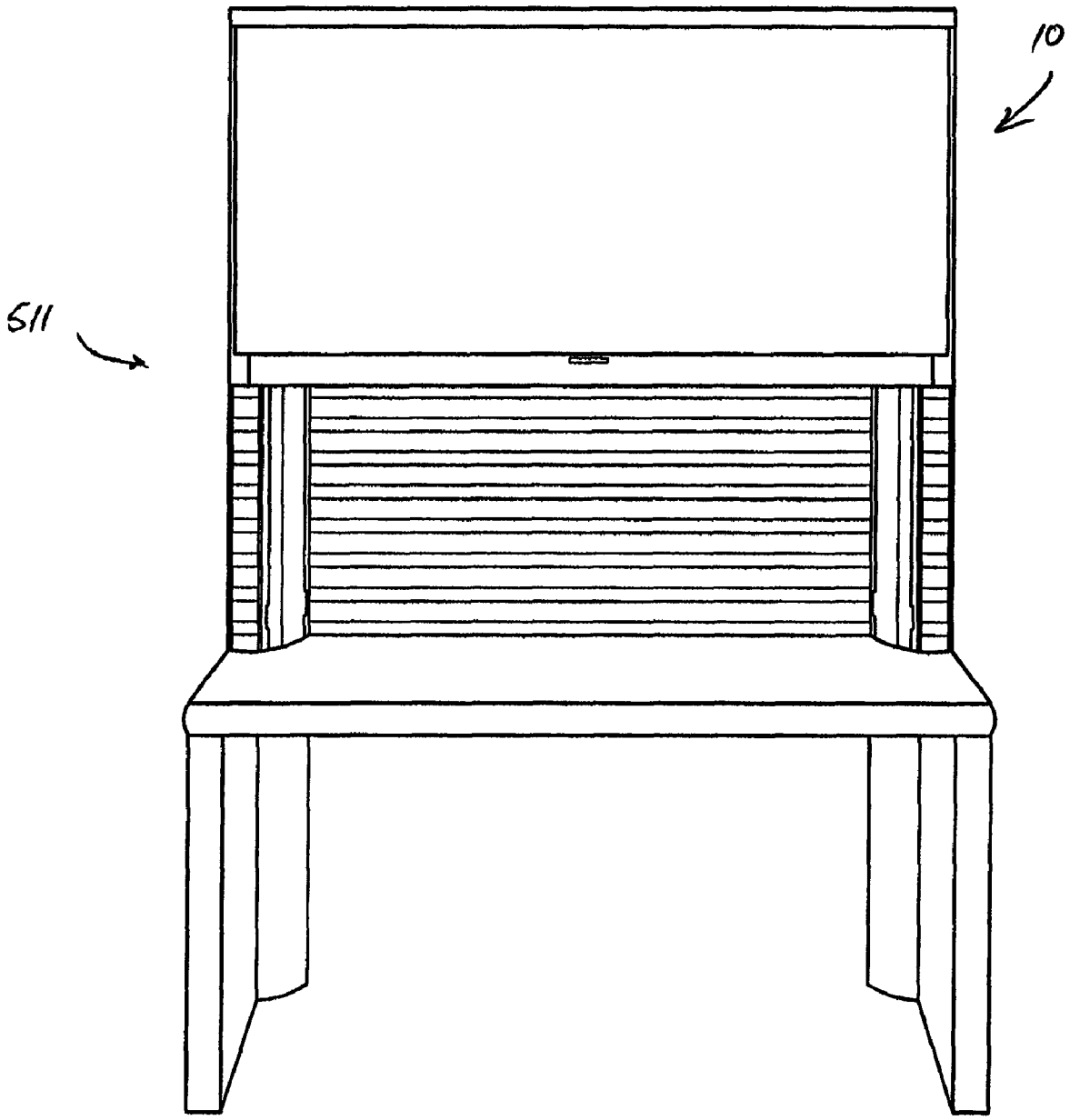
Figure 135:
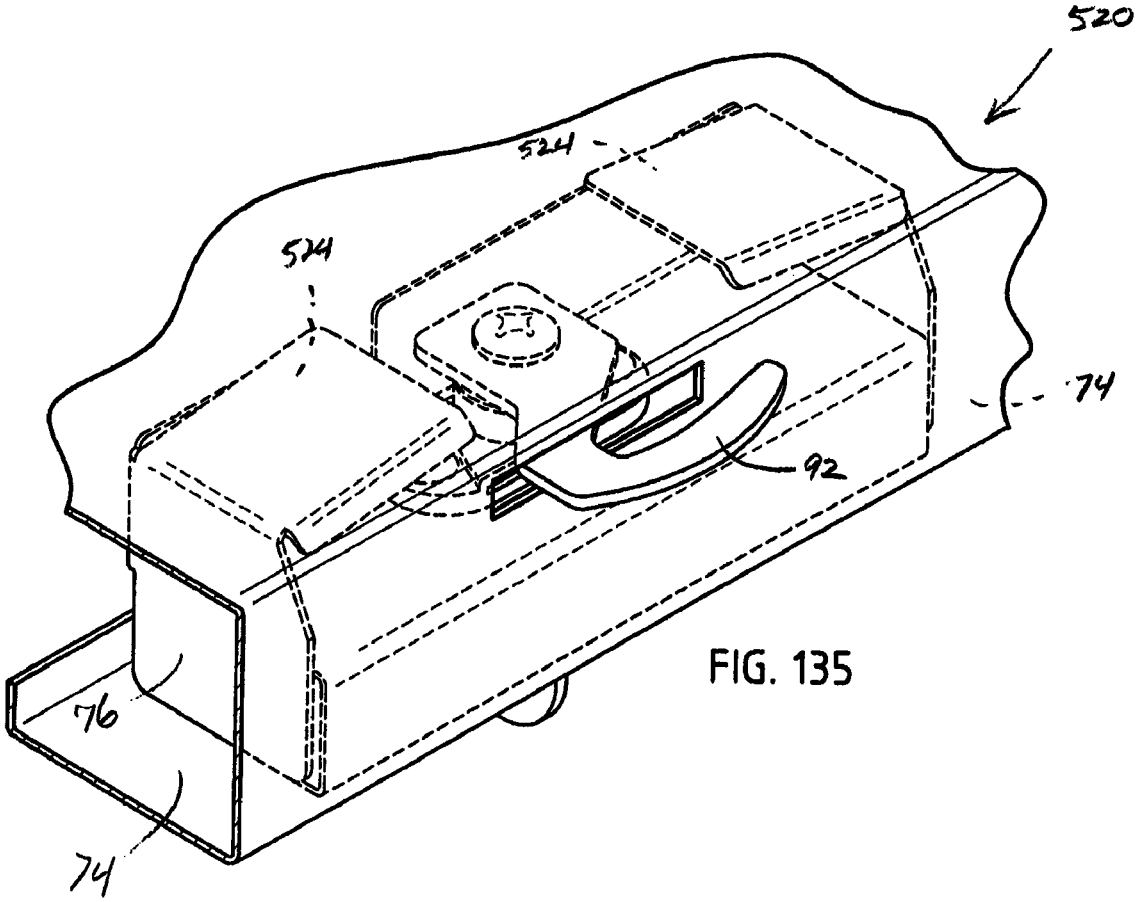
Figure 136:
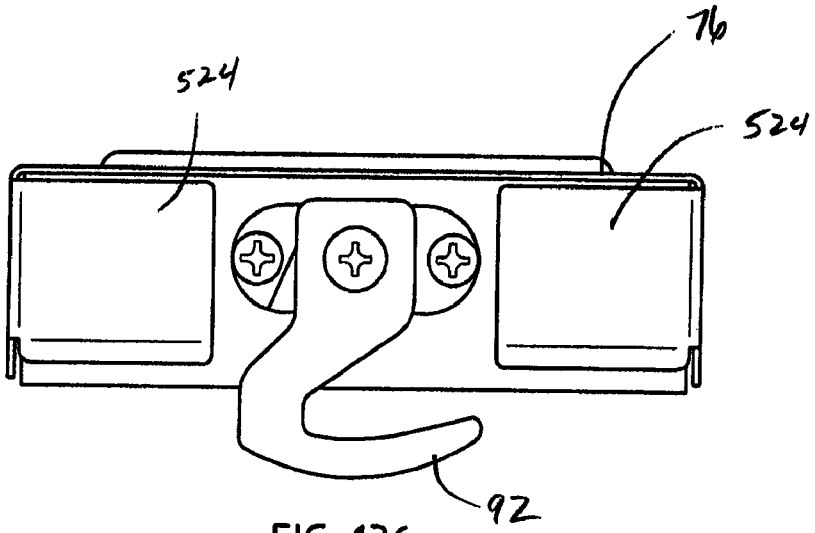
Figure 137:
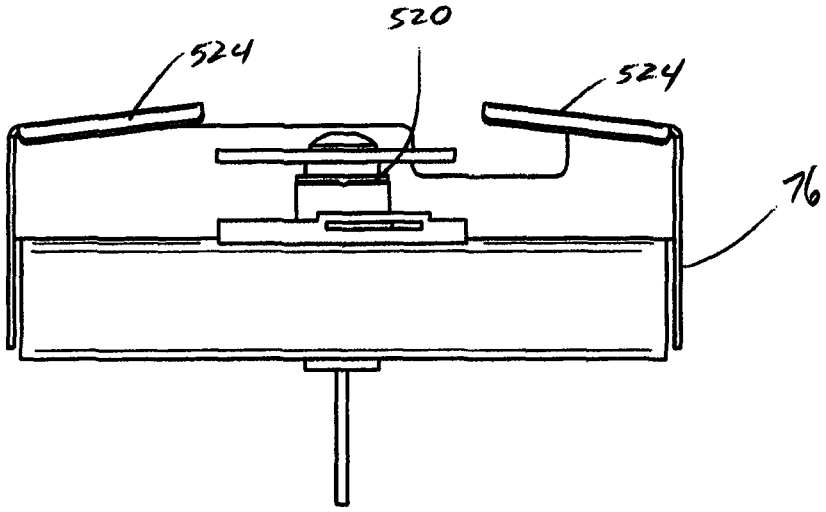
Figure 138:
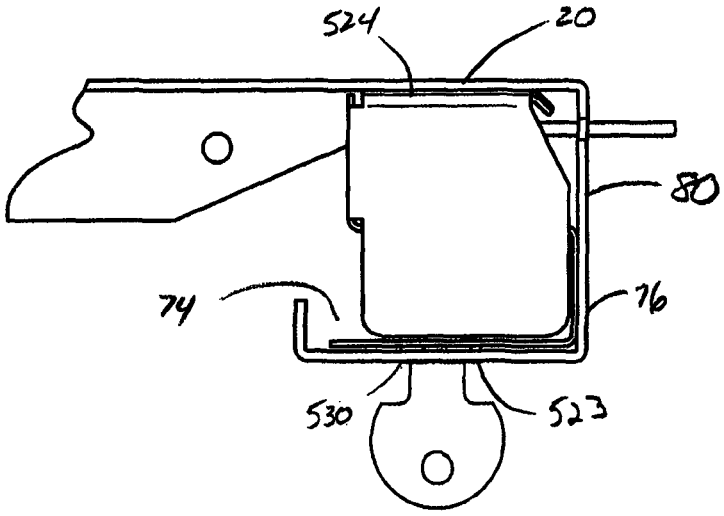
Figure 139:
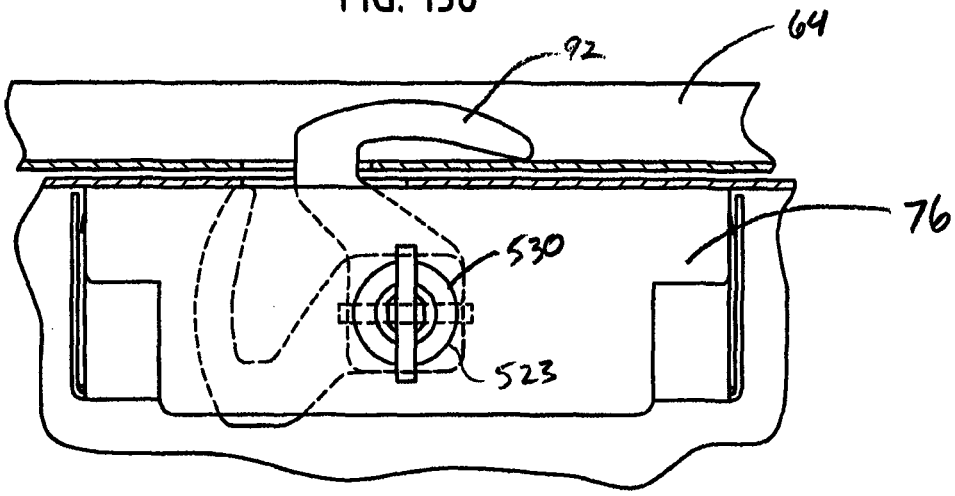
Figure 140:
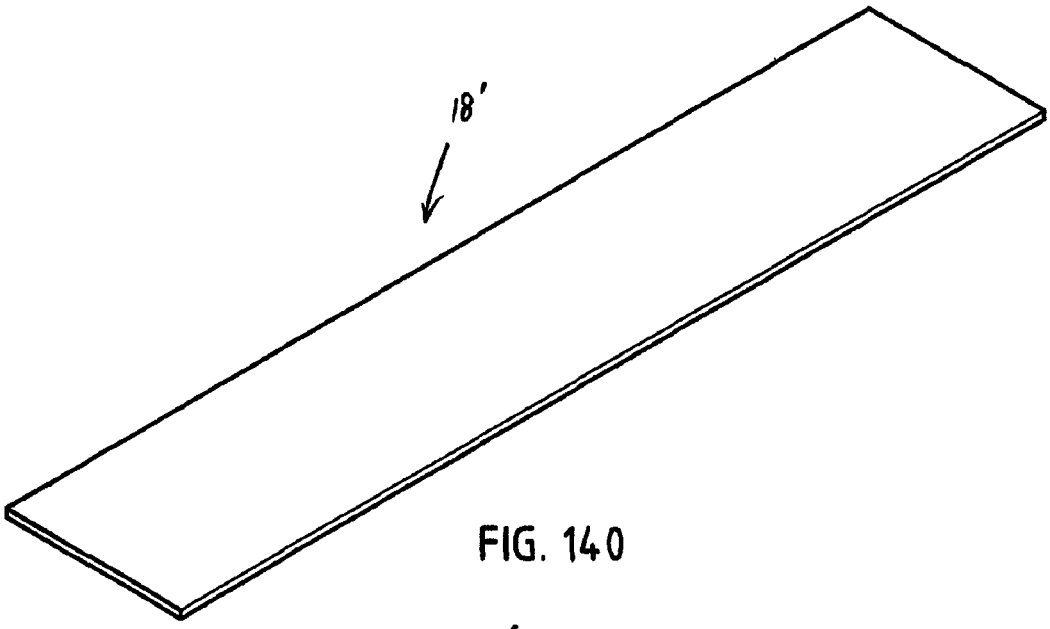
Figure 141:
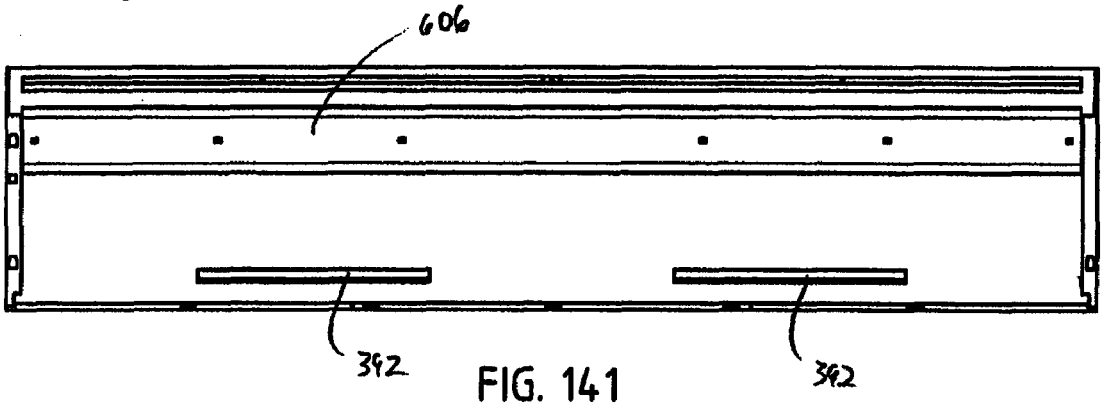
Figure 142:
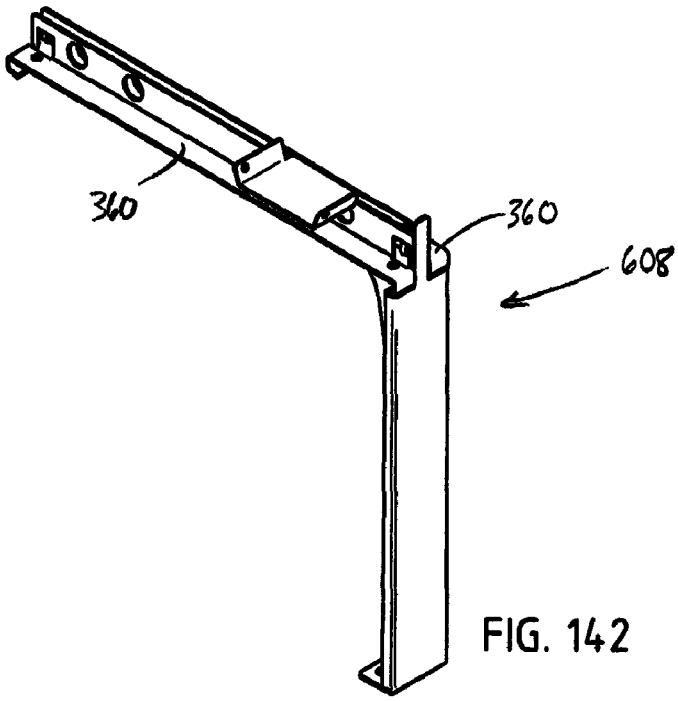
Figure 143:
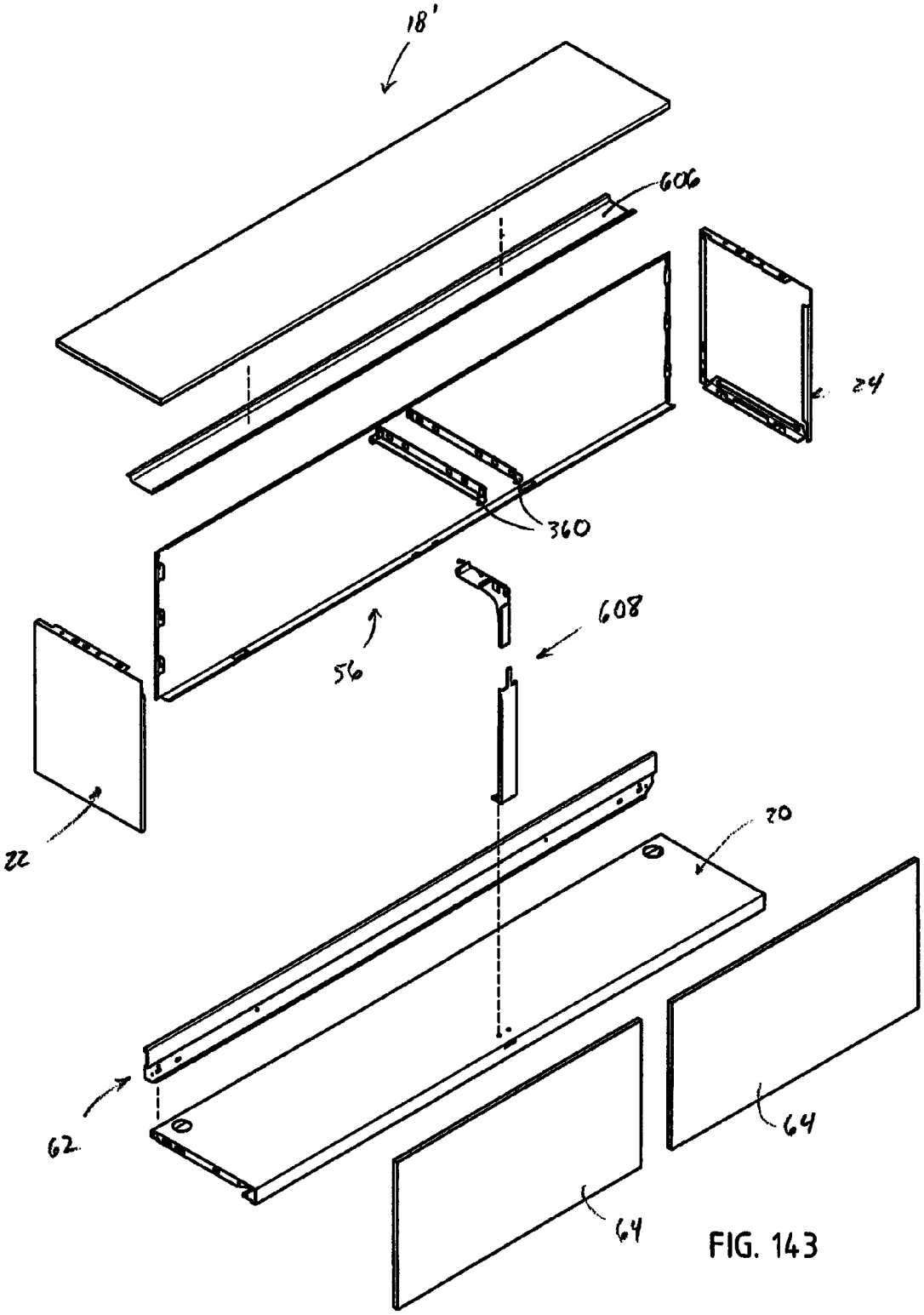
Figure 144:
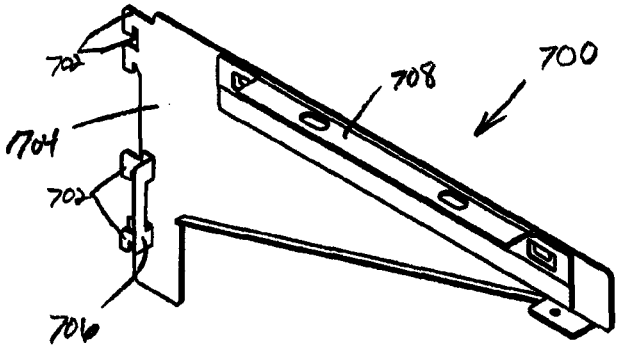
Figure 145:
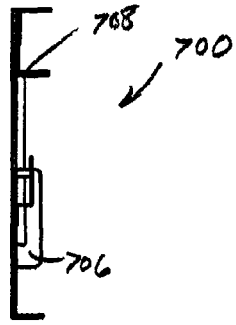
Figure 146:
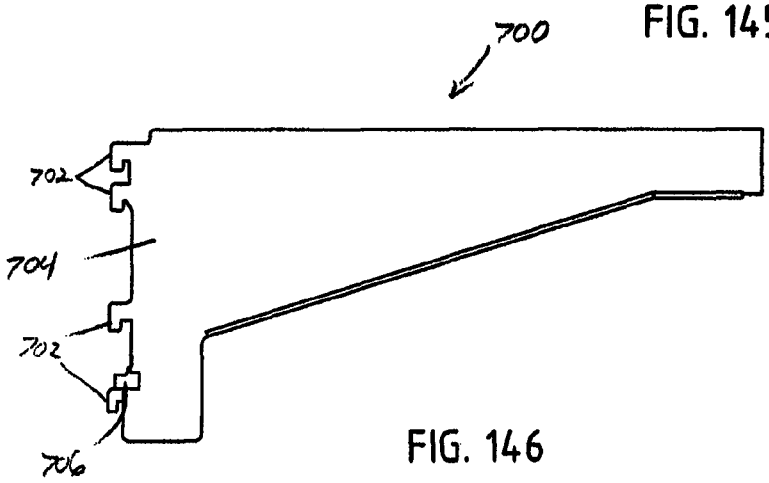
Figure 147:
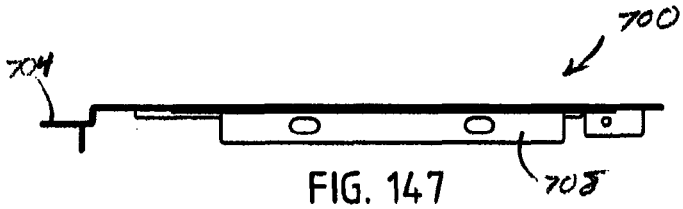
Figure 148:
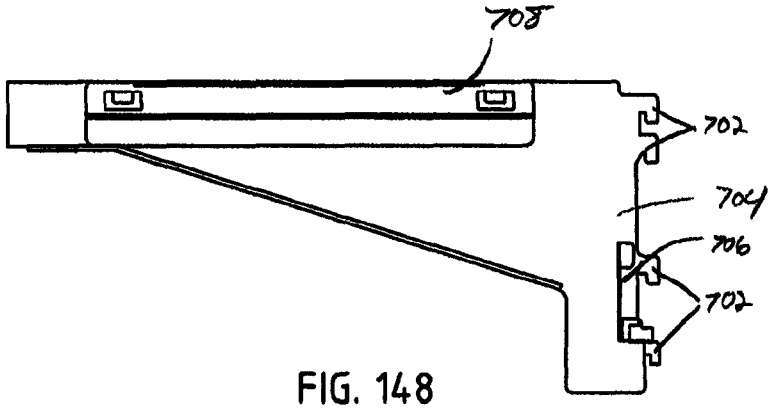
Figure 149:
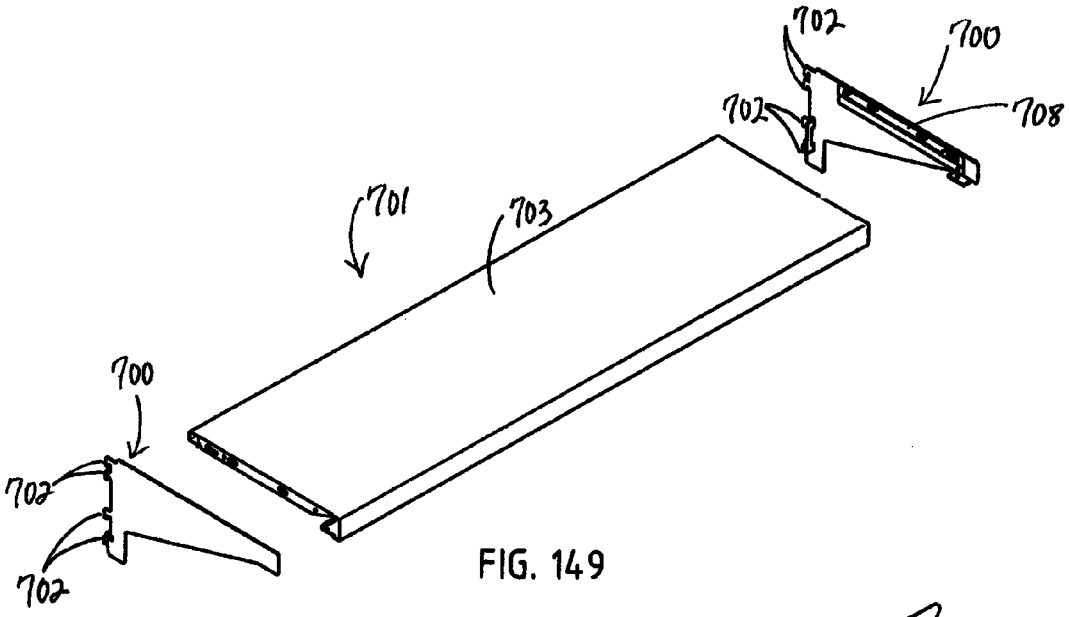
Figure 150:
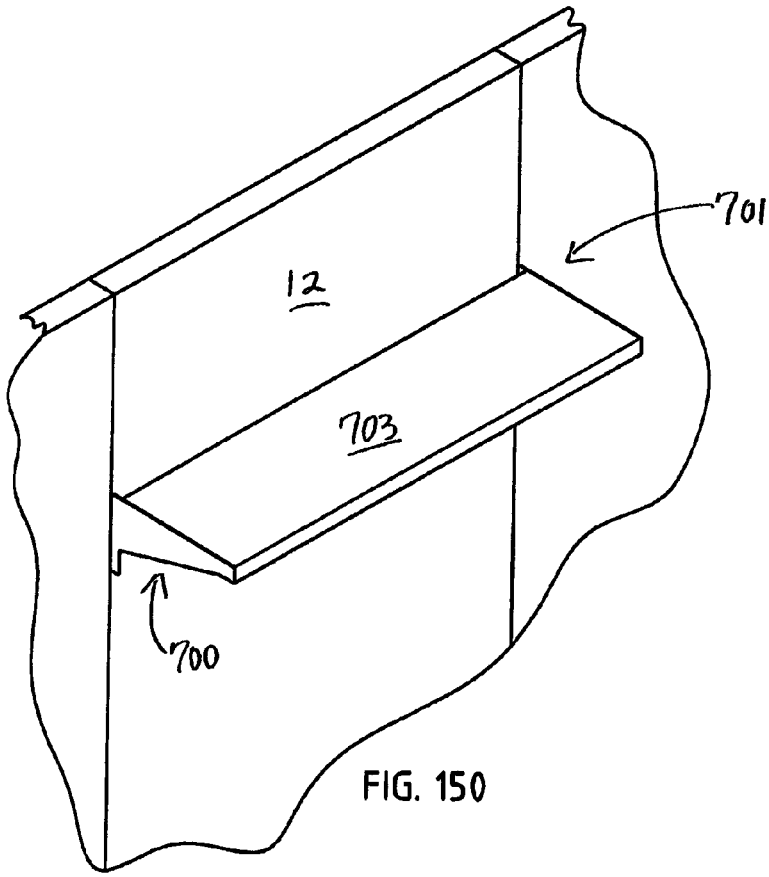
Figure 151:
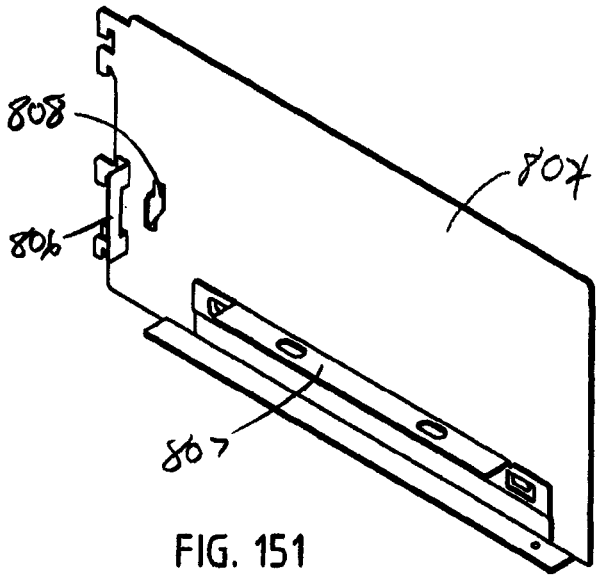
Figure 152:
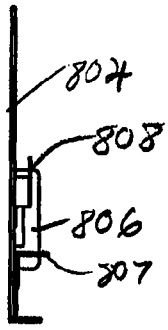
Figure 153:
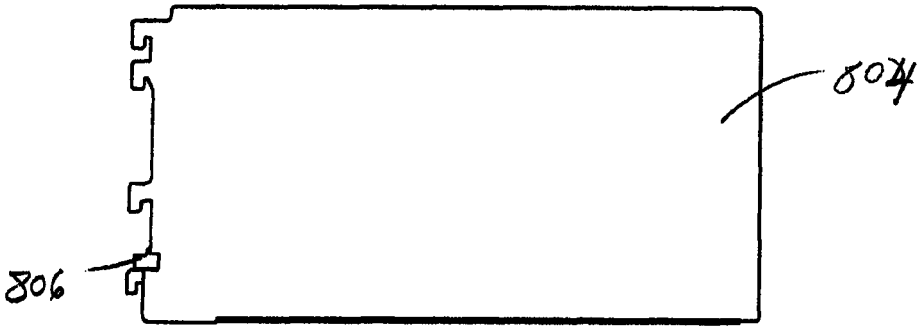
Figure 154:
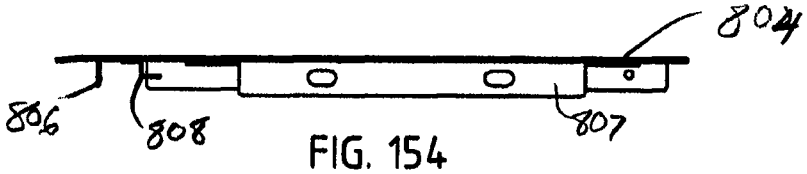
Figure 155:
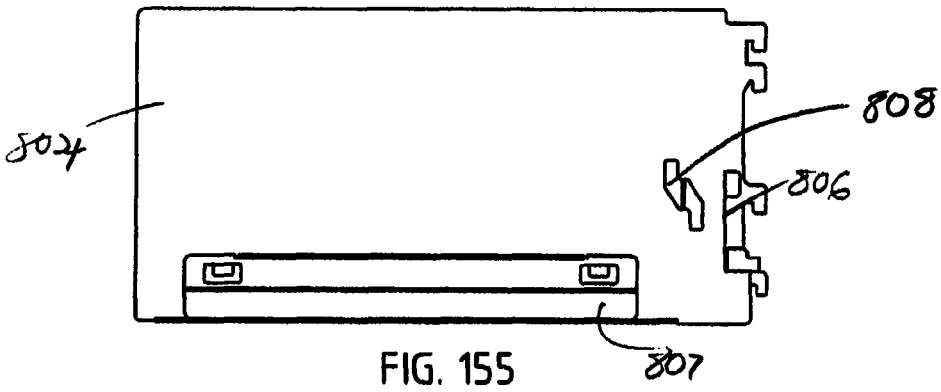
Figure 156:
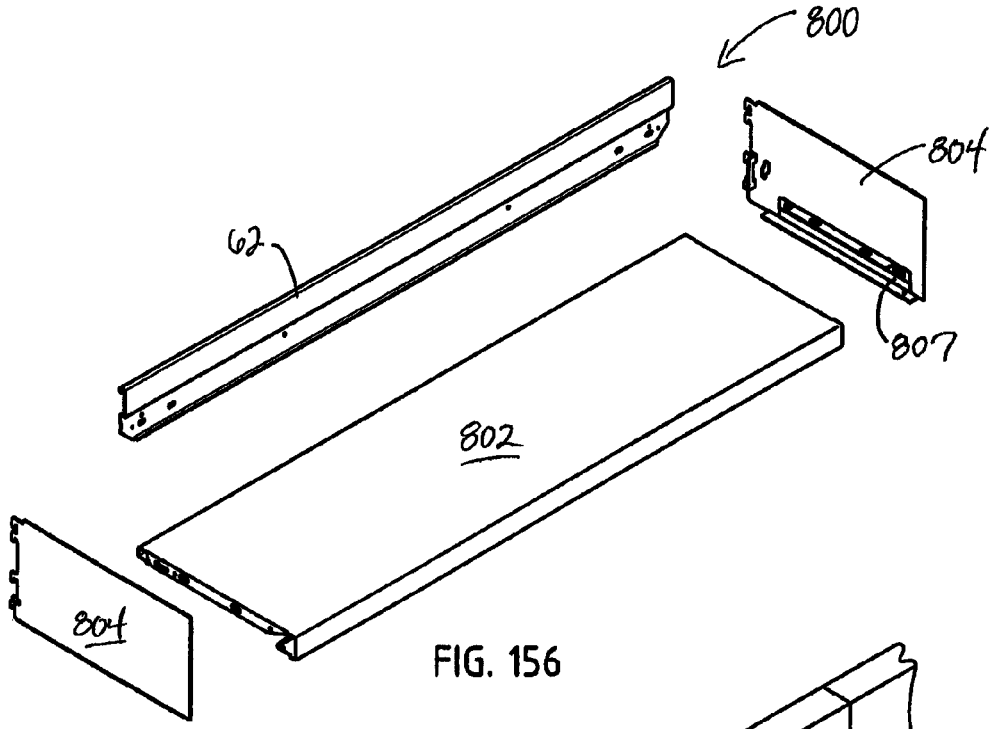
Figure 157:
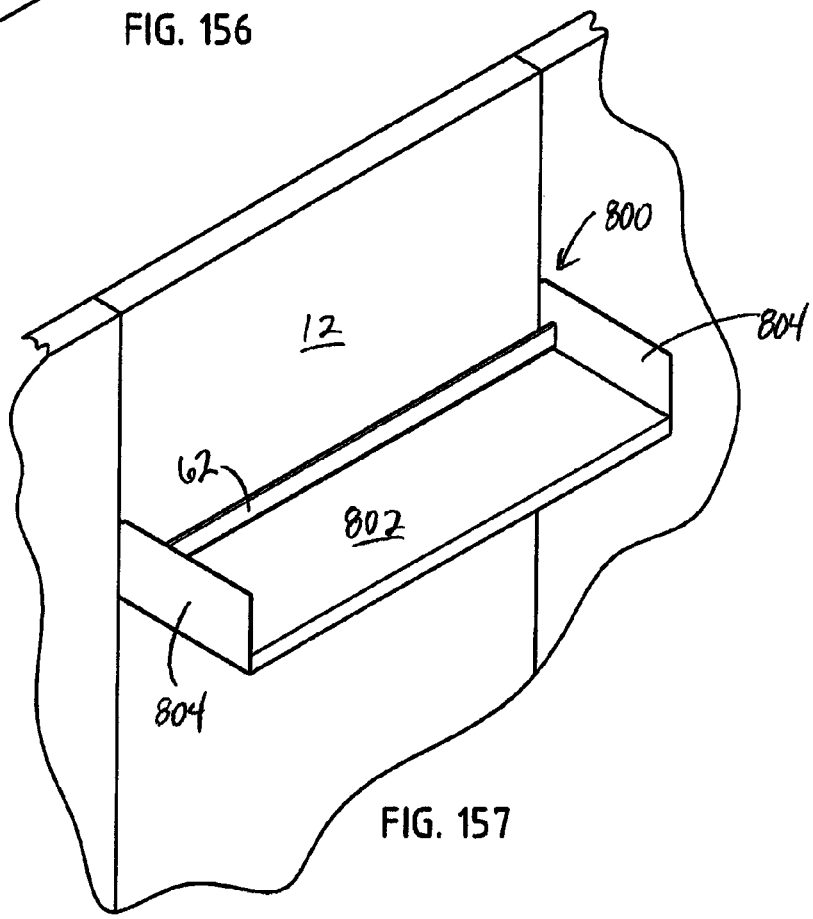
Figure 158:
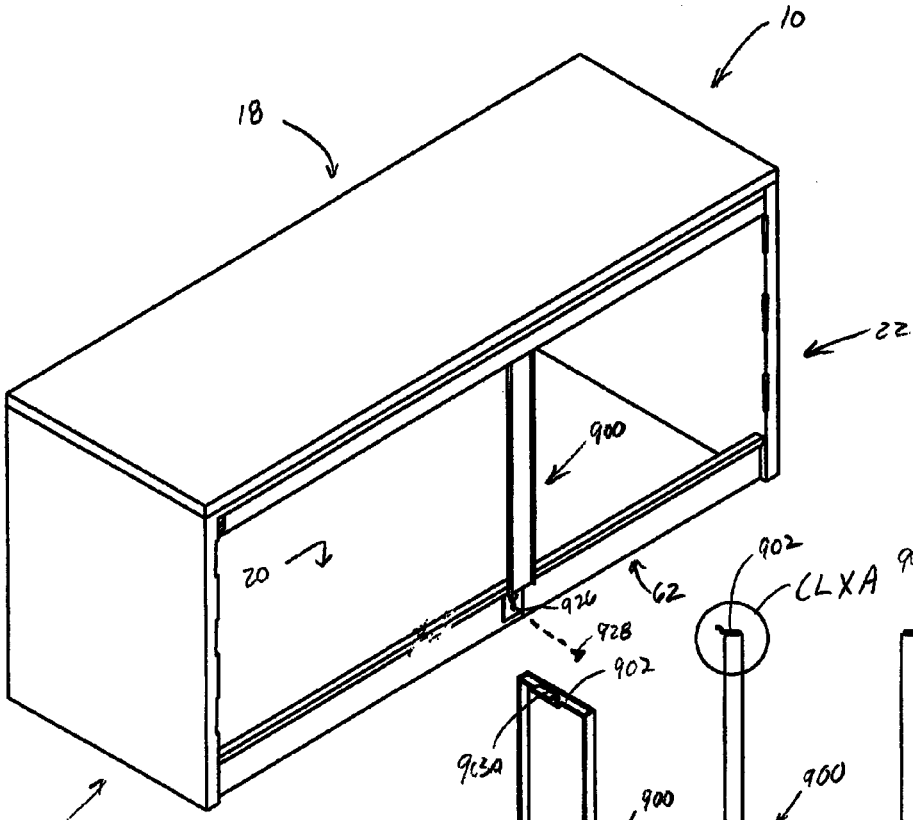
Figure 160A:
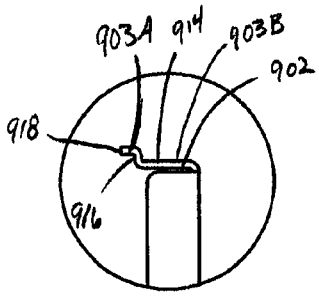
Figure 159:
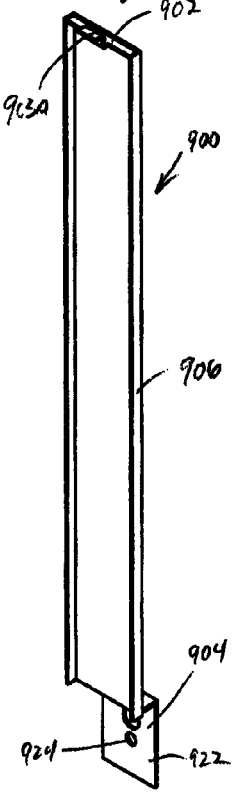
Figure 160:
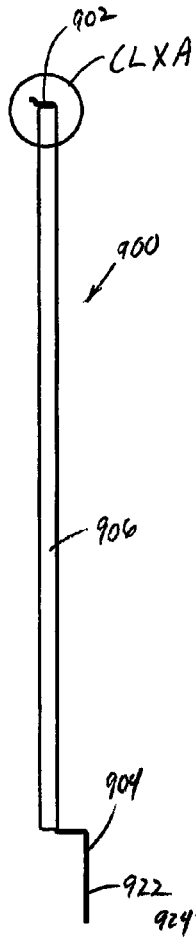
Figure 161:
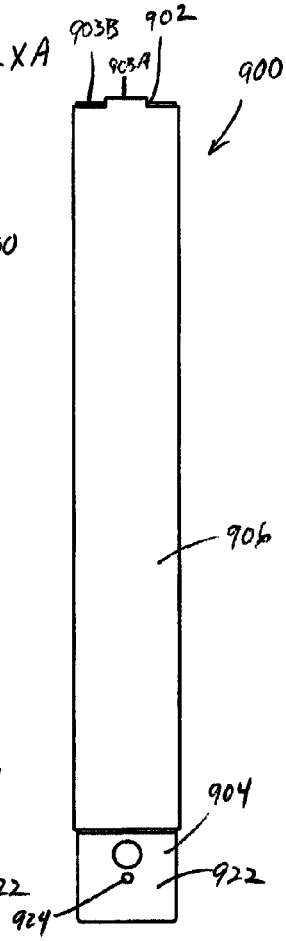
Figure 162:
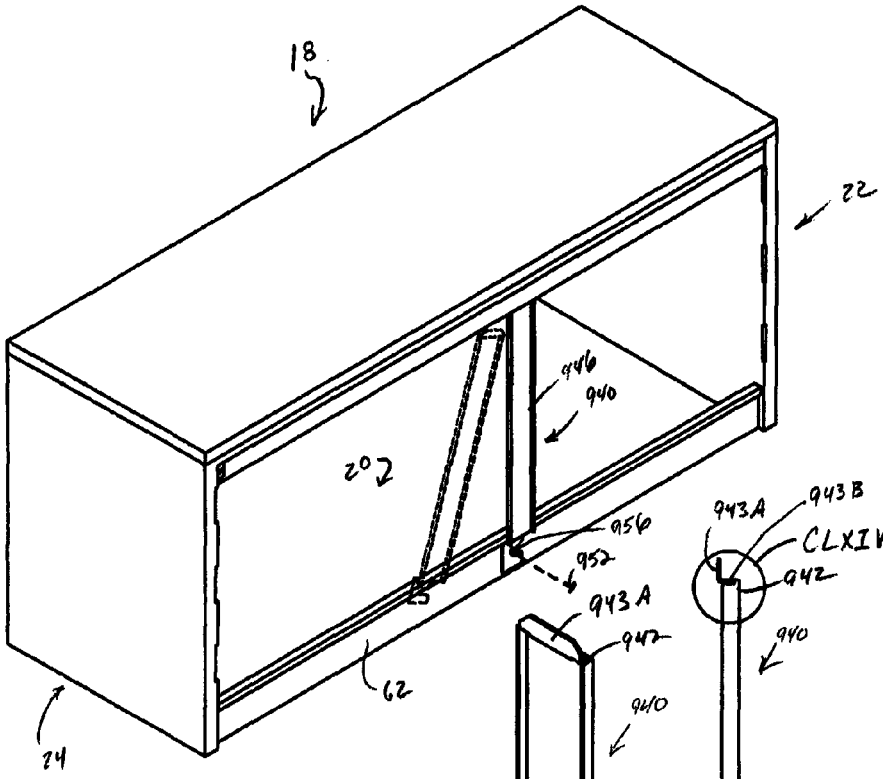
Figure 164A:
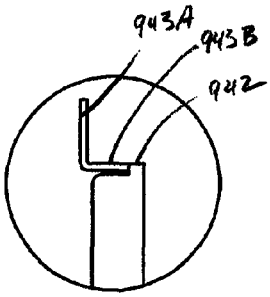
Figures 163, 164, 165:
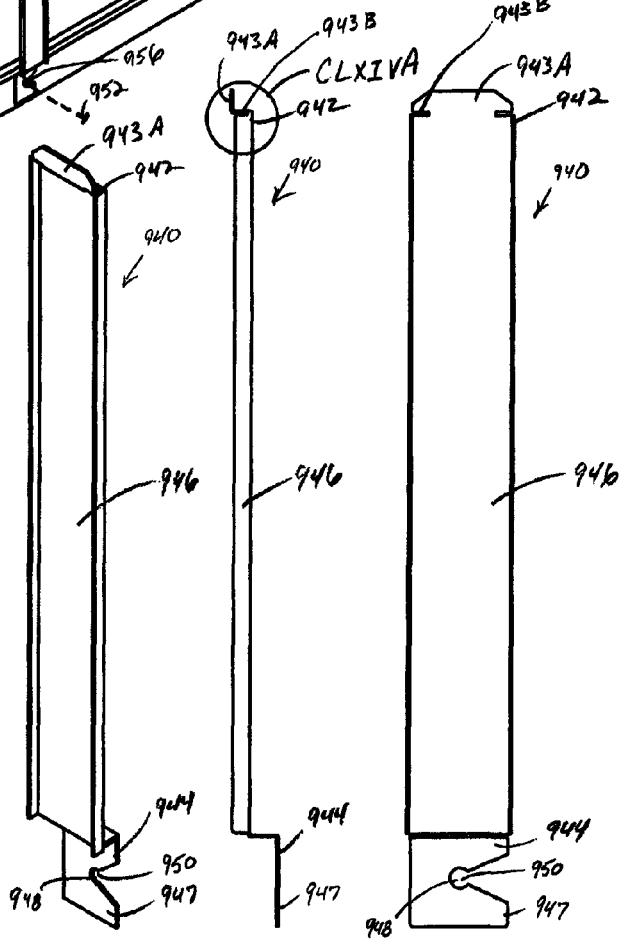

FIG. 107C side elevational view of a storage unit assembly of the instant invention in a panel hung off-module condition;

FIG. 108 is a top perspective view of a top bracket of a horizontal off-module support bracket of the instant invention;

FIG. 109 is a front elevational view of the top bracket of FIG. 108;

FIG. 110 is a rear elevational view of the top bracket of FIG. 108;

FIG. 111 is a side elevational view of the top bracket of FIG. 108;

FIG. 112 is a bottom elevational view of the top bracket of FIG. 108;

FIG. 113 is a top perspective view of a bottom bracket of a horizontal off-module support bracket of the instant invention;

FIG. 114 is a front elevational view of the bottom bracket of FIG. 113;

FIG. 115 is a bottom elevational view of the bottom bracket of FIG. 113;

FIG. 116 is a side elevational view of the bottom bracket of FIG. 113;

FIG. 117 is a back elevational view of the bottom bracket of FIG. 113;

FIG. 118 is a top elevational view of the bottom bracket of FIG. 113;

FIG. 119 is a top perspective view of a storage unit assembly of the instant invention prior to being panel hung in a horizontal off-module condition;

FIG. 120 is a side elevational view of a storage unit assembly of the instant invention prior to being panel hung in a horizontal off-module condition;

FIG. 120A is a bottom elevational view of a bottom bracket during installation;

FIG. 121 is a front perspective view of horizontal off-module support brackets engaged with slotted hangers of office furniture unit prior to connection with vertical off-module support bracket;

FIG. 122 is a rear perspective view of horizontal off-module support brackets engaged with slotted hangers of office furniture unit prior to connection with vertical off-module support bracket;

FIG. 123 is a side elevational view of a vertical off-module bracket engaging a horizontal off-module bracket;

FIG. 124 is a side elevational view of a vertical off-module bracket engaged with a horizontal off-module bracket;

FIG. 125 is a side elevational view of a storage unit assembly of the instant invention before installation in a panel hung horizontal off-module condition;

FIG. 126 is a top perspective view of a storage unit assembly of the instant invention in a panel hung horizontal off-module condition;

FIG. 127 is a top perspective view of an up-mount bracket of the instant invention;

FIG. 128 is a top elevational view of the up-mount bracket of FIG. 127;

FIG. 129 is a side elevational view of the up-mount bracket of FIG. 127;

FIG. 130 is a rear elevational view of the up-mount bracket of FIG. 127;

FIG. 131 is a top perspective view of a storage unit assembly of the instant invention prior to installation in an up-mounted condition;

FIG. 132 is a side elevational view of a storage unit assembly of the instant invention prior to installation in an up-mounted condition;

FIG. 133A is a side elevational view of a storage unit assembly of the instant invention in an up-mounted condition;

FIG. 133B is a front elevational view of a storage unit assembly in a desk/service module arrangement;

FIG. 134 is a top perspective view of a storage unit assembly of the instant invention in an up-mounted condition;

FIG. 135 is a top perspective view of a lock assembly of the instant invention;

FIG. 136 is a top elevational view of the lock assembly of FIG. 135;

FIG. 137 is a front elevational view of the lock assembly of FIG. 135;

FIG. 138 is a side elevational view of the lock assembly of FIG. 135;

FIG. 139 is a top elevational view of the lock assembly installed in a bottom panel;

FIG. 140 is a top perspective view of a dual door top panel of the present invention;

FIG. 141 is a bottom elevational view of the dual door top panel of FIG. 140;

FIG. 142 is a front elevational view of a dual door support of the present invention;

FIG. 143 is an exploded top perspective view a dual door storage unit of the present invention;

FIG. 144 is a top perspective view of a shelf bracket of the instant invention;

FIG. 145 is a front elevational view of the shelf bracket of FIG. 144;

FIG. 146 is a first side elevational view of the shelf bracket of FIG. 144;

FIG. 147 is a top elevational view of the shelf bracket of FIG. 144;

FIG. 148 is a second side elevational view of the shelf bracket of FIG. 144;

FIG. 149 is an exploded top perspective view of the shelf prior to installation;

FIG. 150 is a top perspective view of the shelf of FIG. 149 installed;

FIG. 151 is a top perspective view of a shelf with end walls of the instant invention;

FIG. 152 is a front elevational view of the shelf of FIG. 151;

FIG. 153 is a first side elevational view of the shelf of FIG. 151;

FIG. 154 is a top elevational view of the shelf of FIG. 151;

FIG. 155 is a second side elevational view of the shelf of FIG. 151;

FIG. 156 is an exploded top perspective view of the shelf with end walls of the instant invention;

FIG. 157 is a top perspective view of the shelf with end walls installed;

FIG. 158 is a top perspective view of a binder bin with a support vertical strut installed;

FIG. 159 is a top perspective view of a support strut;

FIG. 160 is a side elevational view of the support strut of FIG. 159;

FIG. 160A is an enlarged side elevational view of section CLXA of FIG. 160;

FIG. 161 is a rear elevational view of the support strut FIG. 159;

FIG. 162 is a top perspective view of a binder bin with a temporary strut installed;

FIG. 163 is a top perspective view of a temporary strut;

FIG. 164 is a side elevational view of the temporary strut of FIG. 163;

FIG. 164A is an enlarged side elevational view of section CLXIVA of FIG. 164; and FIG. 165 is a rear elevational view of the temporary vertical strut FIG. 163.

DETAILED DESCRIPTION OF THE PREFERRED EMBODIMENTS

For purposes of description herein the terms "upper", "lower", "right", "left", "rear", "front", "vertical", "horizontal" and derivatives thereof shall relate to the invention as oriented in FIGS. 1-4. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a storage unit assembly for office furniture units 12 of the type having an outer face 14 with slotted hangers 16 extending therealong. The storage unit 10 includes a bottom panel 20 operably positioned in a generally horizontal orientation, and shaped to abuttingly support objects thereon, and a top panel 18 disposed above and generally parallel with the bottom panel 20, and shaped to cover at least a portion of the bottom panel 20. First and second end panels 22, 24 are disposed at opposite ends of the top and bottom panels 18, 20 and connected with the top and bottom panels 18, 20 to define a rigid, box-shaped case 26 having a generally rigid bottom portion 28 and a generally open back portion 30. The first and second end panels 22, 24 have rear portions 32 with a plurality of vertically spaced apart slots 34 disposed therein. First and second hanger brackets 35, 36 each have a rear portion 38 with first hooks 40 shaped for reception in the slotted hangers 16 of an associated one of the office furniture units 12 and a forward portion 42 with second hooks 44 selectively received in the slots 34 in the rear portions 32 of the first and second end panels 22, 24 to detachably support the case 26 in a panel-hung condition against the outer face 14 of the associated one of the office furniture units 12, as shown in FIGS. 133 and 134. An up-mount bracket 48 has a lower portion 50 shaped for connection with an associated one of the office furniture units 12, and an upper portion 52 connected with and supporting the bottom portion of the case 26 to detachably mount the case 26 in an up-mounted condition above a top portion 54 of the associated one of the furniture units 12. A removable back panel 56 is shaped to enclose at least a portion of the open back portion 30 of the case 26 and has side portions 58 with outwardly protruding hooks 60 selectively received in the slots 34 in the rear portions 32 of the first and second end panels 22, 24 to detachably connect the back panel 56 with the case 26 and enclose at least that portion of the open back portion 30 of the case 26 disposed above the top portion 54 of the associated one of the office furniture units 12 when the case 26 is in the up-mounted condition (FIGS. 133 and 134).

In the example shown in FIGS. 5-9, bottom panel 20 includes a substantially planar top surface 70 adapted to support objects thereon and a bottom surface 72 including a socket 74 adapted to engage and secure a lock housing 76 therein, as will be described later in FIGS. 135-139. Bottom panel 20 further includes side walls 78, as well as a front portion 80 and back portion 82. Socket 74 is defined by the bottom surface 72, front portion 80 and a socket flange 84. Back portion 82 of bottom panel 20 includes a downwardly extending flange 86 shaped to abut and connect with back stop rail 62. Fastener apertures 88 in the back portion 82 of bottom panel 20 as well as in back stop rail 62 allow back stop rail 62 to be fastened to the back portion 82 of bottom panel 20 by mechanical fasteners. The front portion 80 of bottom panel 20 includes a lock aperture 90 that allows a lock arm 92 to protrude from and be received in bottom panel 20. The side walls 78 of bottom panel 20 include a key hole slot 94 adapted for engagement with a tab 96 on a connector bracket 98 that secures the first and second end panels 22, 24 to bottom panel 20.

Referring to FIGS. 10-13, 14A and 14B, the illustrated case 26 includes an elongate, rigid, channel-shaped back stop rail 62 that connects with rail brackets 100 (FIGS. 25A and 25B) attached to the first and second end panels 22, 24, as disclosed in greater detail in related application Ser. No. 12/128,920, filed May 29, 2008, entitled STORAGE UNIT BACK STOP AND METHOD. The back stop rail 62 provides rigidity to the case and is designed to support accessories that can be hung therefrom including dividers, small shelves, communication/electrical line manager, etc. The back stop rail 62 extends between the first and second end panels 22, 24 in the interior of the case 26. The back stop rail 62 has a rearwardly opening, generally U-shaped upper portion 102 defined by a generally flat upper vertical web 104 with upper and lower horizontal flanges 106, 108 projecting rearwardly from the top and bottom of the vertical web 104. Back stop rail 62 also includes a lower portion 110 that extends below bottom panel 20 and terminates at an inwardly extending base flange 112. Back stop rail 62 is supported along the back portion 82 of bottom panel 20 by fasteners and the vertical web 104 projects inwardly into the interior of the case 26 to retain objects on bottom panel 20.

Figure 14A:
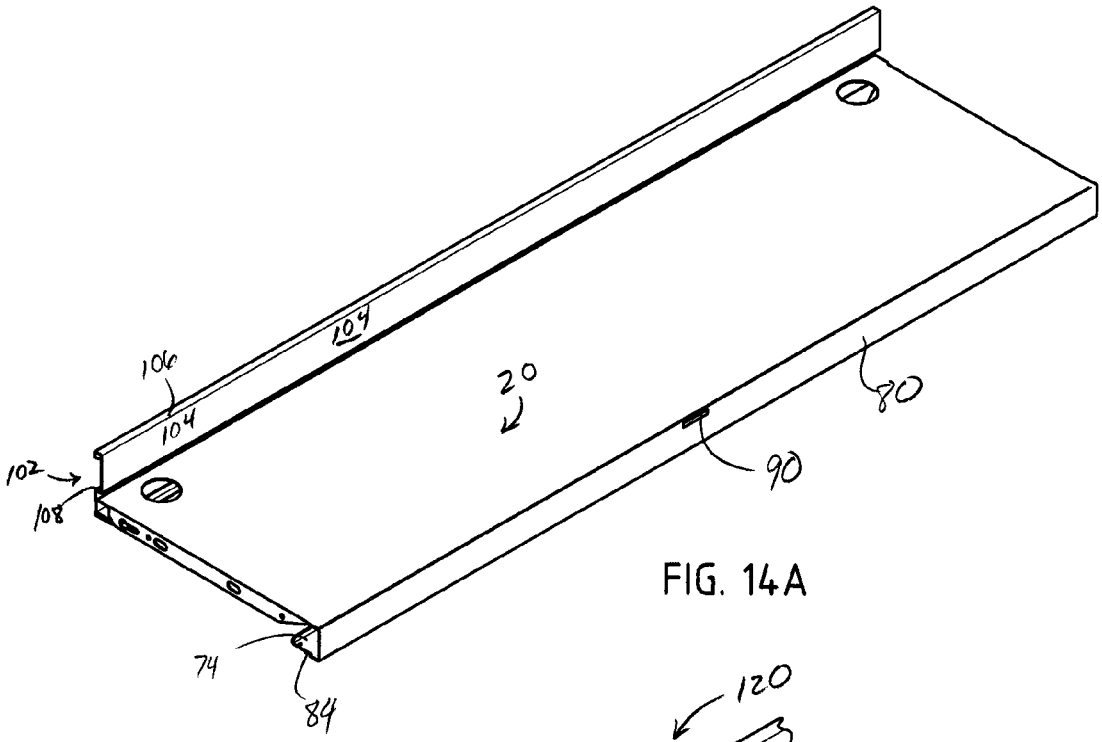
FIG. 14A is a front perspective view of the bottom panel connected with a back stop rail.
Figure 14B:
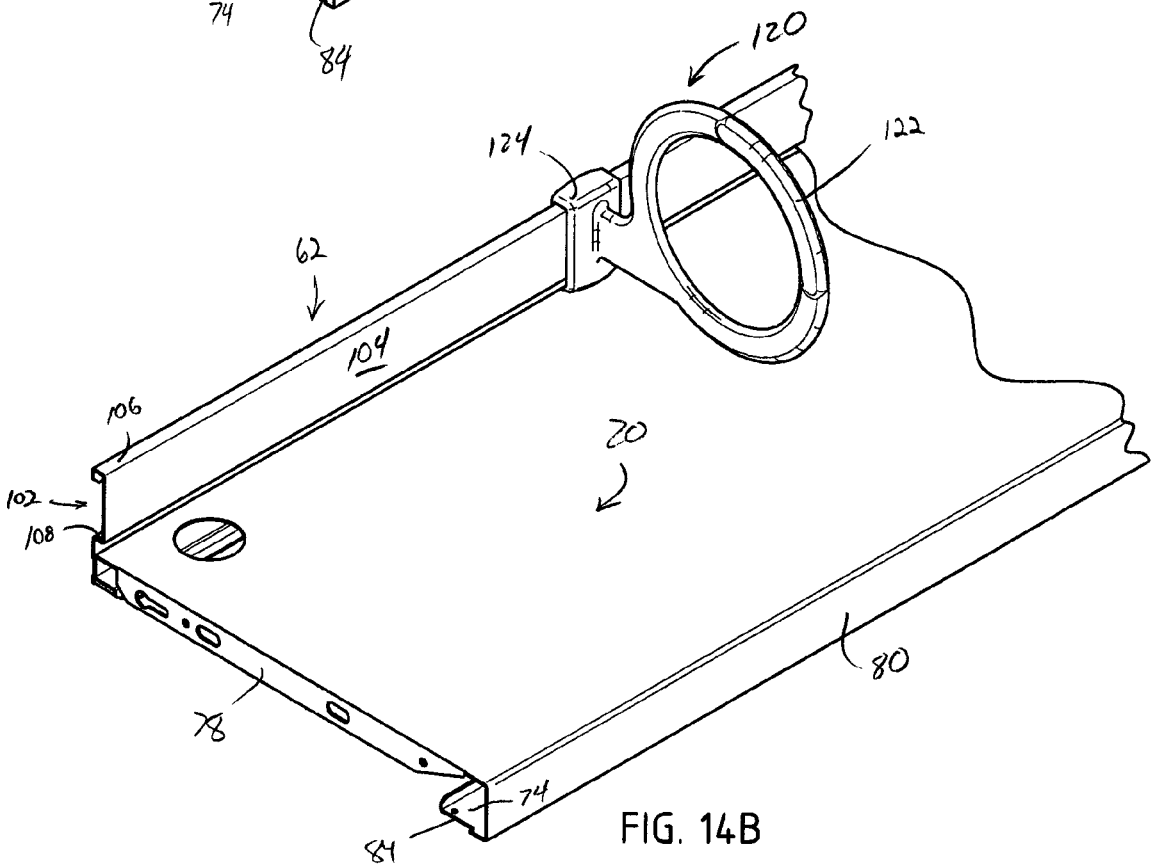
FIG. 14B is a bottom panel attached to the back stop rail and an accessory mounted thereto.
Figure 15:
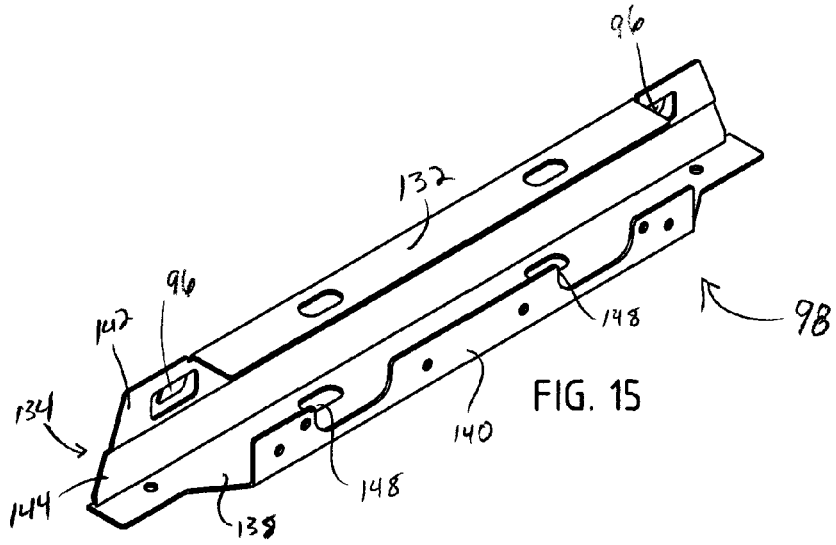
FIG. 15 is a top perspective view of a connector bracket of the instant invention.
Figure 16:
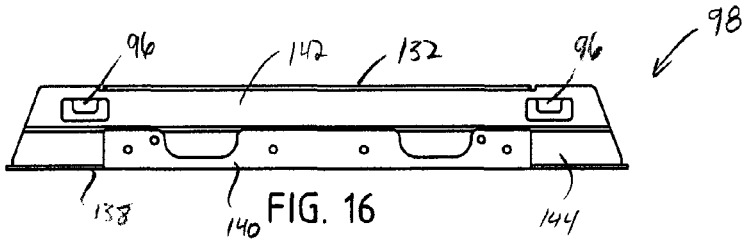
FIG. 16 is a first side elevational view of the connector bracket of FIG. 15.
Figure 17:
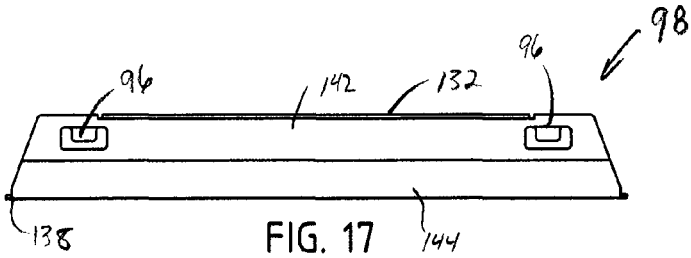
FIG. 17 is a second side elevational view of the connector bracket of FIG. 15.
Figure 19:
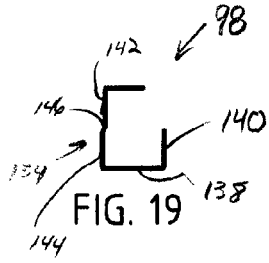
FIG. 19 is a front elevational view of the connector bracket of FIG. 15.
Figure 18:
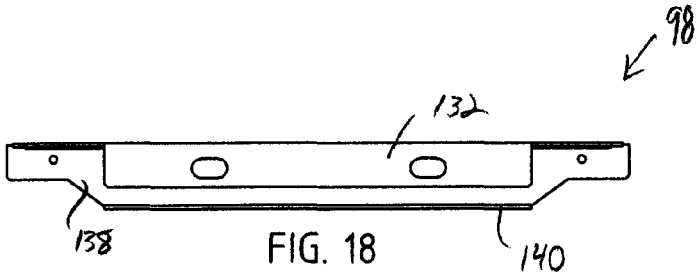
FIG. 18 is a top elevational view of the connector bracket of FIG. 15.
Figure 20:
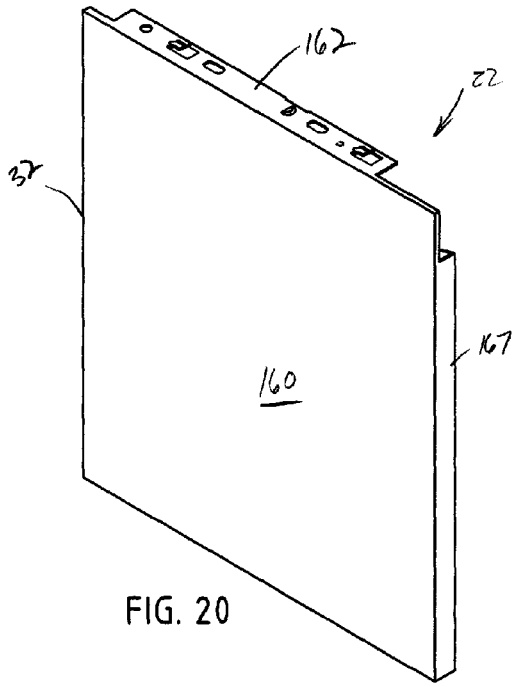
FIG. 20 is a top perspective view of an end panel of the instant invention.
Figure 21A:
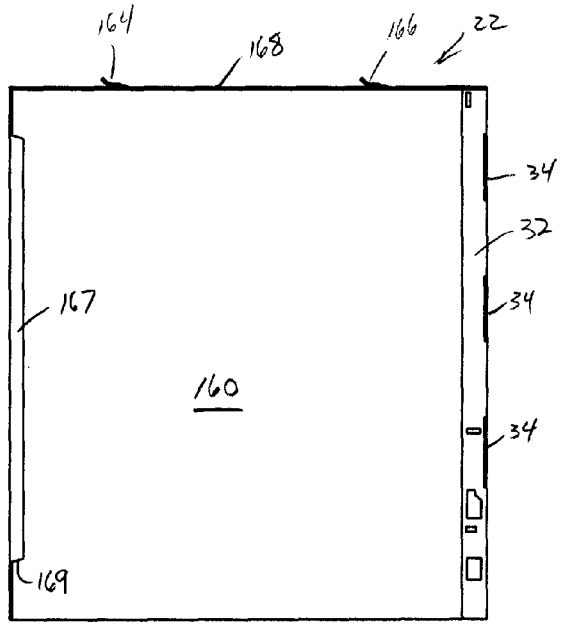
FIG. 21A is a first side elevational view of the end panel of FIG. 20.
Figure 21B:
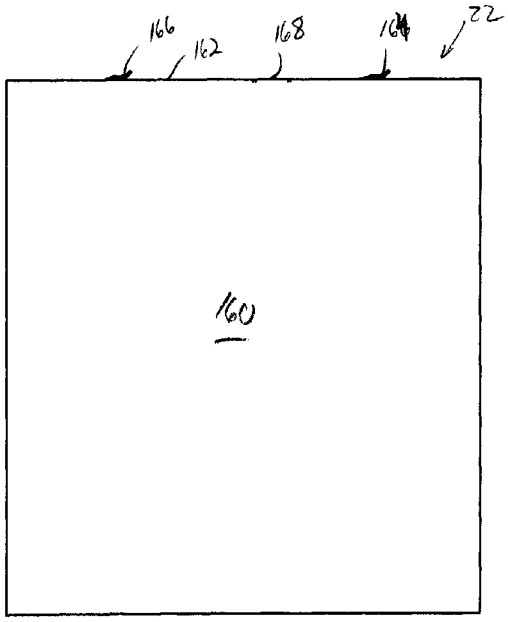
FIG. 21B is a second side elevational view of the end panel of FIG. 20.
Figure 22:
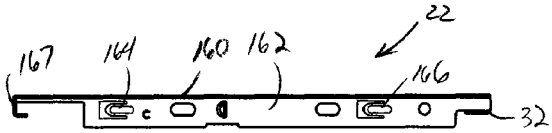
FIG. 22 is a top elevational view of the end panel of FIG. 20.
Figure 23:
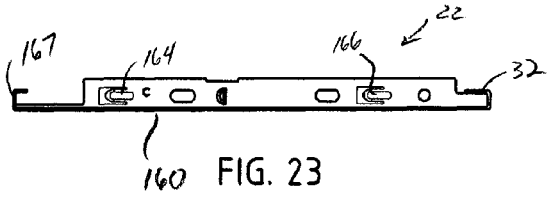
FIG. 23 is a bottom elevational view of the end panel of FIG. 20.
Figure 24:
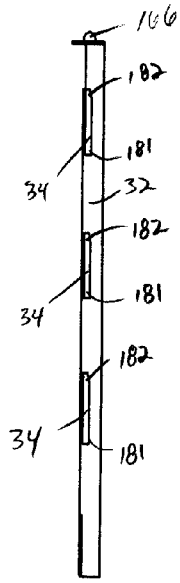
FIG. 24 is a rear elevational view of the end panel of FIG. 20.

As shown in FIG. 14A, an accessory 120 may be provided having a first portion 122 configured to equip the interior of the case 26 and a second portion 124 detachably engaged with the upper horizontal flange 106 on the back stop rail 62. The accessory 120 hangs from and is supported by and abuts against vertical web 104 of said back stop rail 62 at a selected one of a wide variety of positions along back stop rail 62. The accessory 120 functions an interior divider inside the bin and also functions as a wire manager through which communication/electrical lines can be routed.

As shown in FIGS. 15-19, the illustrated connector bracket 98 includes a top support flange 132, a side engagement wall 134 having engagement tabs 96, a bottom support flange 138, and an upwardly extending flange 140. Side engagement wall 134 includes an upper portion 142 offset from a lower portion 144. This construction of connector bracket 98 provides a small gap 146 between upper portion 142 of side engagement wall 134 and end panel 22 or 24 to which connector bracket 98 is attached. This small gap 146 allows side wall 78 of bottom panel 20 to be frictionally forced into gap 146. Top support flange 132 is of adequate length to support the underside of bottom panel 20. Bottom support flange 138 of connector bracket 98 includes apertures 148 adapted for reception of fasteners when storage unit assembly 10 has been secured in an up-mounted condition.

Referring now to FIGS. 20-24, first end panel 22 includes a substantially planar exterior wall 160 with a top flange 162 extending orthogonally inward toward the interior of storage unit assembly 10 after construction. The second end panel 24 will have identical features only oriented in a mirror-like fashion. Accordingly, all features described with respect to the first end panel 22 will be mirror images to that of the second end panel 24. Top flange 162 includes first and second clips 164, 166 adapted to receive a portion of top panel 18 as will be disclosed in further detail below. A detent stop 168 is located between first and second clips 164, 166 and helps secure top panel 18 in position when installed. A front flange 167 on the end panel includes a bottom end 169 adapted to abut and secure the top surface of bottom panel 20 after assembly. Rear portion 32 of first end panel 22 includes multiple slots 34, adapted to engage either the removable back 56 in an up-mounted condition or a hanger bracket 35, 36 when the storage unit assembly 10 is installed in a panel hung condition as discussed in further detail below.

Figure 25A:
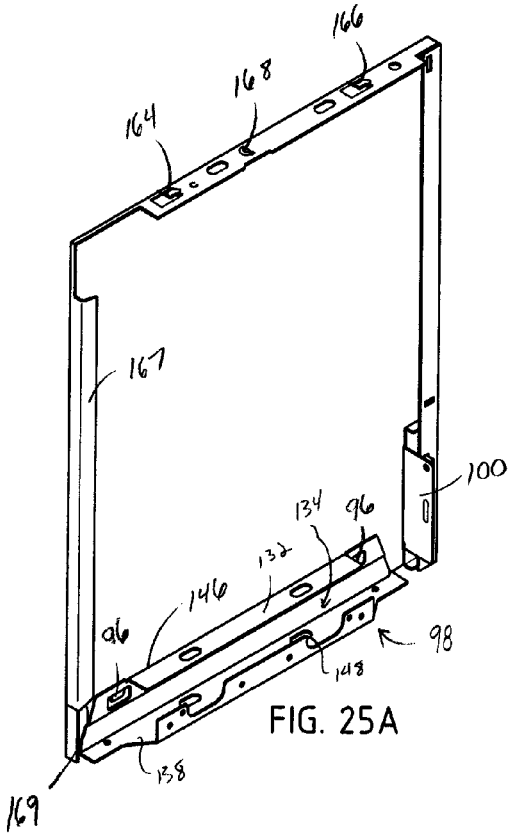
FIG. 25A is a top perspective view of an end panel attached to a connector bracket.
Figure 25B:
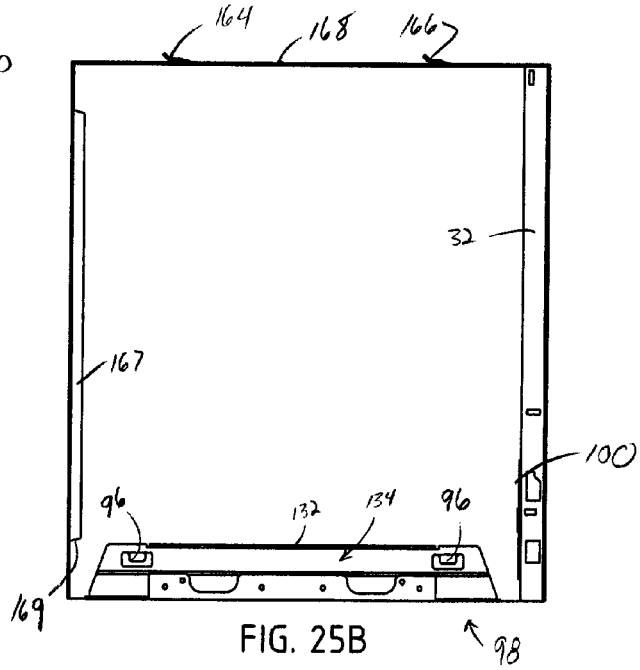
FIG. 25B is a first side elevational view of the end panel and connector bracket of FIG. 25A.

FIGS. 25A and 25B illustrate connector bracket 98 attached with first end panel 22. Connector bracket 98 may be attached to the inside of first end panel 22 by fasteners, welding etc. The attachment of connector bracket 98 is such that gap 146 is created between upper portion 142 of side engagement wall 134 and the inside of first end panel 22.

Figure 26:
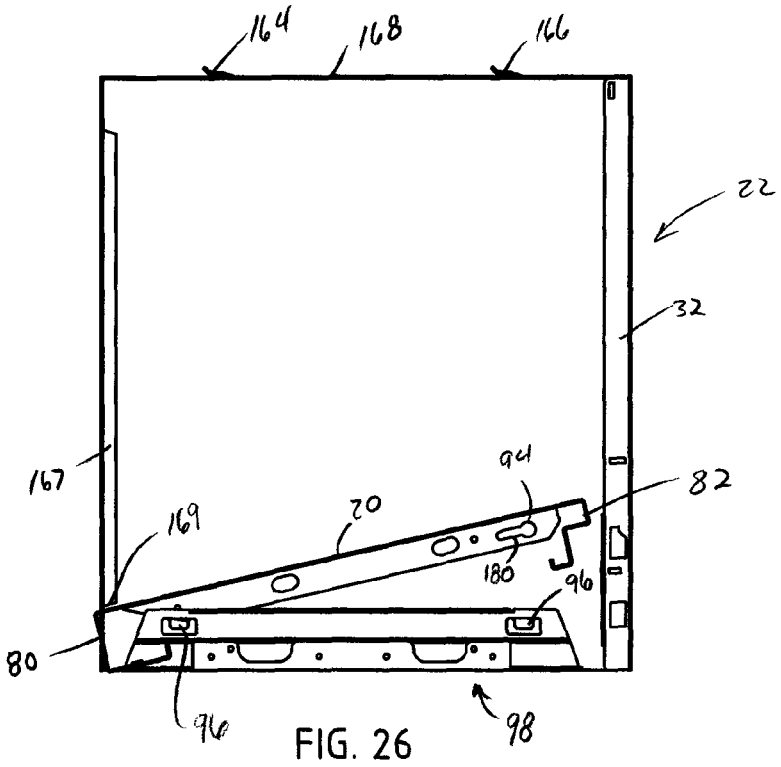
FIG. 26 is a side elevational view of the bottom panel during connection with an end panel.
Figure 27:
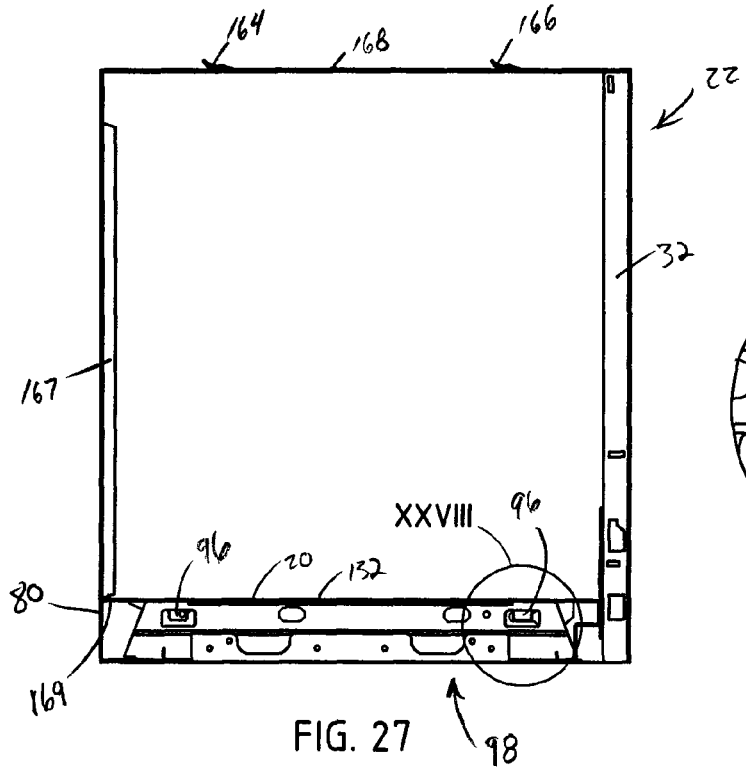
FIG. 27 is a side elevational view of the bottom panel connected with an end panel.
Figure 28:
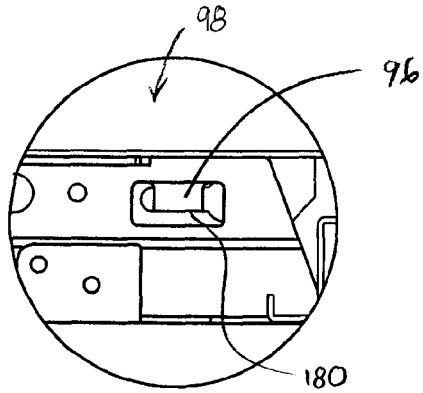
FIG. 28 is an enlarged elevational view of a portion of the connector bracket connected to the bottom panel.
Figure 29:
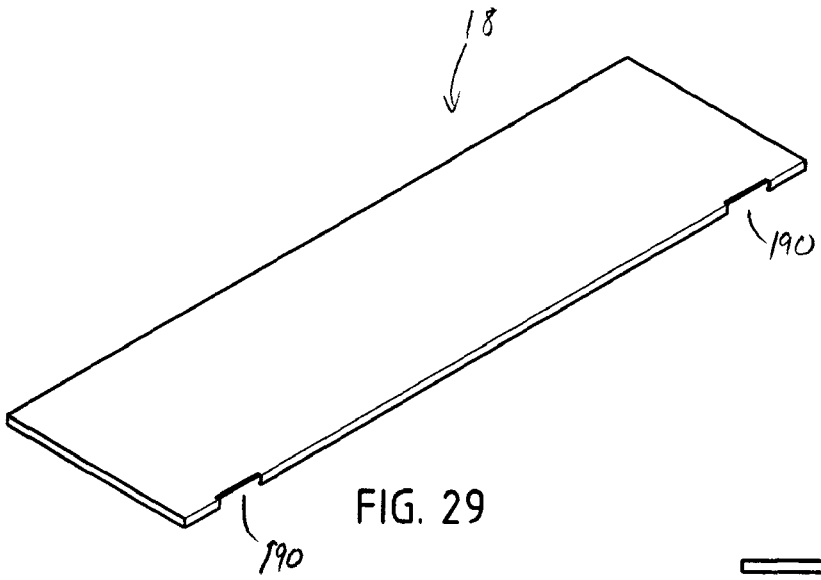
FIG. 29 is a top perspective view of a top panel of the present invention.
Figure 30:
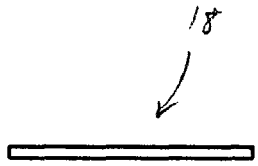
FIG. 30 is a side elevational view of the top panel of FIG. 29.
Figure 31:
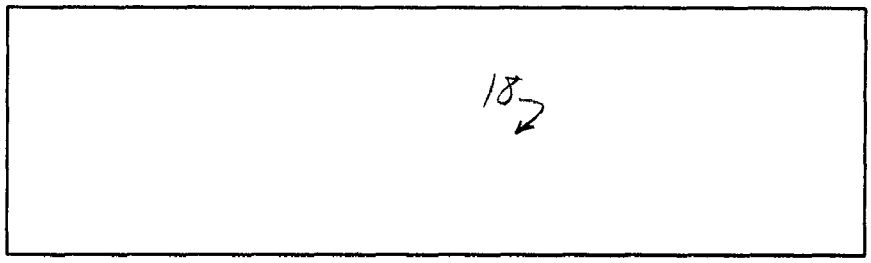
FIG. 31 is a top elevational view of the top panel of FIG. 29.
Figure 32:
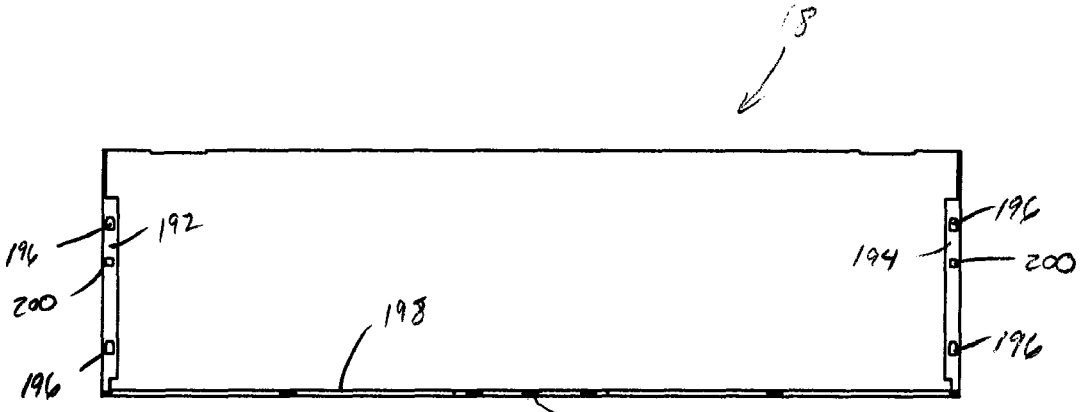
FIG. 32 is a bottom elevational view of the top panel of FIG. 29.

Referring now to FIGS. 26-28, each end panel 22, 24 is connected to bottom panel 20 by connector brackets 98. During assembly, front portion 80 of bottom panel 20 is slid forward at an angle so that front portion 80 of bottom panel 20 is below bottom end 169 of front flange 167 of first end panel 22, as shown in FIG. 26. Back portion 82 of bottom panel 20 is then rotated downwardly so that key hole slot 94, located on both side portions of bottom panel 20, engages the rearmost engagement tab 96 on connector brackets 98 located on either side of bottom panel 20, as shown in FIG. 27. When the rearmost engagement tab 96 reaches key hole slot 94, it springs outwardly into interference with a bottom edge 180 of key hole slot 94, as shown in FIGS. 27 and 28, preventing bottom panel 20 from being accidentally lifted or removed. During disassembly, to remove bottom panel 20, a user would utilize a prying device, such as a screwdriver, and push the rearmost engagement tab 96 in a direction toward the first end panel 22 thereby preventing interference with bottom edge 180 of key hole slot 94 so that back portion 82 of bottom panel 20 can be rotated upwardly and bottom panel 20 can be slid out from between the first and second end panels 22, 24. There are three slots 34 (FIG. 24) each of which has a shaped adapted receive the hooks 44 of hanger brackets 35, 36. The slots 34 include a wide base 181 that narrows to an acute top portion 182 and are aligned vertically with one another.

Figure 65:
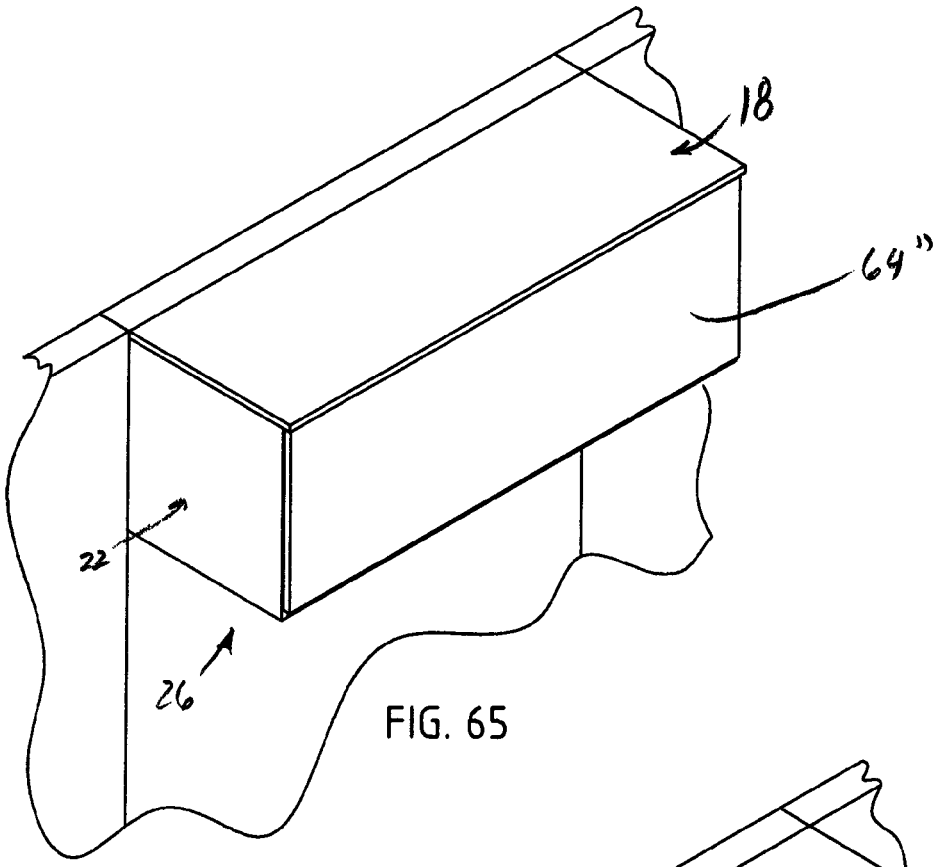
FIG. 65 is a top perspective view of an in-the-case storage unit assembly of the instant invention in a closed position.
Figure 66:
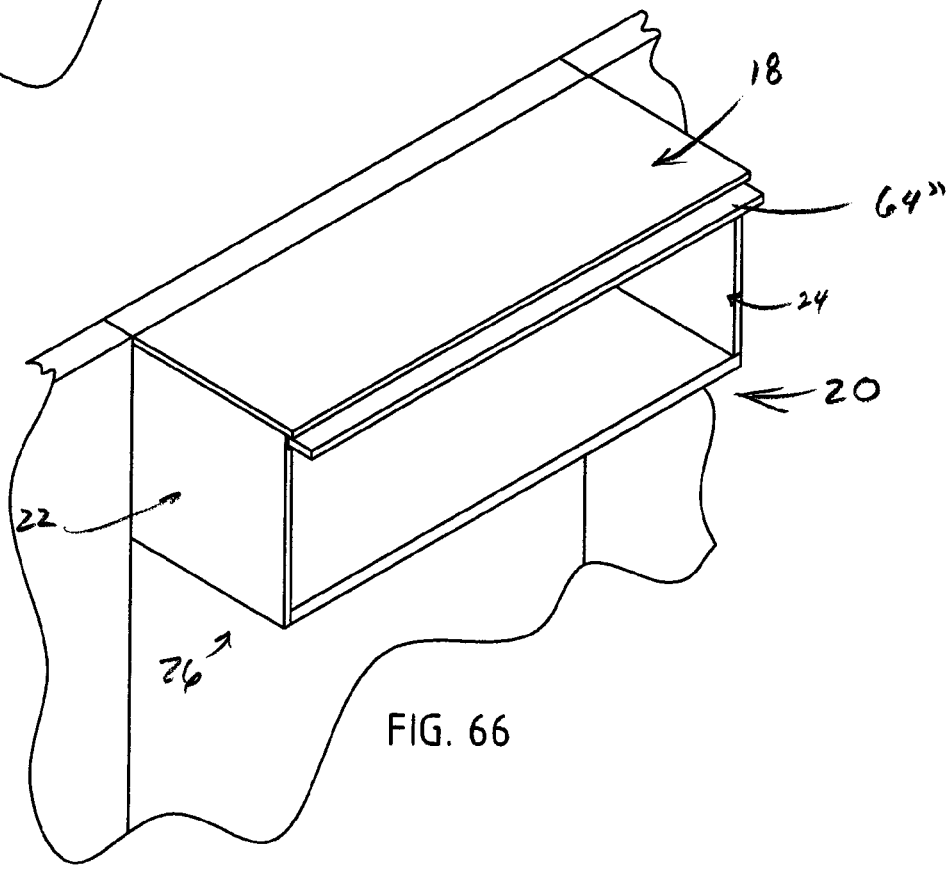
FIG. 66 is a top perspective view of an in-the-case storage unit assembly with the door in an open position.

In the example shown in FIGS. 29-32, top panel 18 includes cutouts 190 adapted to receive a portion of a hinge for an over-the-case configuration. For an in-the-case configuration (FIGS. 65 and 66), the cutouts 190 would likely not be present. Top panel 18 is substantially planar and includes an underside with first and second inwardly extending side flanges 192, 194 having clip apertures 196 disposed therein, as well as an inwardly extending rear flange 198. The clip apertures 196 are adapted to engage first and second clips 164, 166 on end panels 22, 24. A central aperture 200 is adapted to engage detent stop 168 that exists between first and second clips 164, 166 on end panels 22, 24. Top panel 18 is slid onto the clips 164, 166 until detent stop 168 engages central aperture 200, at which point top panel 18 is held in position and cannot be removed. A prying tool, such as a screwdriver, can be used to separate inwardly extending side flanges 192, 194 of top panel 18 from end panels 22, 24 so that top panel 18 can be withdrawn from connection with end panels 22, 24.

Figure 33A:
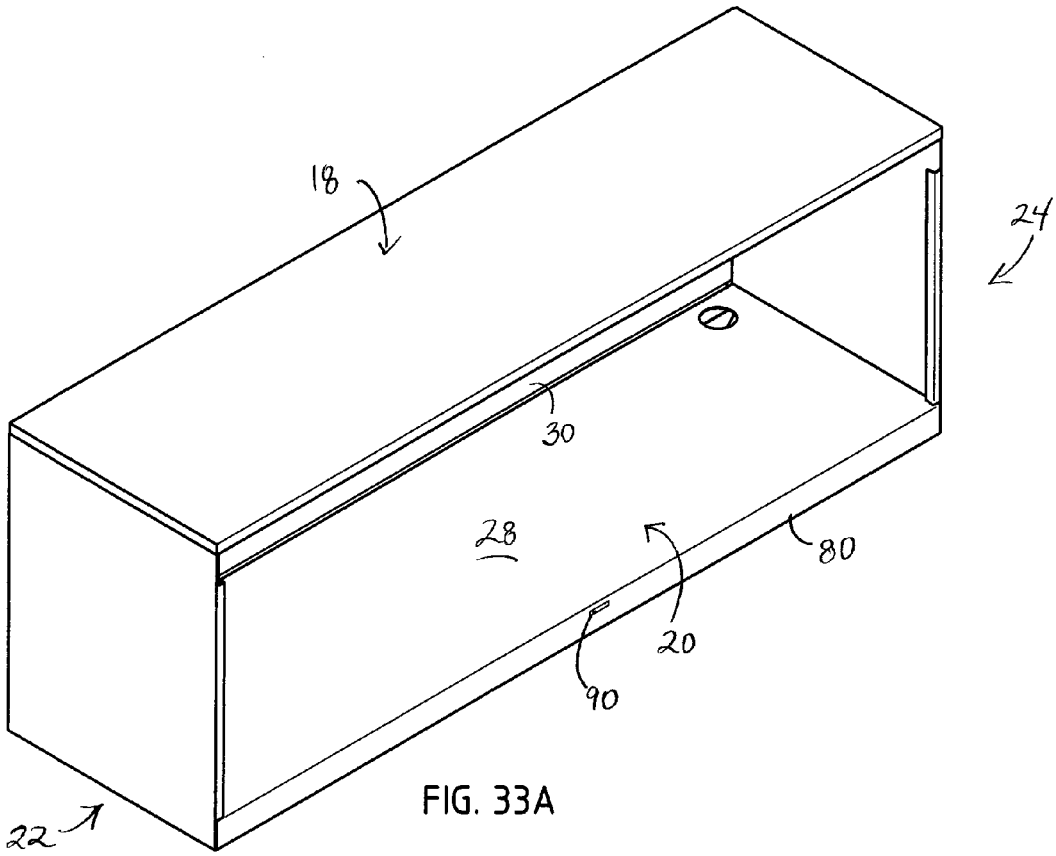
FIG. 33A is a top perspective view of the bottom panel, end panels and top panel assembled.
Figure 33B:
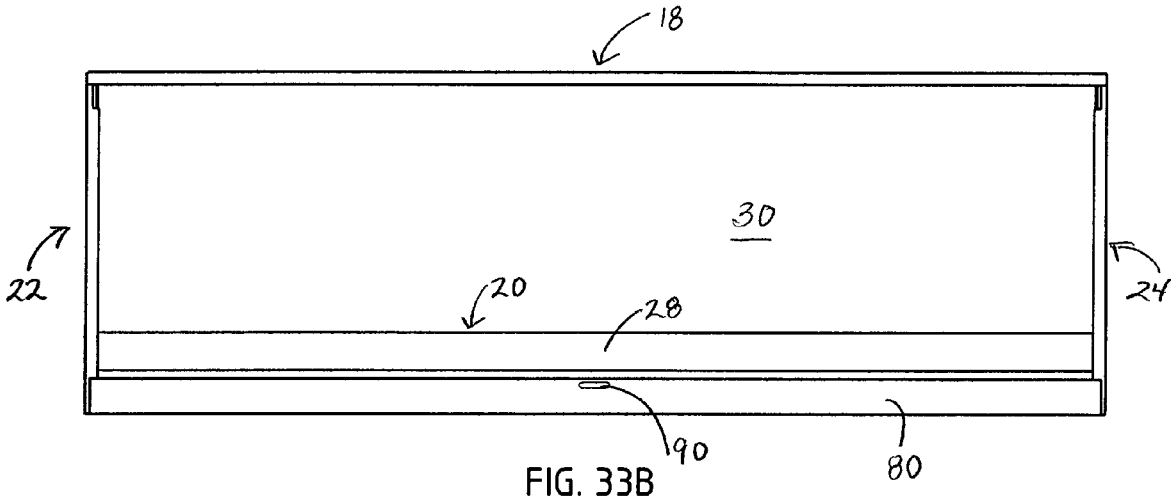
FIG. 33B is a front elevational view of the bottom panel, end panels and top panel assembled.
Figure 34:
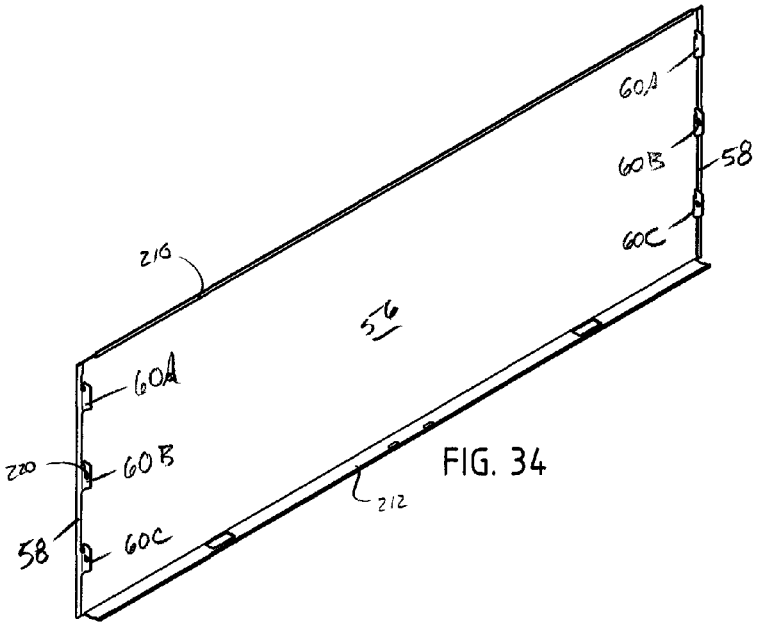
FIG. 34 is a top perspective view of a removable back of the instant invention.
Figure 35:
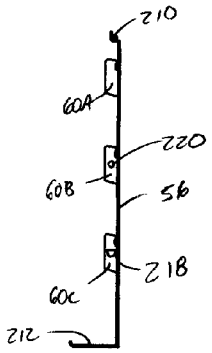
FIG. 35 is a side elevational view of the removable back of FIG. 34.
Figure 36A:
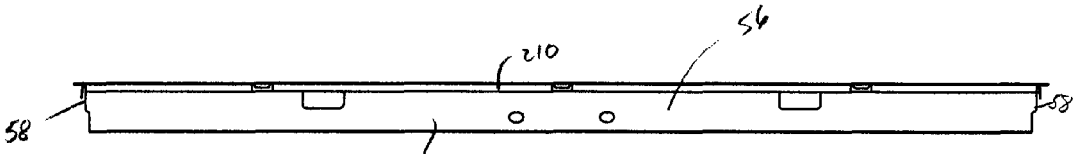
FIG. 36A is a top elevational view of the removable back of FIG. 34.
Figure 36B:
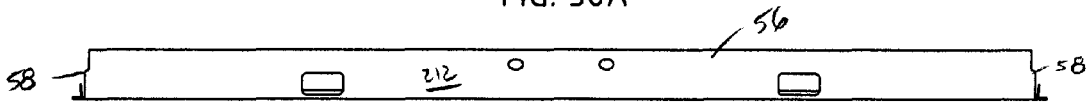
FIG. 36B is a bottom elevational view of the removable back of FIG. 34.
Figure 37:
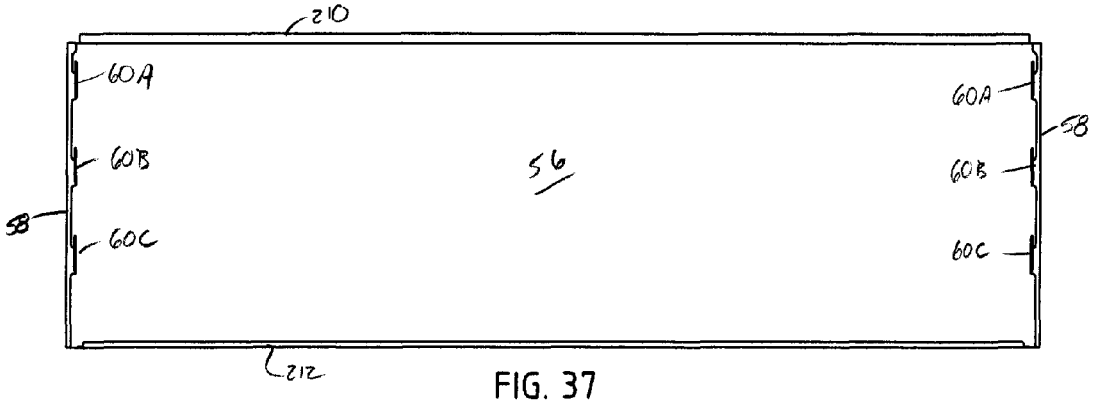
FIG. 37 is a front elevational view of removable back of FIG. 34.
Figure 38:
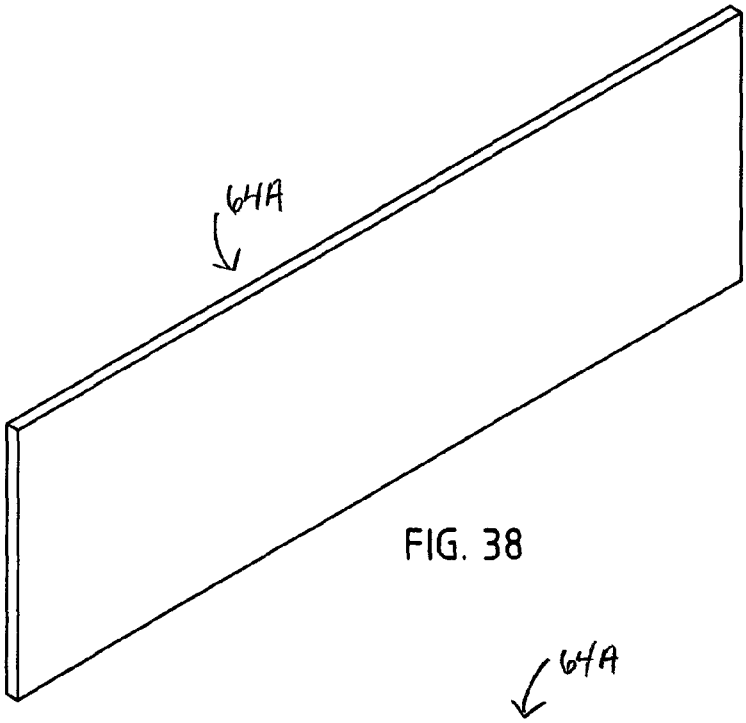
FIG. 38 is a top perspective view of a metal door of the instant invention.
Figure 39:
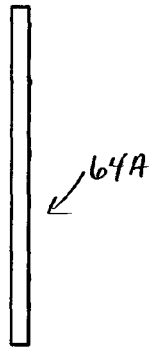
FIG. 39 is a side elevational view of the metal door of FIG. 38.
Figure 40:
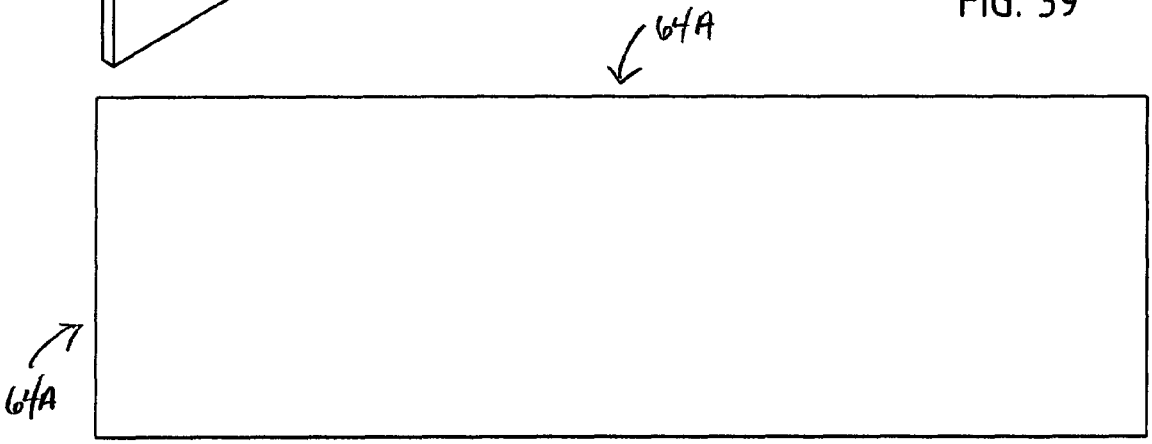
FIG. 40 is a front elevational view of the metal door of FIG. 38.
Figure 41:
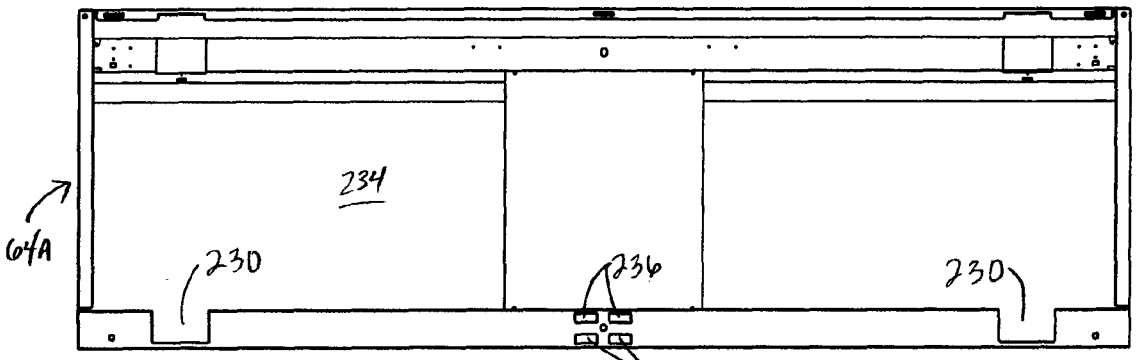
FIG. 41 is a rear elevational view of the metal door of FIG. 38.
Figure 42:
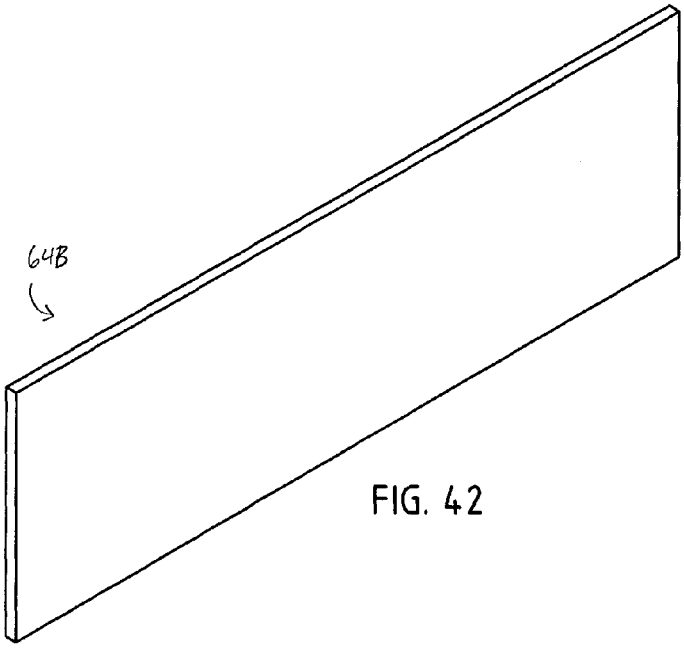
FIG. 42 is a top perspective view of a wood door of the instant invention.
Figure 43:
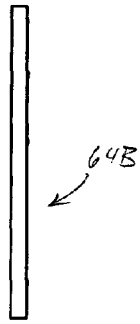
FIG. 43 is a side elevational view of the wood door of FIG. 42.
Figure 44:
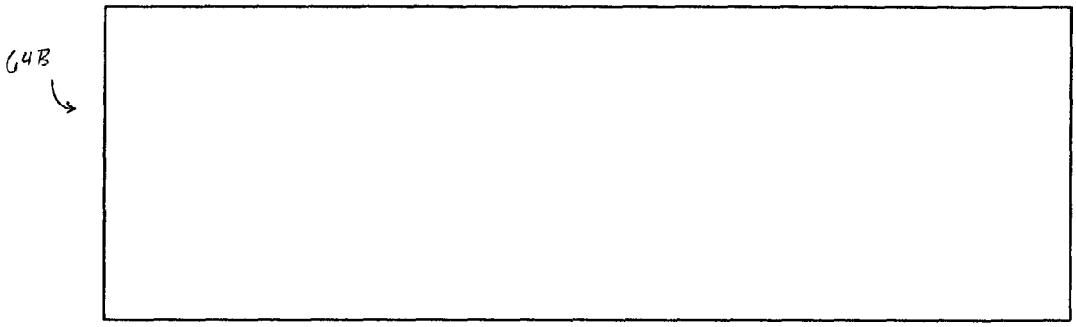
FIG. 44 is a front elevational view of the wood door of FIG. 42.
Figure 45:
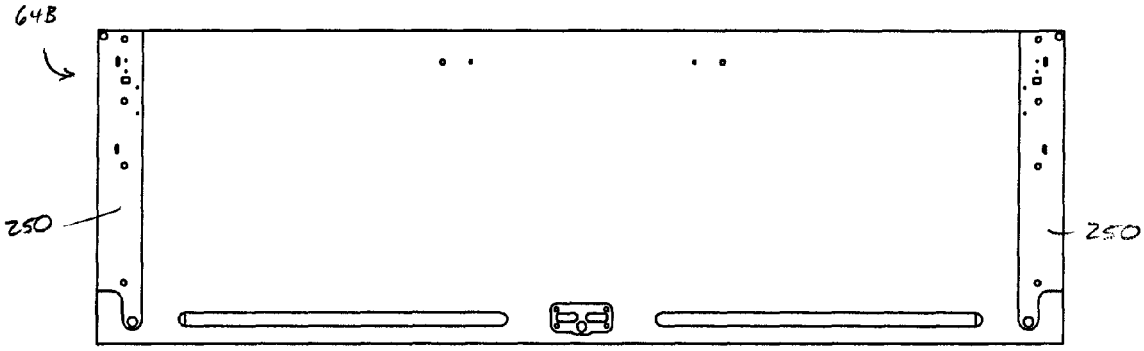
FIG. 45 is a rear elevational view of the wood door of FIG. 42.
Figure 46:
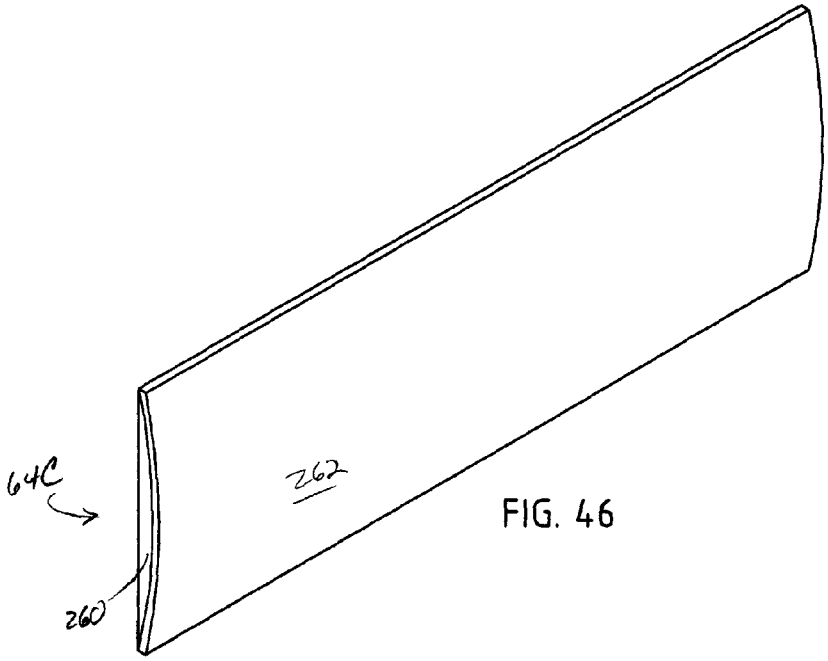
FIG. 46 is a top perspective view of a curved front door of the instant invention.
Figure 47:
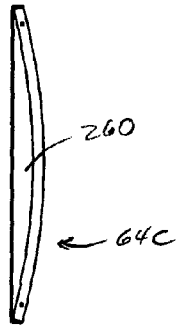
FIG. 47 is a side elevational view of the curved front door of FIG. 46.
Figure 48:
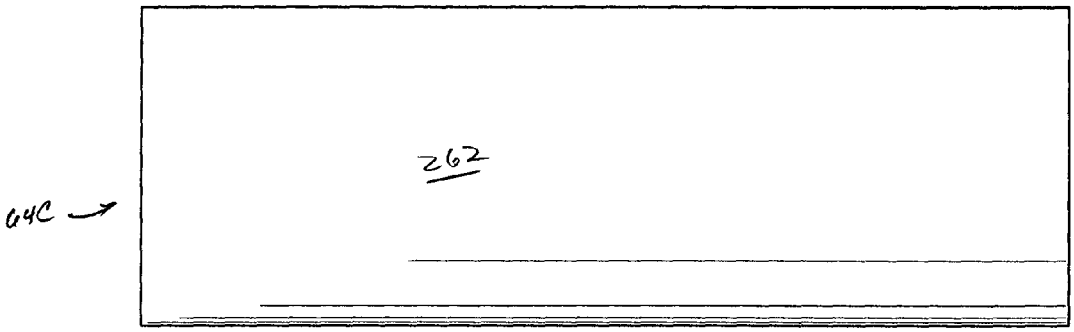
FIG. 48 is a front elevational view of the curved front door of FIG. 46.
Figure 49:
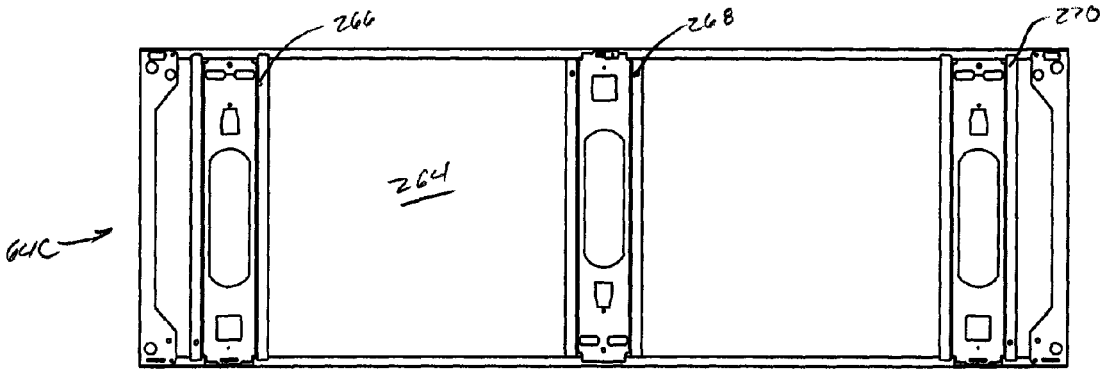
FIG. 49 is a rear elevational view of the curved front door of FIG. 46.
Figure 50:
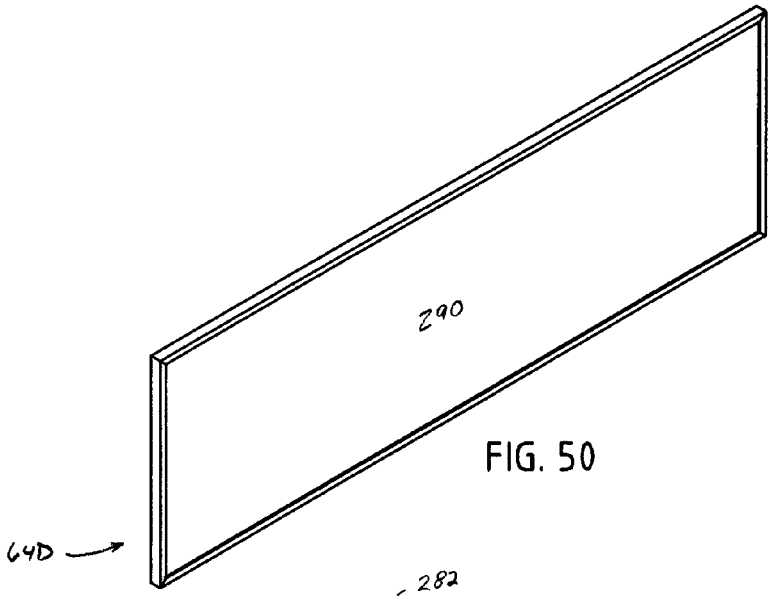
FIG. 50 is a top perspective view of a picture frame door of the instant invention.
Figure 51:
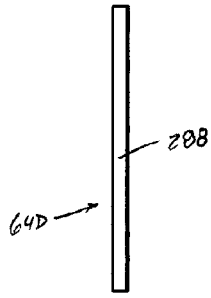
FIG. 51 is a side elevational view of the picture frame door of FIG. 50.
Figure 52:
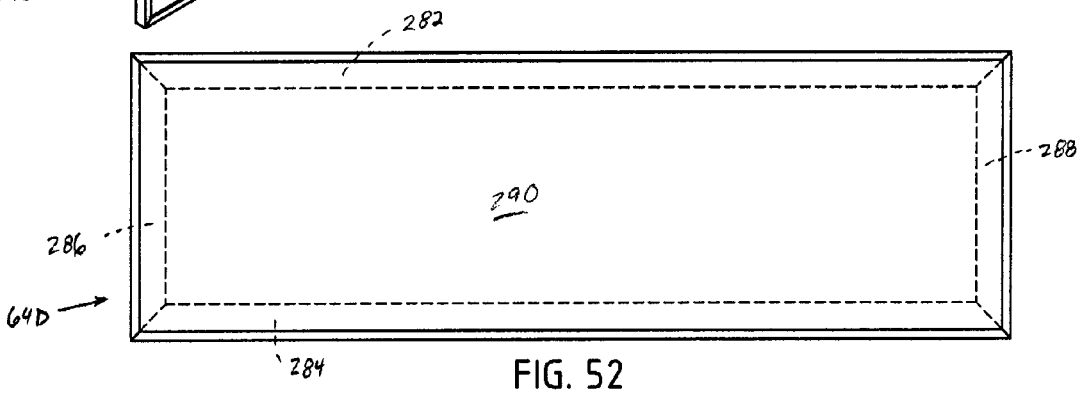
FIG. 52 is a front elevational view of the picture frame door of FIG. 50.

Referring to FIGS. 33A and 33B, the assembly of first and second end panels 22, 24 with top and bottom panels 18, 20 defines the rigid box-shaped case 26 with a generally rigid bottom portion 28 and a generally open back portion 30.

As shown in FIGS. 34-37, the illustrated removable back panel 56 includes a top engagement flange 210, a bottom engagement flange 212, and top hooks 60A, middle hooks 60B and bottom hooks 60C (collectively referred to as hooks 60) that protrude outwardly from side portions 58 in a direction generally orthogonal to the planar extent of the removable back panel 56. Hooks 60 of removable back panel 56 are designed for engagement with slots 34 in the rear portion 32 of each of the first and second end panels 22, 24. The bottom hook 60C on each side of back panel 56 includes an anti-dislodgment aperture 218 designed for engagement with an anti-dislodgement clip located on each of the first and second end panels 22, 24 (shown in FIGS. 97B and 97C) in a similar fashion to that described below with respect to hook 44C of connector brackets 35, 36. In addition the middle hook 60B on each side of back panel 56 includes an anti-dislodgement aperture 220 for receiving an optional anti-dislodgement pin. The hooks 60 have a shape and size very similar to the shape and size of hooks 44 on hanger brackets 35, 36. The three hooks 60A, 60B and 60C are aligned vertically on both side portions 58 of the removable back 56 and are adapted to engage the three vertical slots 34. The back panel 56 is typically installed onto case 26 when the case is to be secured in an up-mounted condition.

Referring now to FIGS. 38-53, the storage unit assemblies are adapted for use with metal doors 64A, wood doors 64B, curved front doors 64C and picture frame doors 64D. The metal doors 64A shown in FIGS. 38-41 are substantially planar and include slide cutouts 230 adapted to receive quick attach clips 232, as shown in FIG. 61, that hold slide assemblies in place in an over-the-case application. A back side 234 of the metal door 64A also includes two sets of lock apertures 236, 238 adapted to receive and retain locking arm 92 in a locking housing 76. The top set of apertures 236 is used for a short case construction and the bottom set of apertures 238 is used for a tall case construction. Doors may be installed on the storage unit assembly in a variety of ways, including those disclosed in U.S. Provisional Application Ser. No. 60/940,899, filed May 30, 2007, entitled STORAGE UNIT DOOR APPARATUS AND METHOD, which is hereby incorporated by reference.

FIGS. 42-45 illustrate wood door 64B, which is similar in construction to the metal door 64A described above, but is solid wood, and includes metal side reinforcements 250. Wood door 64B is adapted for use in an in-the-case application, although it is contemplated that wood door 64B could be used in an over-the-case application as well.

FIGS. 46-49 illustrate curved front door 64C having side walls 260 and a curved front side 262. A back side 264 of the curved front door 64C includes three bracket assemblies 266, 268, 270. The central bracket assembly 268 provides structural support while the side brackets 266 and 270 are adapted to connect with slide assemblies in an over-the-case application.

Figure 53A:
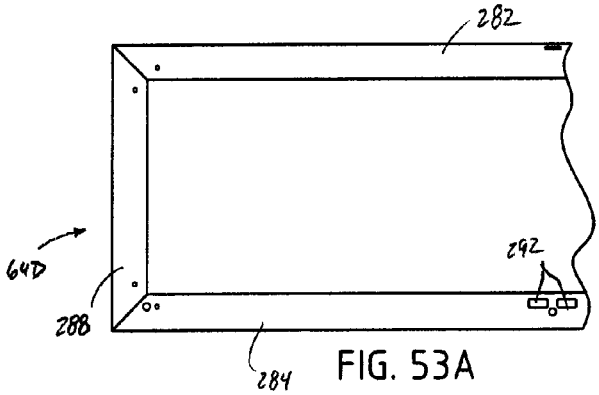
FIG. 53 is a rear elevational view of the picture frame door of FIG. 50.
Figure 53B:
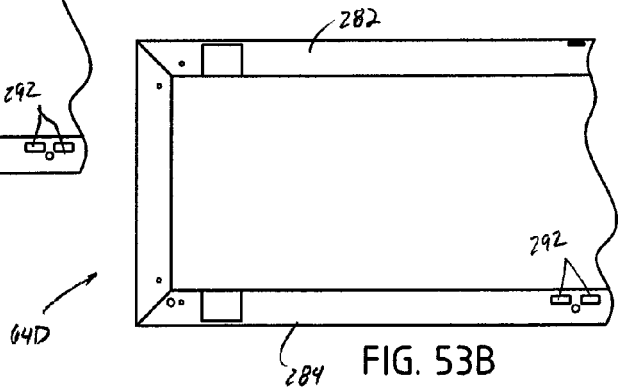
Figure 54:
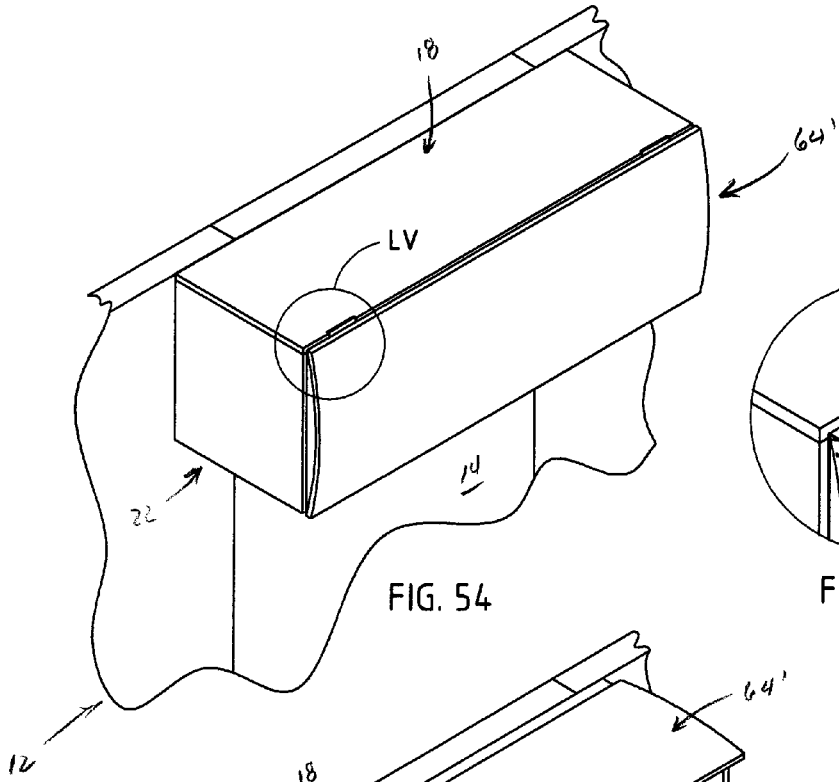
FIG. 54 is a top perspective view of an over-the-case storage unit assembly of the instant invention in a closed position.
Figure 55:
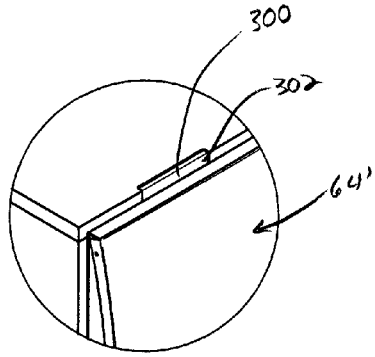
FIG. 55 is an enlarged view of section LV of the over-the-case storage unit assembly of FIG. 54.
Figure 56:
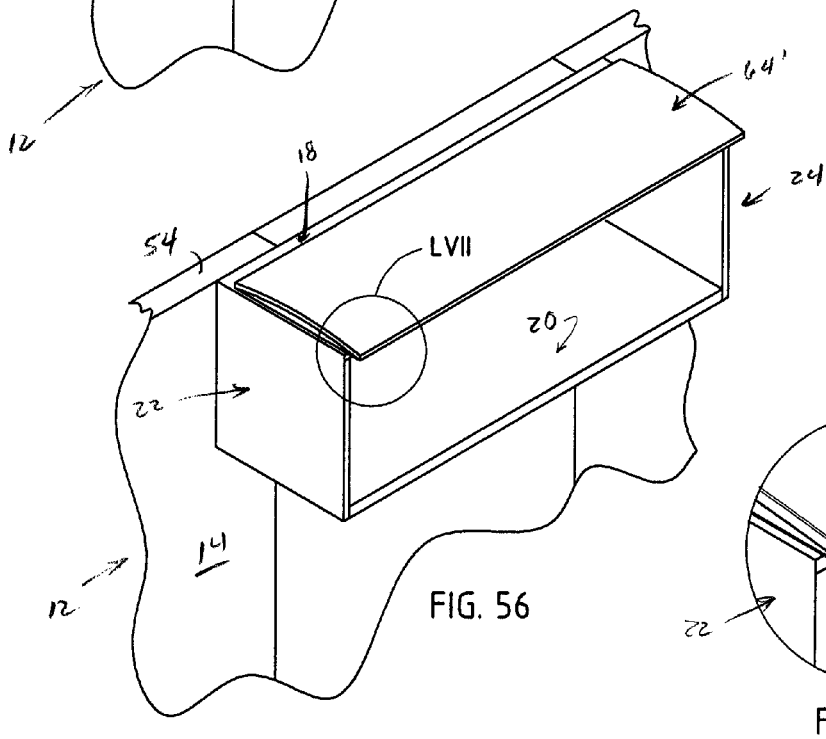
FIG. 56 is a top perspective view of an over-the-case storage unit assembly of the instant invention in an open position.
Figure 57:
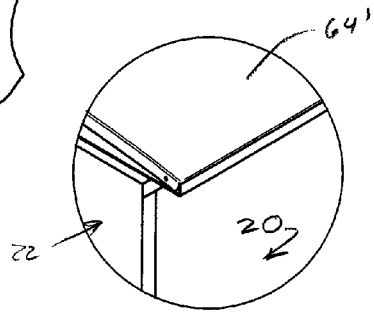
FIG. 57 is an enlarged view of section LVII of the over-the-case storage unit assembly of FIG. 56.

Referring now to FIGS. 50-52, 53A and 53B, picture frame door 64D includes a frame construction 280 having a top member 282, bottom member 284, and side members 286, 288 configured to frame a planar sheet 290. The planar sheet 290 may be a marker board, translucent or opaque material, or a solid material, for example. Picture frame door 34D also includes a set of lock apertures 292 for installation on storage unit assemblies in either an over-the-case (FIG. 53B) or in-the-case application (FIG. 53A). The over-the-case picture frame door 64D also includes slide cutouts for receiving a slide mechanism.

Referring now to FIGS. 54-57, the metal door 64A, wood door 64B, curved front door 64C or picture frame door 64D may be used as an over-the-case door 64' for an over-the-case configuration or application. The door 64' is connected to a planar attachment bracket 300 in the cutouts 190 in the top panel 18 and not directly to the front portion of the top panel 18. As a result, a reduced gap 302 is created. In the over-the-case construction, the door 64' can be moved from a vertical closed position to a horizontal open position where the door 64' rests on the top panel 18.

Figure 58:
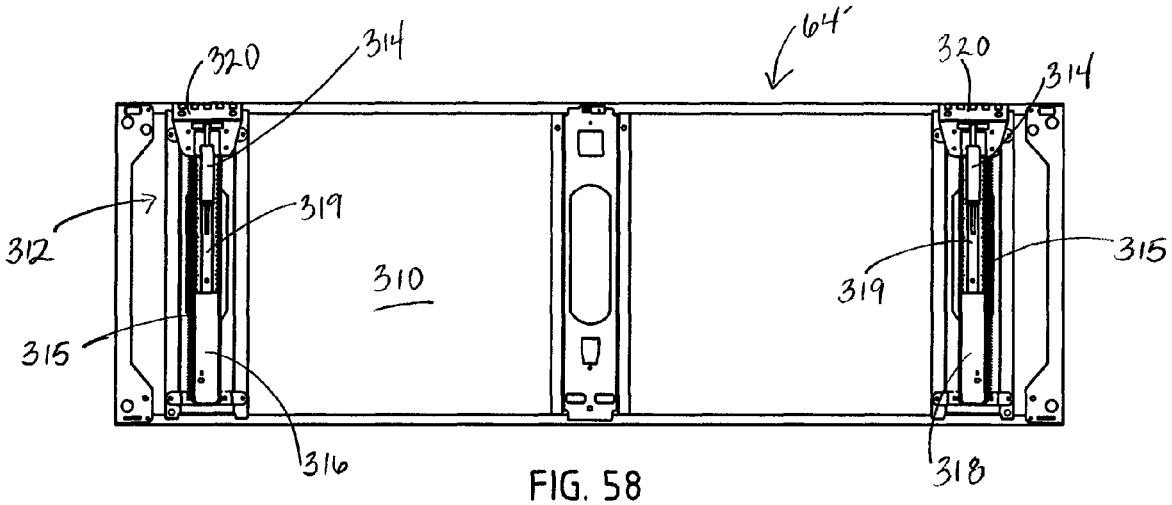
FIG. 58 is rear elevational view of an over-the-case door.
Figure 59:
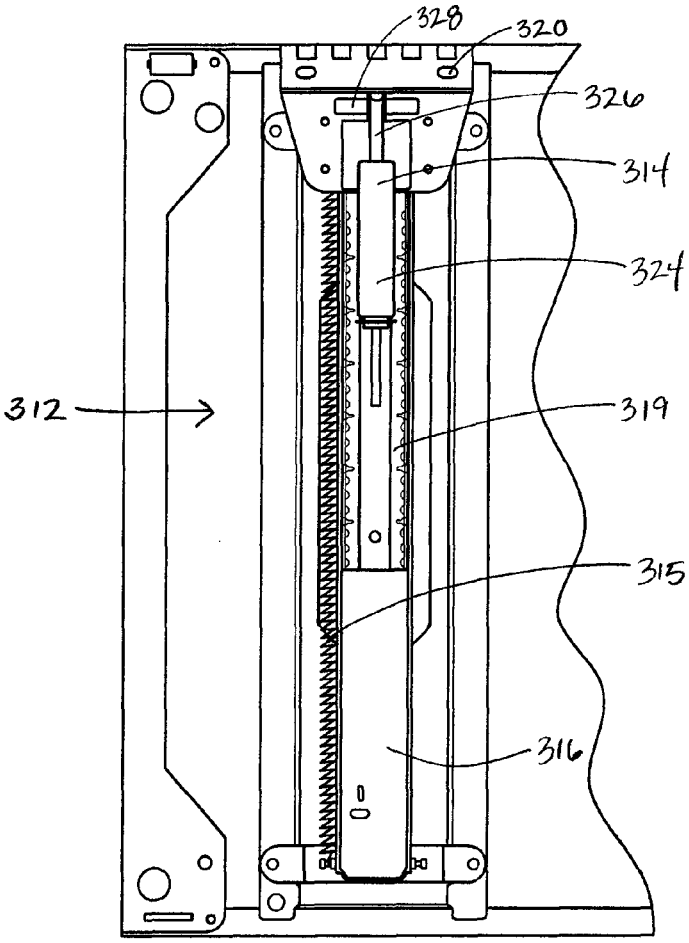
FIG. 59 is a partial rear elevational view of an over-the-case door.
Figure 60:
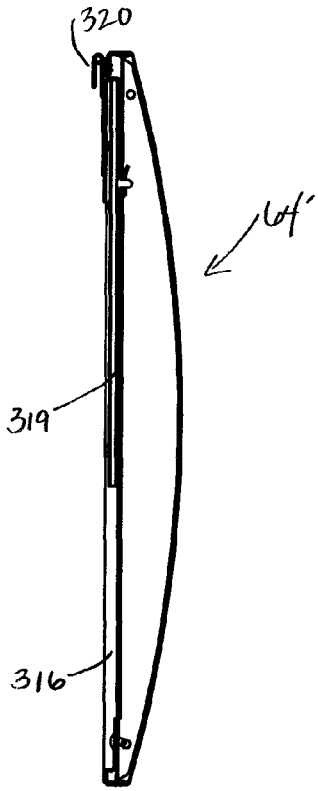
FIG. 60 is a side elevational view of an over-the-case door.

In the example shown in FIGS. 58-60, a rear side portion 310 of the over-the-case door 64' includes an over-the-case door support mechanism 312 having optional dampener assemblies 314 and optional spring assists 315 connected with first and second door slides 316, 318. Door slides 316, 318 are attached rear side 310 of door 64' and to hinges 320 located at the inside top of door 64' and each door slide 316, 318 includes a carriage 319. The hinges 320 allow door 64' to move between open and closed positions. The slides 316, 318 allow relative movement of door 64' to an open position above storage unit assembly 10 and to a closed vertical position in front of storage unit assembly 10. As shown in FIG. 59, the dampener assembly 314 has a piston 324 and a spring cylinder 326. Piston 324 is biased outward from the spring cylinder 326, and acts to slow movement of the over-the-case door 64' during closure. Piston 324 is attached to a pivot pin 328 disposed below and further inside the case 26 than hinges 320. Spring assists 315 secured on either side of the dampener assembly 314 act to assist the user during opening of the over-the-case door 64'.

Figure 61A:
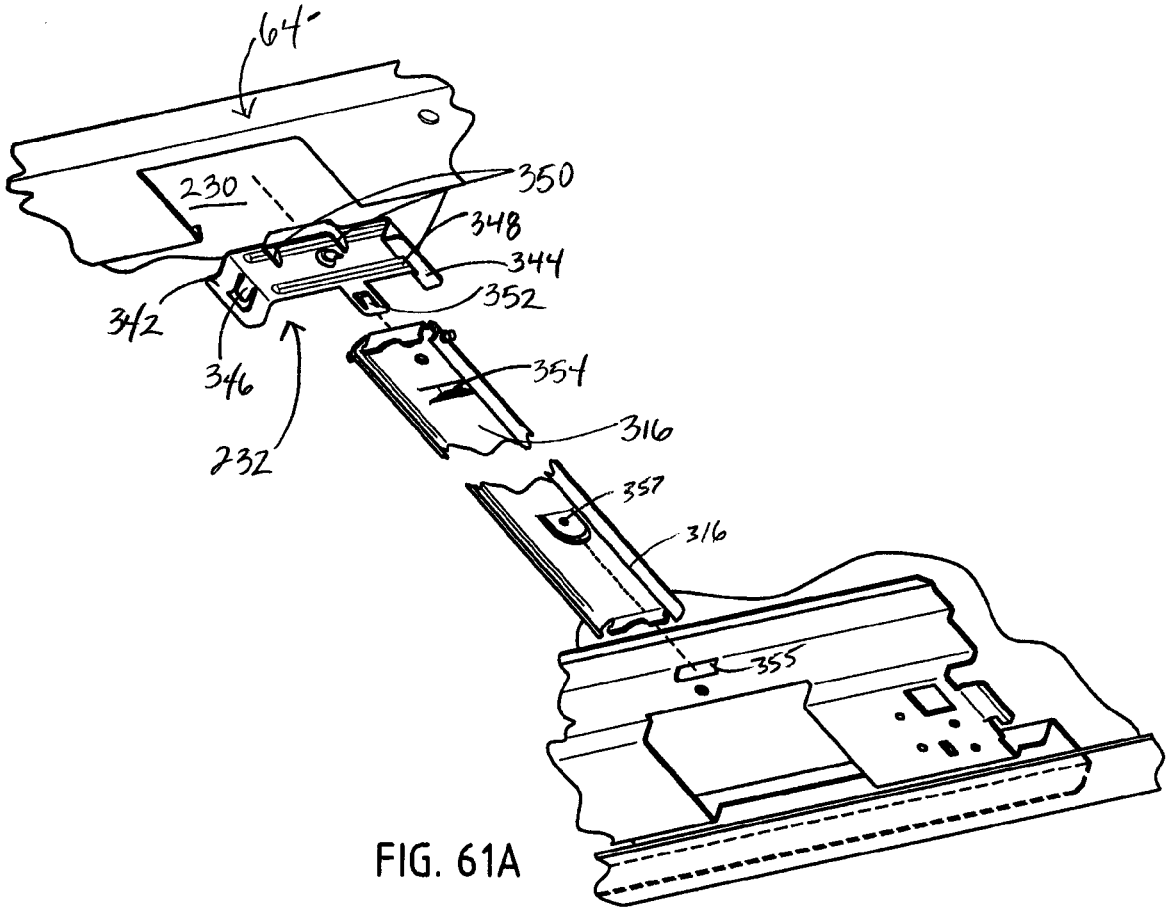
FIG. 61 is a bottom perspective view of a door slide with quick attach clip for the over-the-case door.
Figure 61B:
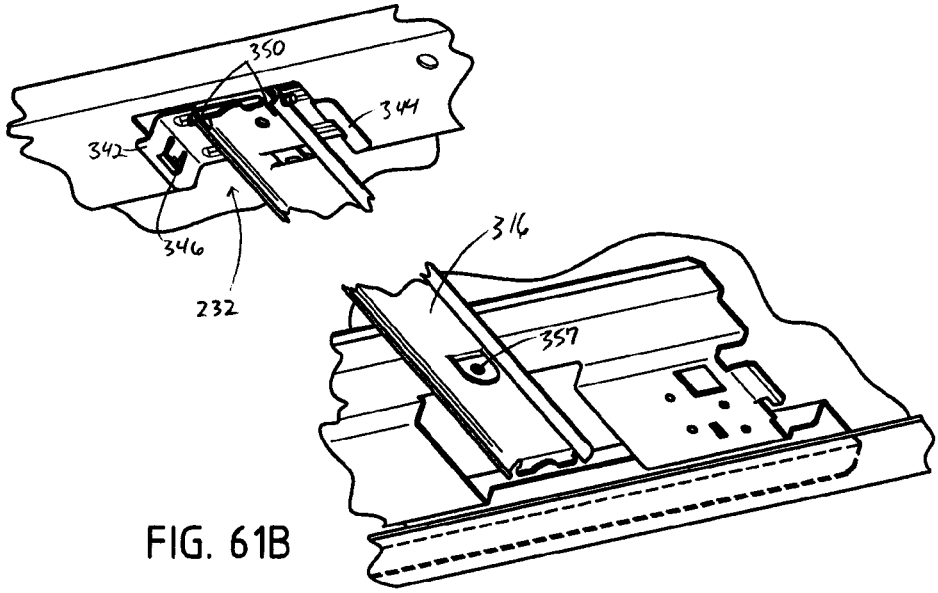

FIGS. 61A and 61B illustrate the quick attach clip 232 that may be used to secure door slides 316, 318 to door 64'. The quick attach clip 232 includes first and second wings 342, 344 with first and second tabs 346, 348, respectively, designed to provide an interference fit with slide cutouts 230 in the over-the-case door 64'. Legs 350 extend into the slides 316, 318 and hold the slide in position. A center tab 352 extends and locks into a loop 354 on slide 316 keeping slide 316 from slipping out of quick attach clip 232. Both slides 316 and 318 may be attached in the manner described above. A door-side engagement tab 353 on track is selectively received in a tab receiving aperture 355 (FIG. 61B) in a hat channel near the top of interior side of door 64'. Engagement tab 353 includes a fastener aperture 357 for receiving a mechanical fastener that can be secured through both engagement tab 353 and hat channel of door 64'. Alternatively, as shown in FIG. 62, a permanent bracket 356 with fasteners 358 may be used.

Figure 62:
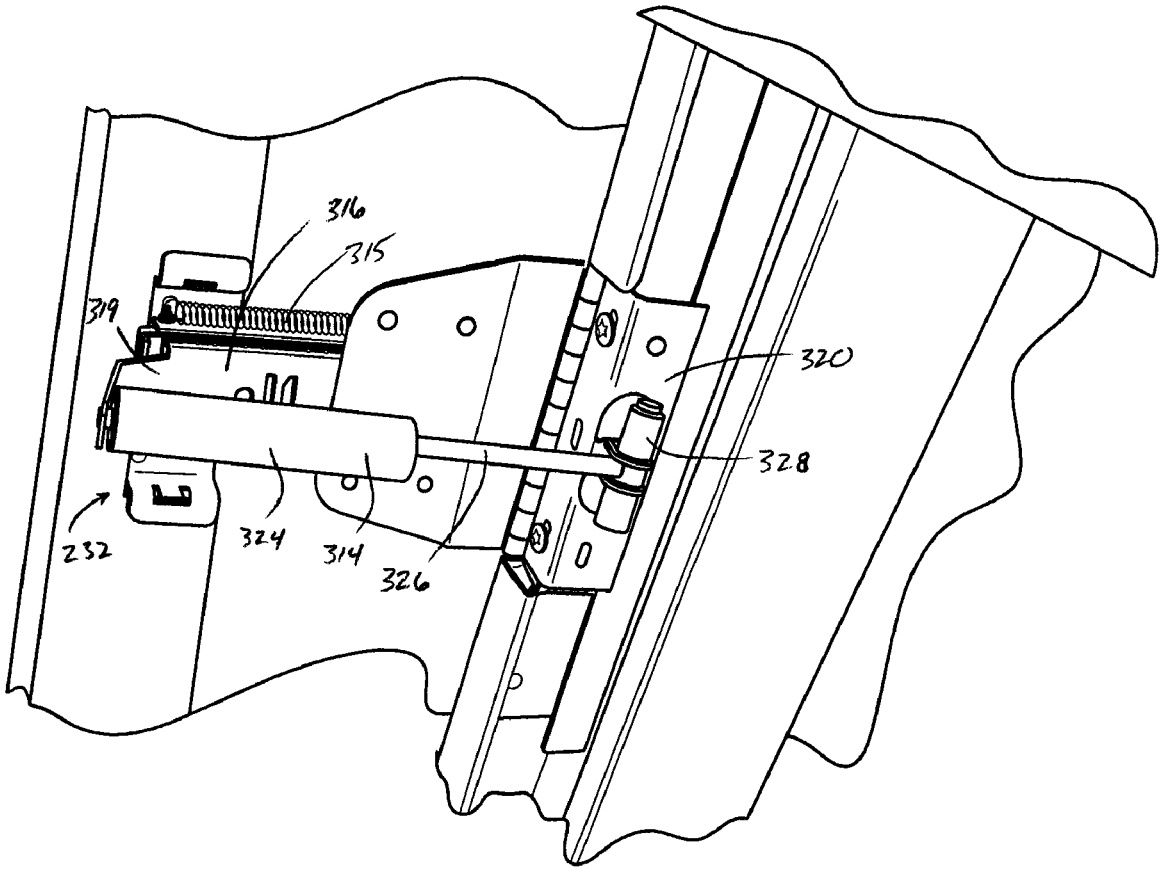
FIG. 62 is a bottom perspective view of a door slide in a nearly fully open position.
Figure 63:
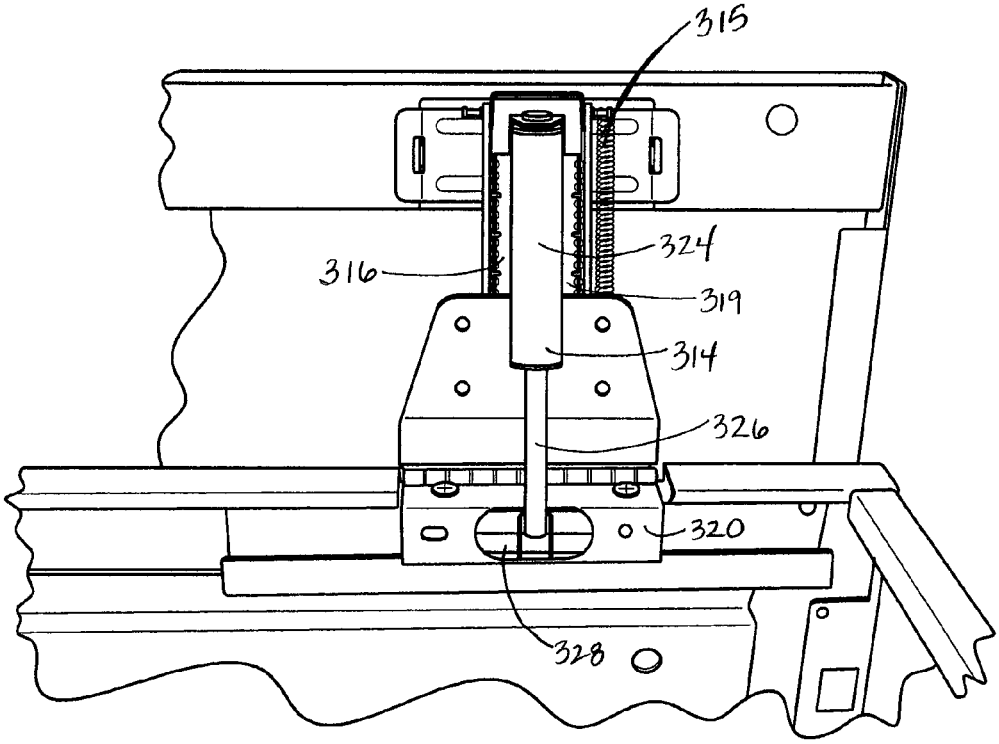
FIG. 63 is a bottom elevational view of the door slide of FIG. 62.
Figure 64:
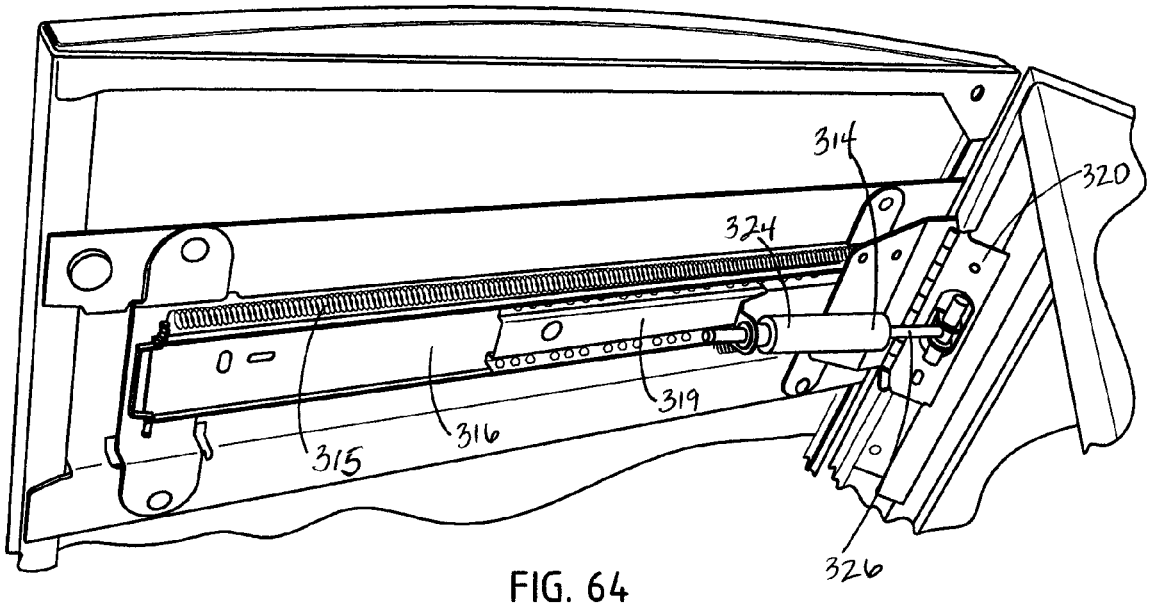
FIG. 64 is a bottom perspective view of a door slide for the over-the-case application in an nearly fully closed position.

FIG. 62-64 illustrate over-the-case door 64' at a nearly fully open position. The door 64' is allowed to slide along slide 316 (or 318) until reaching the top of the slide at the inside top of the door. As shown in FIG. 64, slides 316 and 318 allow the over-the-case door 64' to move downwardly relative to top panel 18 of storage unit assembly 10 until the bottom of the over-the-case door 64' can abut bottom panel 20. Spring assist 315 lessens the rate of travel when the door 64' is closed and minimizes the likelihood of injury to a user. In addition, when door 64' is being opened, spring assist 315 assists door 64' to open and come to rest above storage unit assembly 10.

Figure 67:
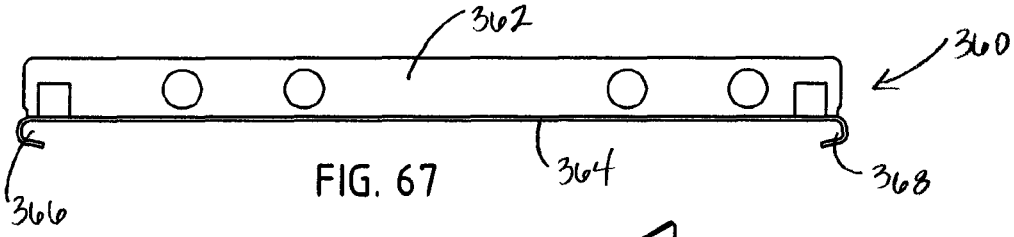
FIG. 67 is side elevational view of an in-the-case guide rail of the instant invention.
Figure 68:
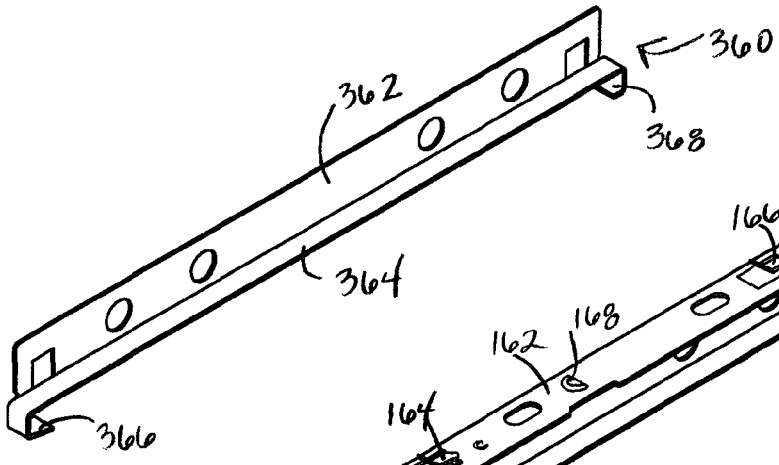
FIG. 68 is a top perspective view of the in-the-case guide rail of FIG. 67.
Figure 69:
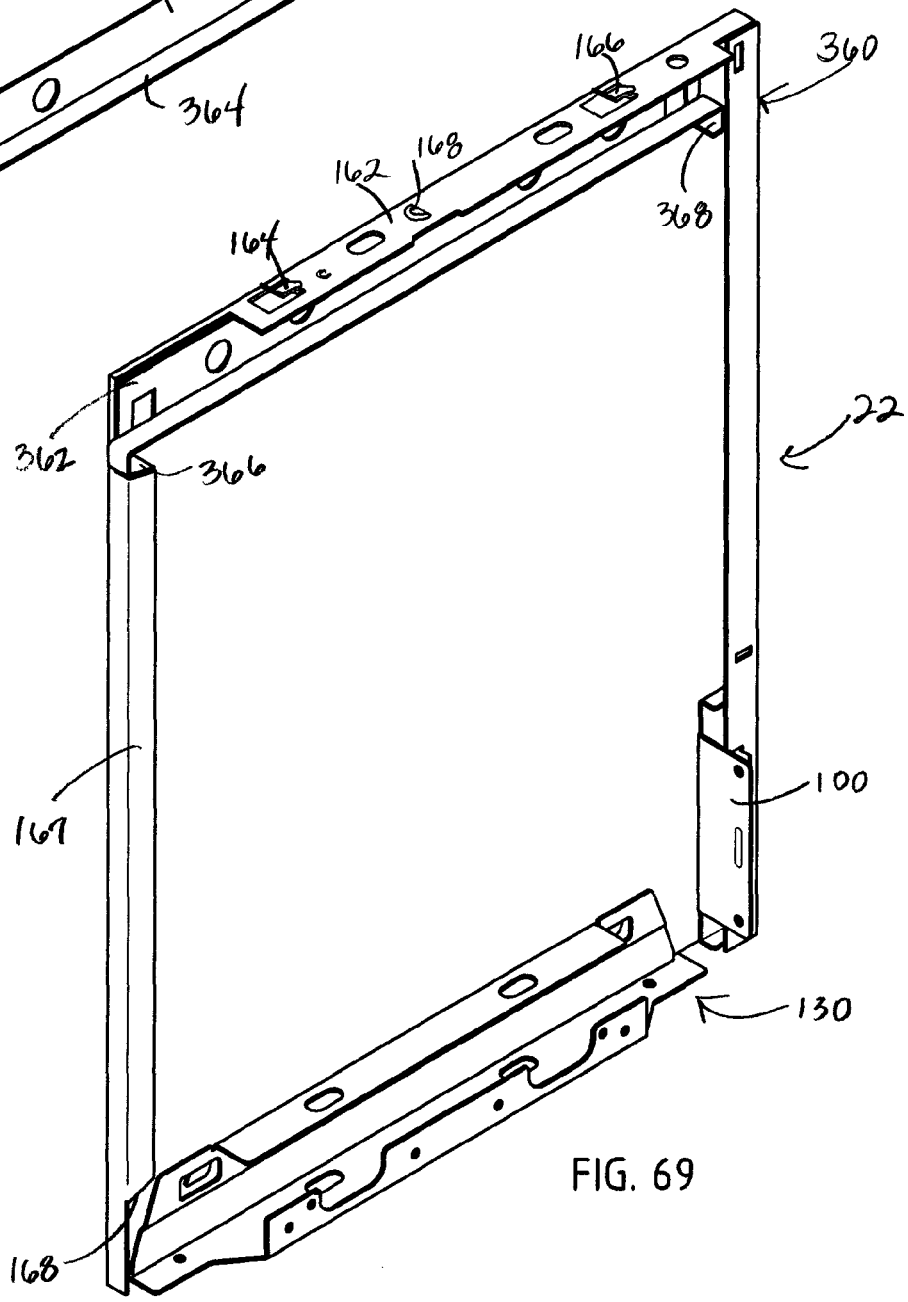
FIG. 69 is a top perspective view of the in-the-case guide rail of FIG. 67 mounted in an end panel.

Referring now to FIGS. 65-71, a door 64" having a substantially planar construction (such as the aforementioned wood door, metal door or picture frame door) may be used in an in-the-case construction or application. An in-the-case construction allows door 64" to be in a closed position perpendicular with and below top panel 18 or an open position wherein in-the-case door 64" is disposed parallel with top panel 18 and inside case 26. Door 64" is adapted to slide in and out of case 26 in the in-the-case construction on guide rails 360 that are shown in FIGS. 67 and 68. The guide rails 360 are attached to first and second end panels 22, 24 and include a vertical portion 362 fixedly attached to the inside of first and second end panels 22, 24 as well as a rail portion 364 having forward and rearward hook-like stops 366, 368. As shown in FIG. 69, guide rail 360 is located at a top portion of the inside of first and second end panels 22, 24.

Figure 70A:
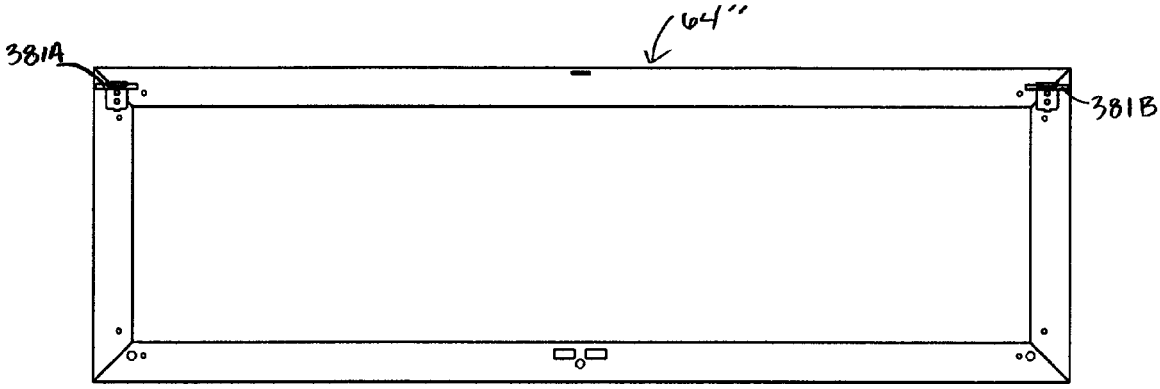
FIG. 70A is a rear elevational view of an in-the-case door of the instant invention.
Figure 70B:
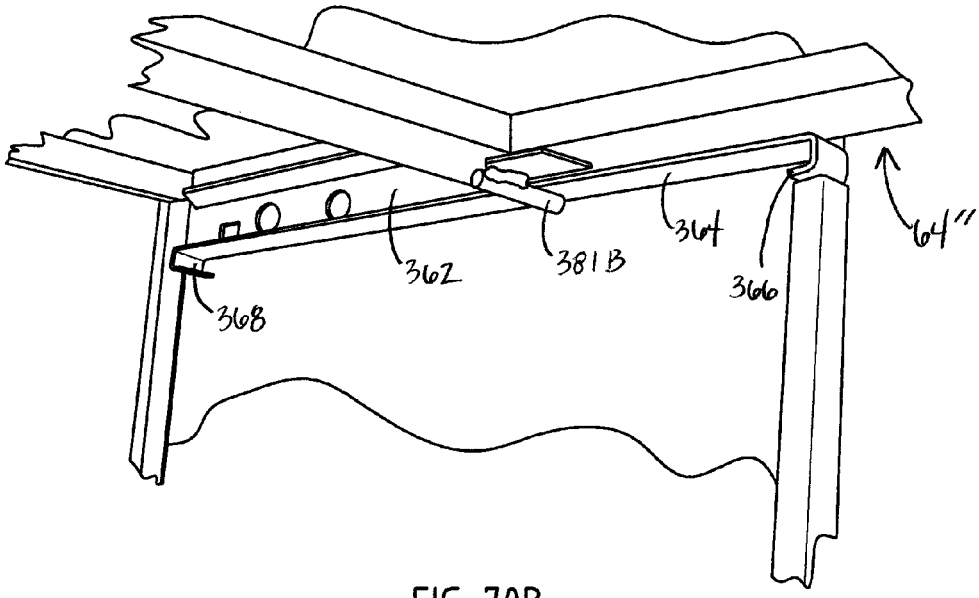
FIG. 70B is a partial bottom perspective view of the in-the-case door of FIG. 70 between open and closed positions.
Figure 71A:
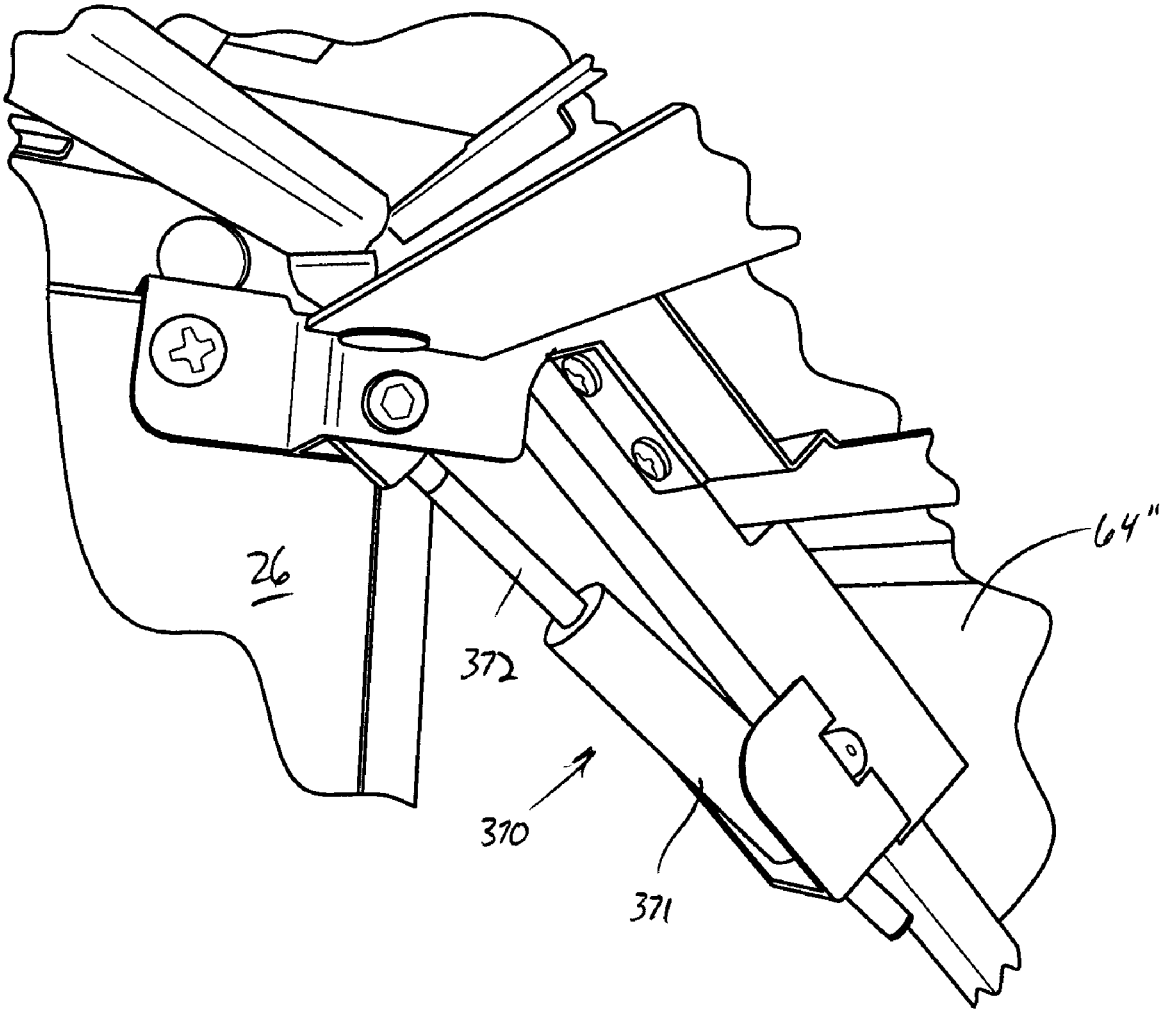
FIG. 71A is an enlarged perspective view of a dampener assembly.
Figure 71B:
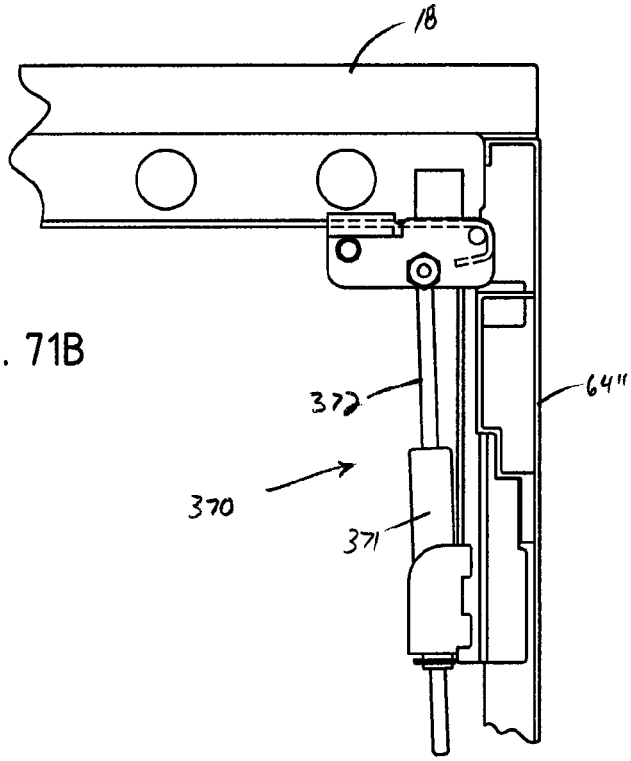
FIG. 71B is a partial side elevational view of the in-the-case door dampener with the door closed.
Figure 71C:
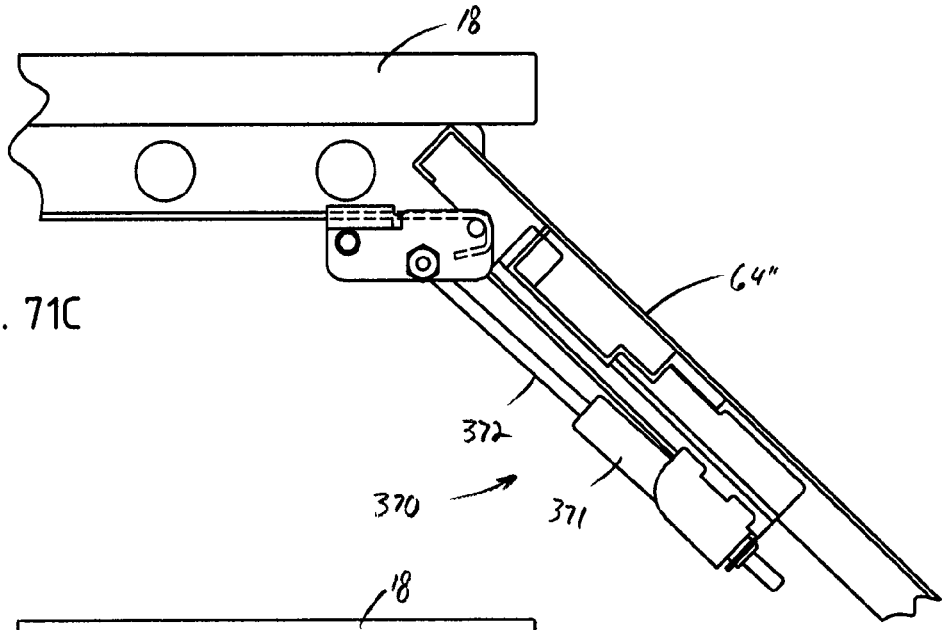
FIG. 71C is a partial side elevational view of the in-the-case door dampener with the door partially opened.
Figure 71D:
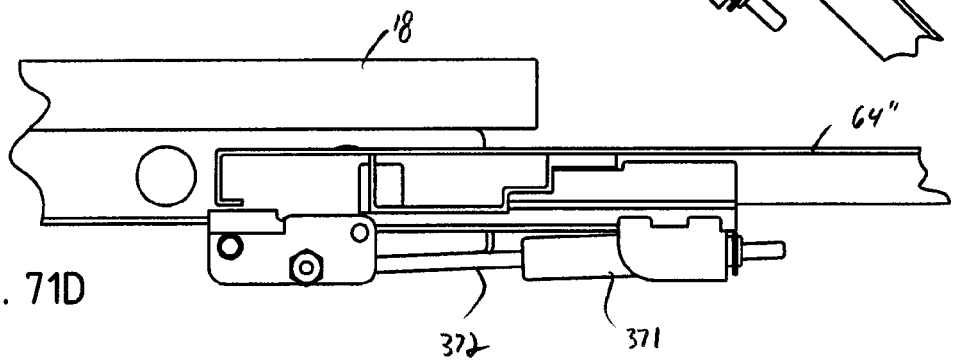
FIG. 71D is a partial side elevational view of the in-the-case door dampener with the door open.
Figure 72:
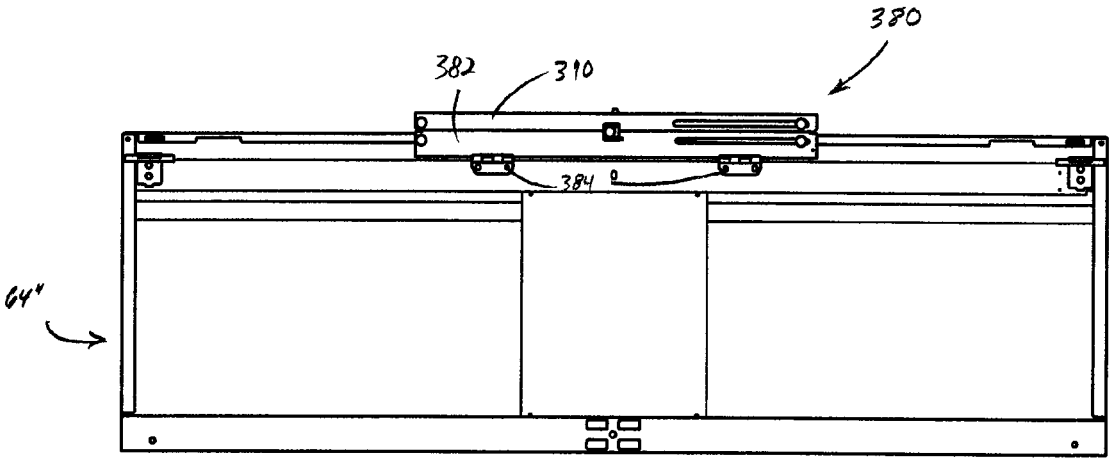
FIG. 72 is a bottom elevational view of an anti-racking mechanism attached to a metal door.
Figure 73:
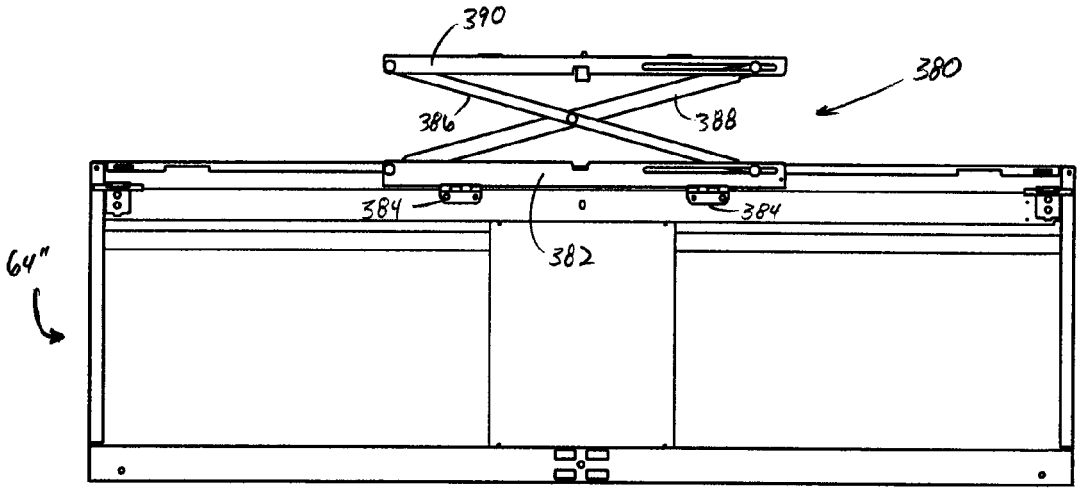
FIG. 73 is a bottom elevational view of the anti-racking mechanism of FIG. 72 in a partially extended position.

Referring to FIGS. 70 and 71, an in-the-case door support mechanism 361 includes in-the-case door 64" attached to first and second pivot pins 381A, 381B located at an rear top portion of in-the-case door 64". Each pivot pin 381A, 381B rests below guide rail 360 and is adapted to slide along the bottom of guide rail 360 between forward stop 366 (in a closed door position) and the rearward stop 368 (in an open door position). In the fully open position, in-the-case door 64" rests on top of the guide rail 360. As mentioned above, the metal door 64A, wood door 64B, or picture frame door 64D may be used for an in-the-case application. As shown in FIGS. 71A-71D, a dampener mechanism 370 may be included that provides assistance to the user when the door is being closed. The dampener 370 includes a housing 371 pivotally attached to a top portion of a door 64" and a rod 372 attached to an interior portion of case 26.

Referring now to FIGS. 72-75, an optional anti-racking mechanism 380 may be utilized that prevents in-the-case door 64" from binding during opening or closing. Anti-racking mechanism 380 includes a door side bracket 382 attached to hinges 384 that are fixedly attached to a top portion of the rear of the in-the-case door 64". Anti-racking mechanism 380 also includes first and second scissor members 386, 388 that cross and attach to a rear bracket 390. Rear bracket 390 releasably engages a quick connect bracket 392 (FIG. 75) which is fixedly attached to the underside of top panel 18 inside storage unit assembly 10. Rear bracket 390 includes tabs 393A and 393B with protuberances 394A and 394B, respectively, and a center tab 395 all of which laterally align and releasably attach rear bracket 390 with quick connect bracket 392. Rear bracket 390 includes center slot 396 and tab receiving apertures 397A and 397B which are adapted to receive protuberances 394A and 394B. Optionally, a spring assist 398 may be installed which is connected to the rear bracket 390 and door-side bracket 382.

Figure 74A:
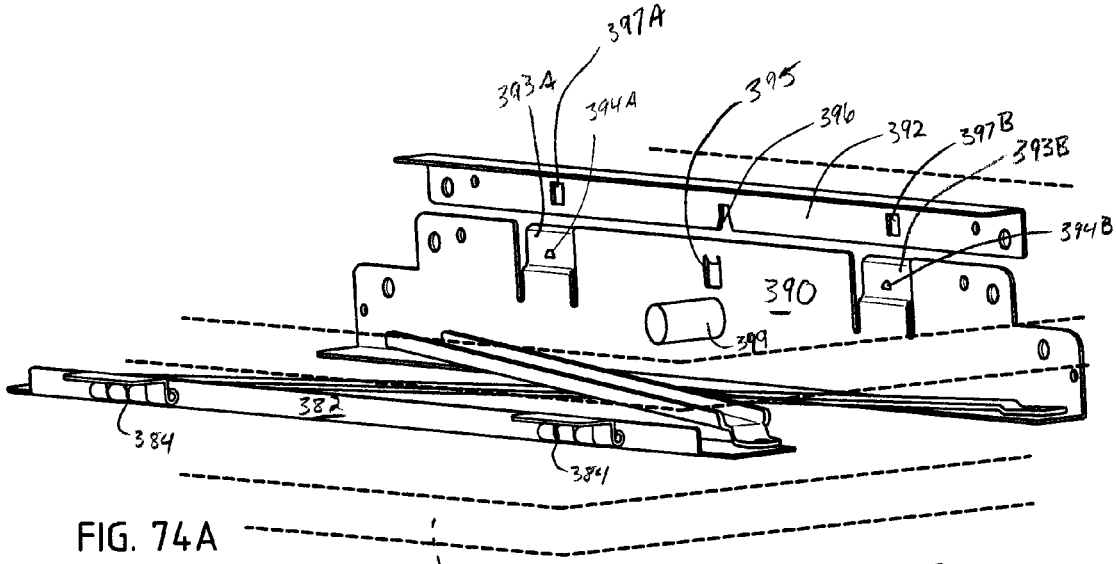
FIG. 74A is a top perspective view of an anti-racking mechanism prior to installation.
Figure 74B:
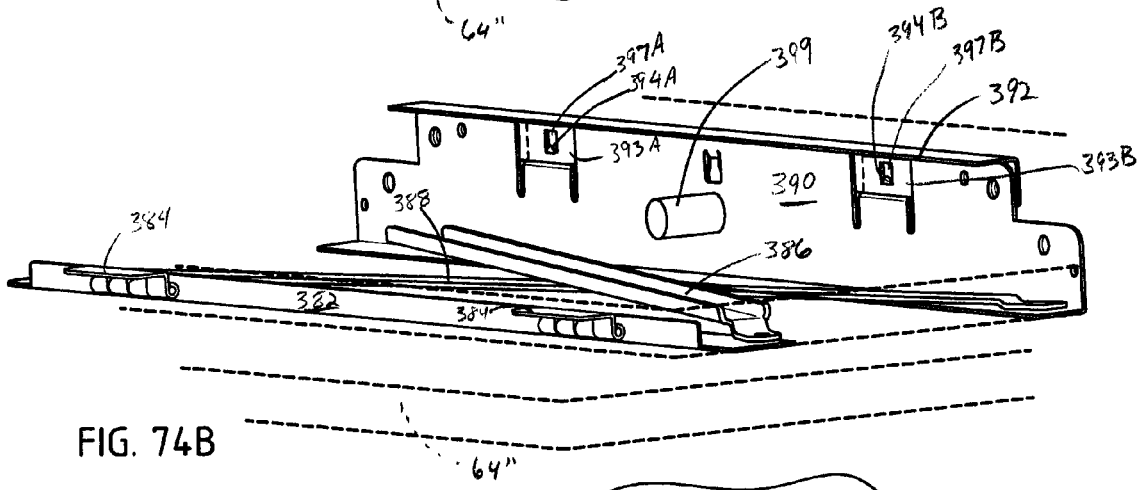
FIG. 74B is a top perspective view of the anti-racking mechanism of 74A after installation.
Figure 75:
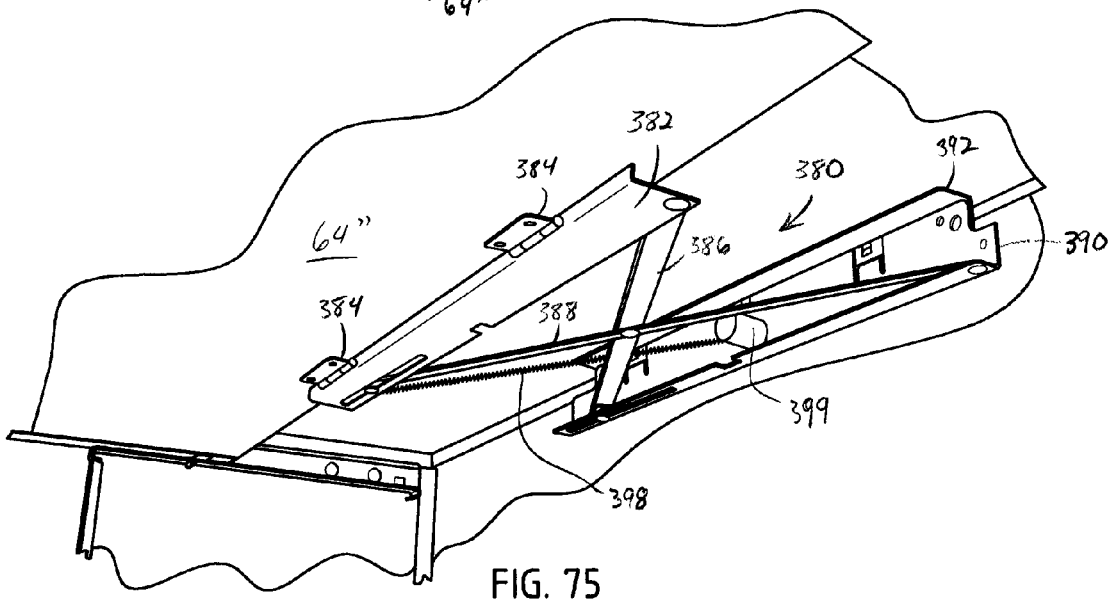
FIG. 75 is a bottom perspective view of the anti-racking mechanism of FIG. 74A after installation.
Figure 76A:
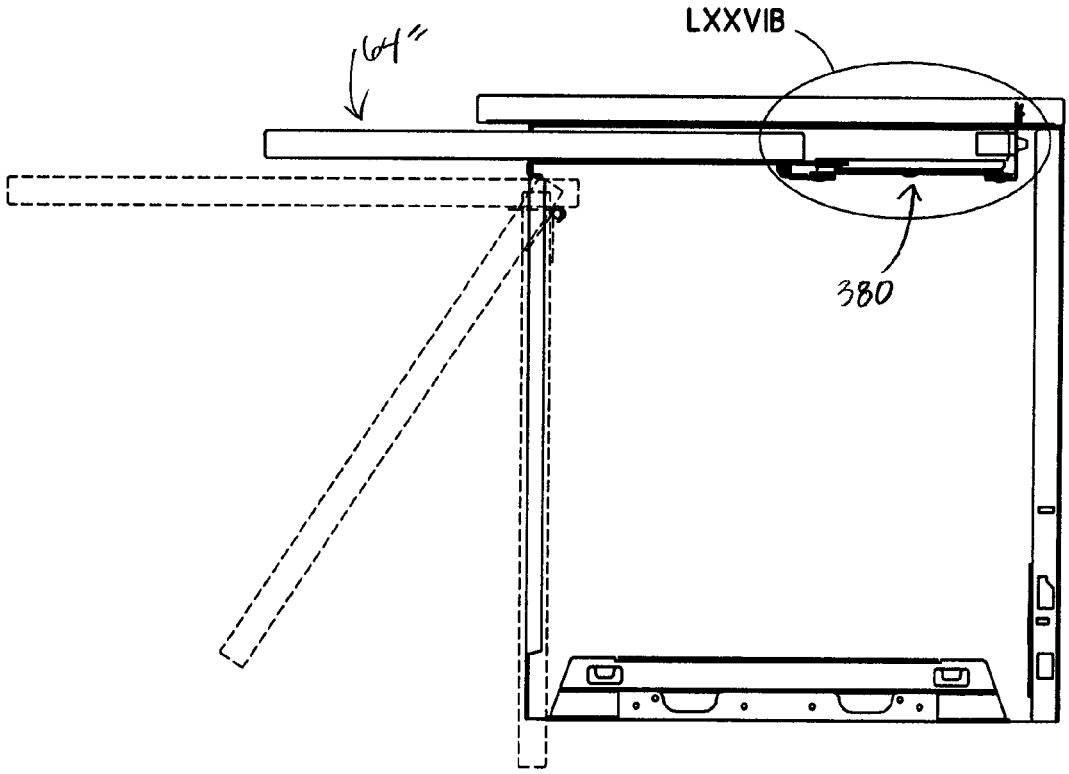
FIG. 76A is a side elevational view of the anti-racking mechanism attached.
Figure 76B:
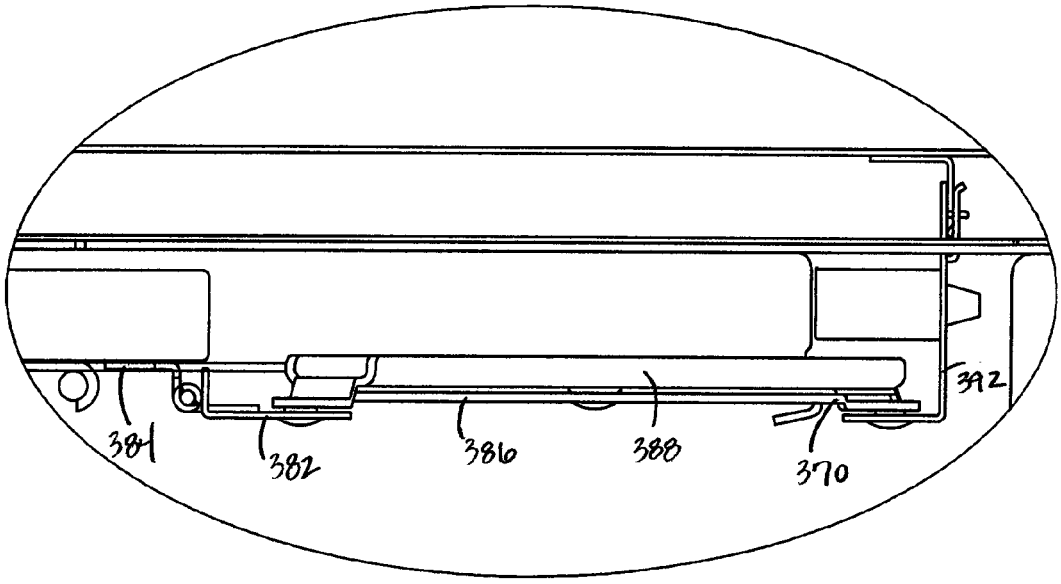
FIG. 76B is an enlarged view of section LXXVIB of FIG. 76A.
Figure 77:
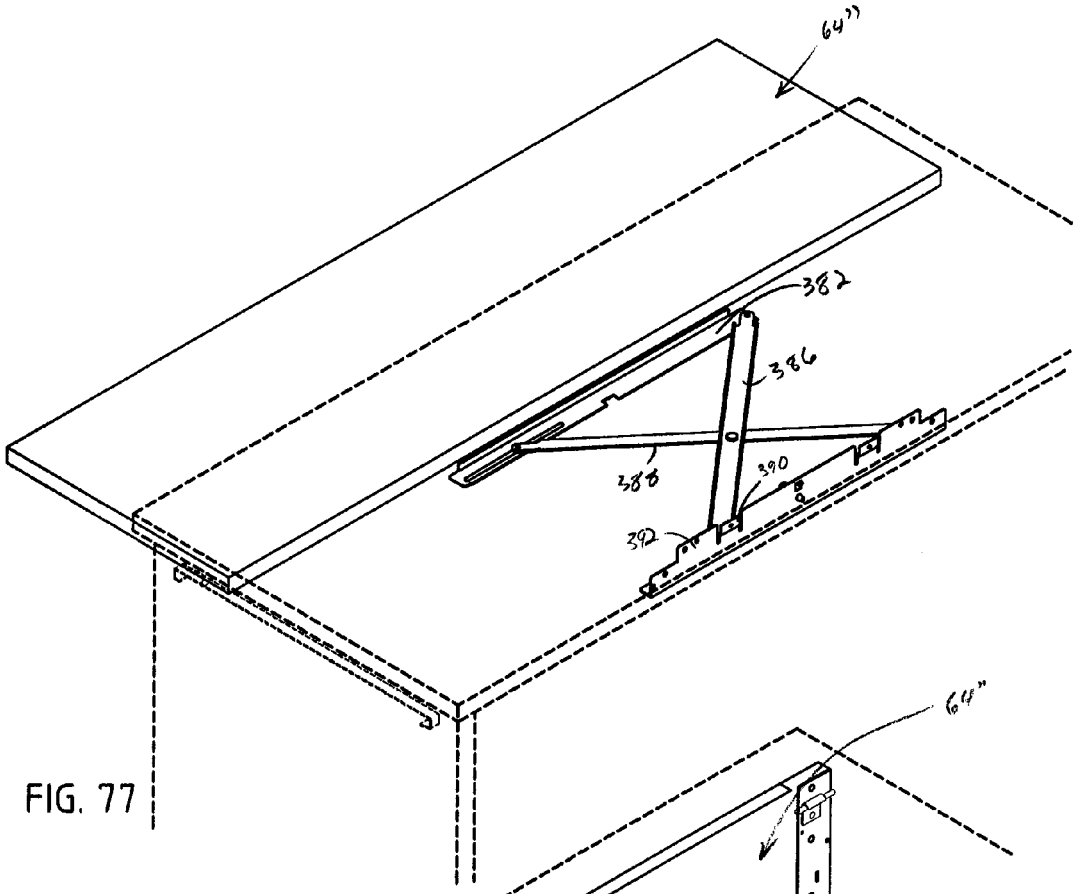
FIG. 77 is a top perspective view of the anti-racking mechanism between fully open and fully closed positions.
Figure 78:
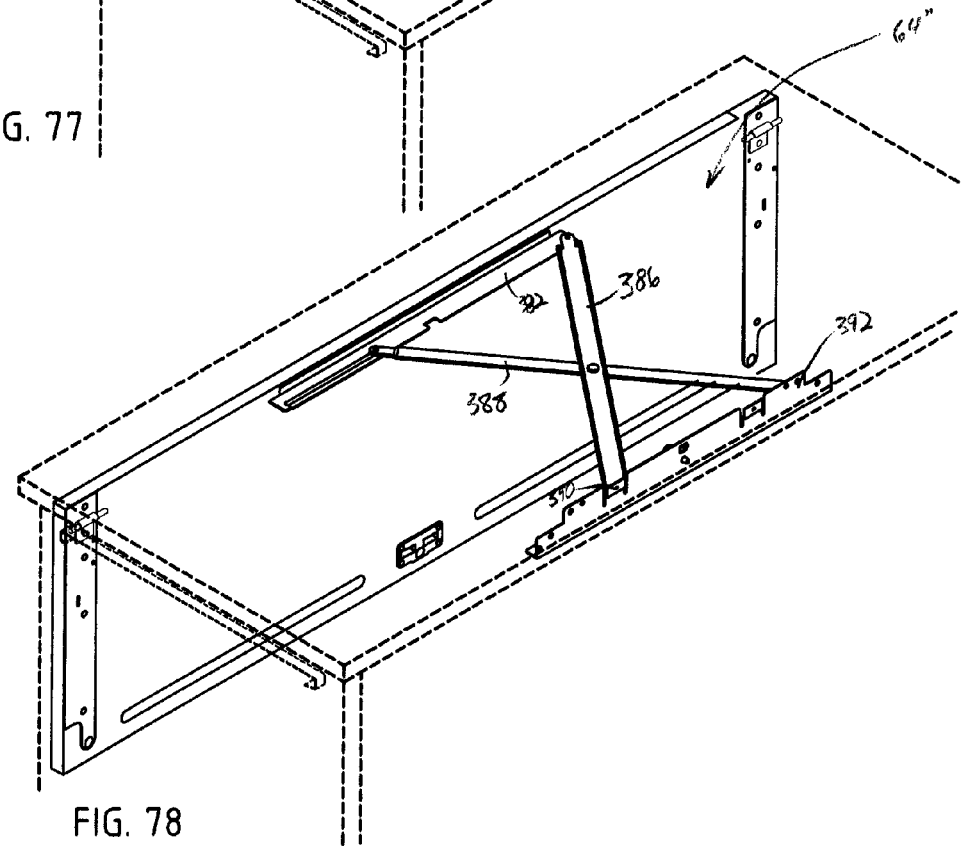
FIG. 78 is a top perspective view of the anti-racking mechanism in the fully closed position.
Figure 79:
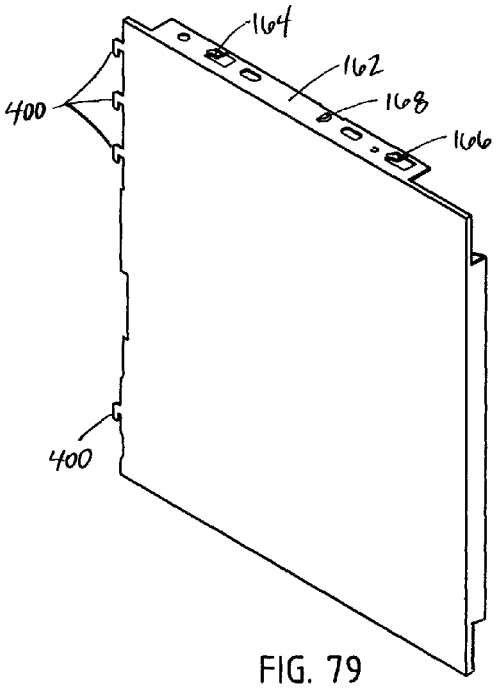
FIG. 79 is a top perspective view of an integral end panel of the instant invention.
Figure 80:
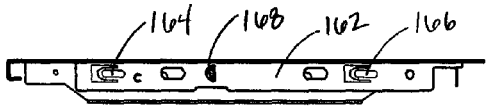
FIG. 80 is a top elevational view of the integral end panel of FIG. 79.
Figure 81:
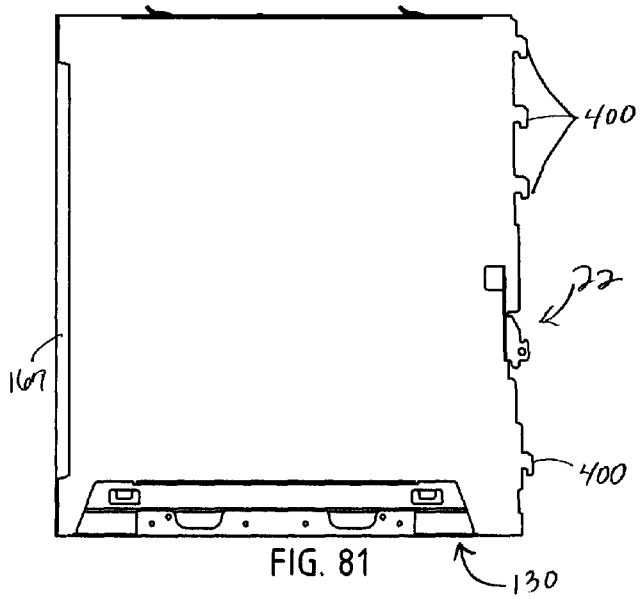
FIG. 81 is a first side elevational view of the integral end panel of FIG. 79.
Figure 82:
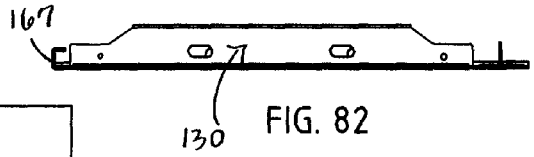
FIG. 82 is a bottom elevational view of the integral end panel of FIG. 79.
Figure 83:
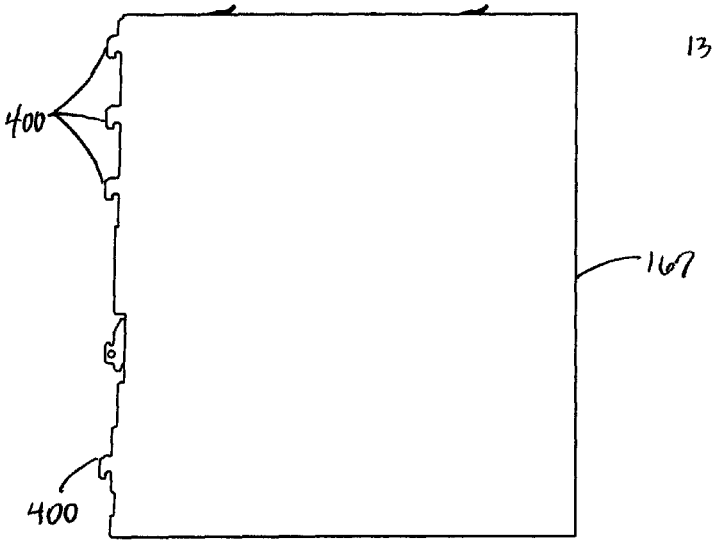
FIG. 83 is a second side elevational view of the integral end panel of FIG. 79.

As shown in FIGS. 74A and 74B, to install anti-racking mechanism 380 the hinges are first fastened to the in-the-case door 64". Rear bracket 390 is then lined up with quick connect bracket 392 such that tab receiving apertures 397A and 397B are aligned vertically with protuberances 394A and 394B (FIG. 74A). The rear bracket 390 is then lifted vertically. The center tab 395 engages and laterally aligns with the slot 396 while the rear bracket is lifted vertically until the protuberances 394A and 394B snappingly engage the receiving apertures 397A and 397B, holding rear bracket 390 in place. To remove rear bracket 390 from quick connect bracket 392, a prying tool, such as a screwdriver is used to separate the protuberances 394A, 394B from the receiving apertures 397A and 397B and the rear bracket is lowered out of position. Quick connect bracket 392 can be installed without the use of fasteners, allowing for easy and fast installation of the anti-racking mechanism 380. The hinges 384 attached to the front bracket 382 of the anti-racking mechanism 380 allow door 64" to open and close while the anti-racking mechanism 380 maintains a substantially horizontal alignment, as shown in FIGS. 77 and 78. A bumper 399 may also be included which prevents the anti-racking mechanism and door from being slammed shut by a user.

Figure 84:
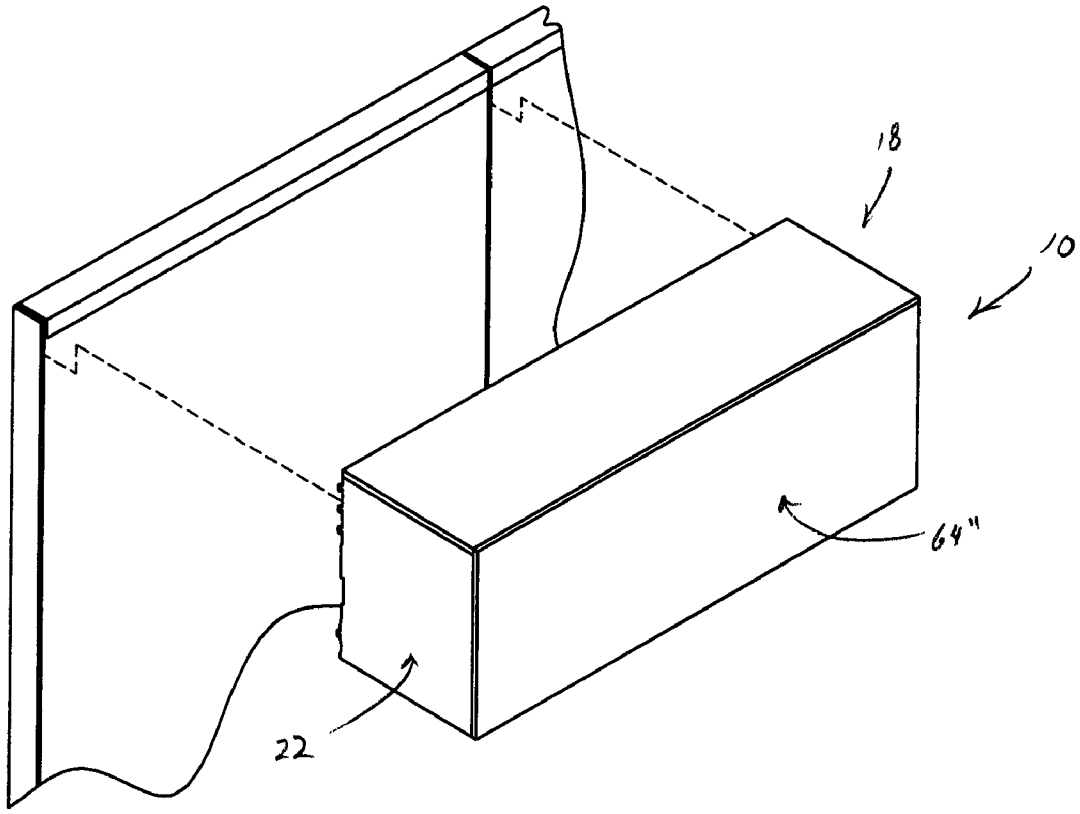
FIG. 84 is a top perspective view of a storage unit assembly with integral end panels prior to installation.
Figure 85:
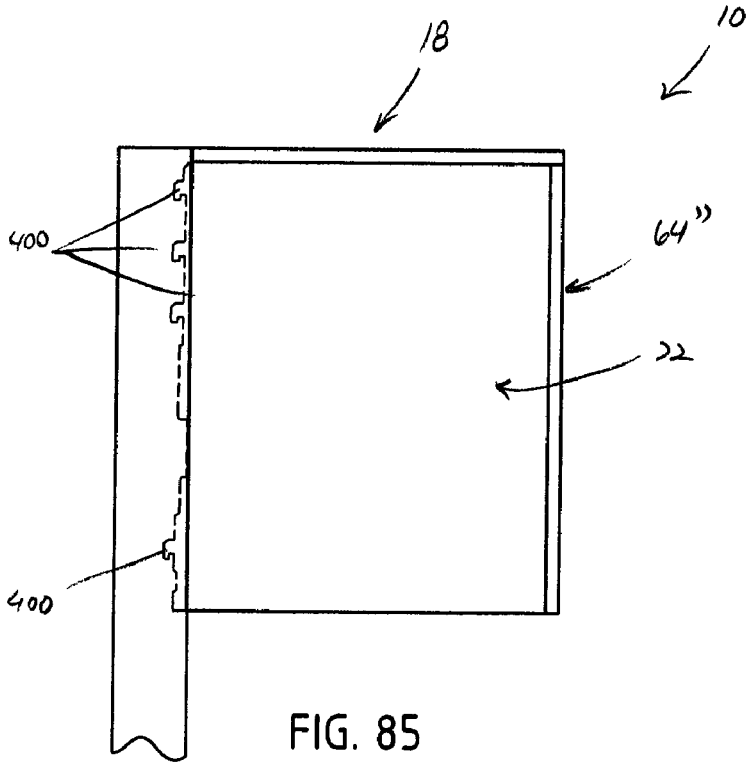
FIG. 85 is a side elevational view of a storage unit assembly with integral end panels after installation.
Figure 86:
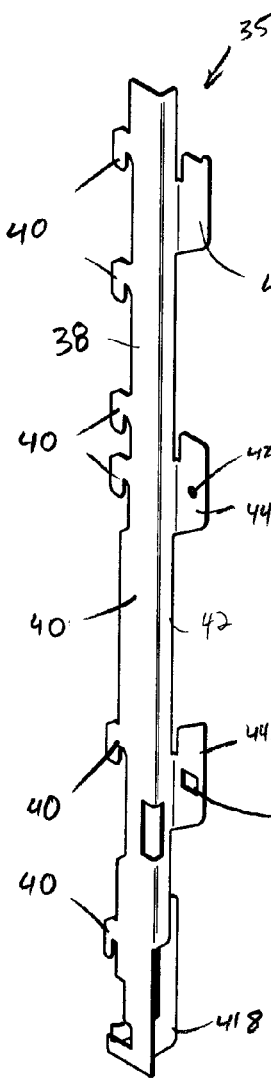
FIG. 86 is a top perspective view of an on-module hanger bracket of the instant invention.
Figure 87:
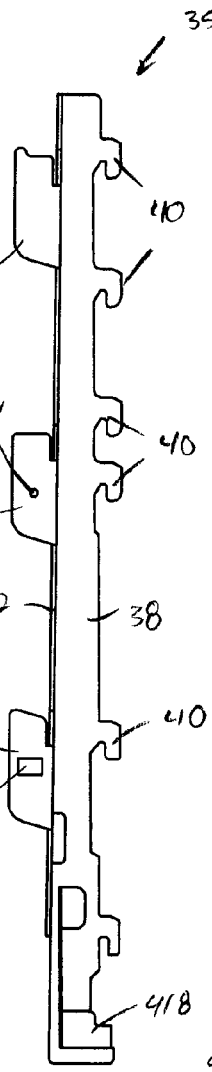
FIG. 87 is a first side elevational view of the on-module hanger bracket of FIG. 86.
Figure 89:
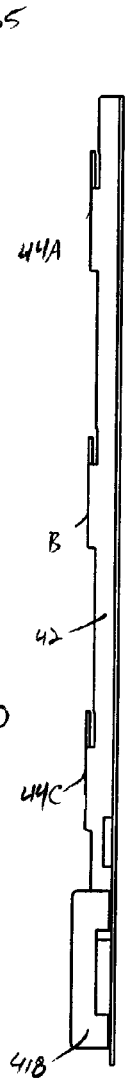
FIG. 89 is a rear elevational view of the on-module hanger bracket of FIG. 86.
Figure 90:
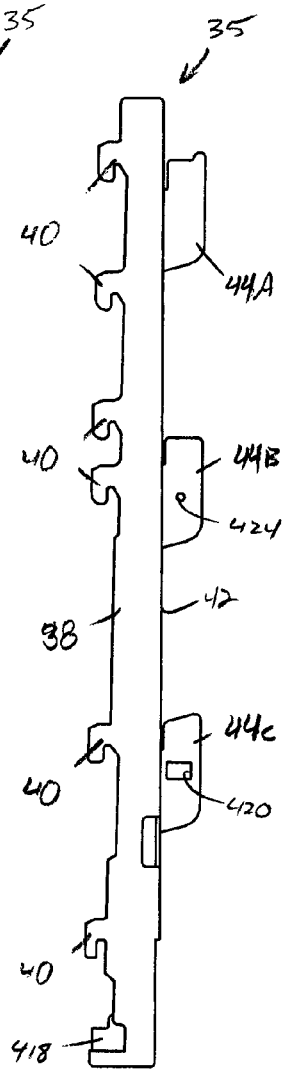
FIG. 90 is a second side elevational view of the on-module hanger bracket of FIG. 86.
Figure 91:
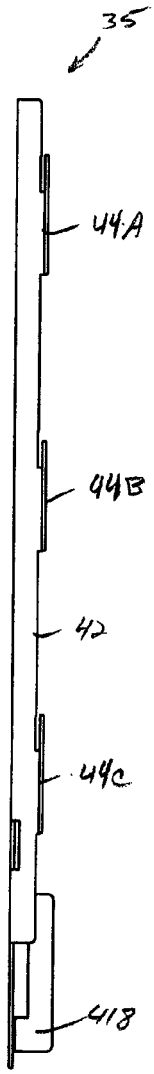
FIG. 91 is a front elevational view of the on-module hanger bracket of FIG. 86.
Figure 88:
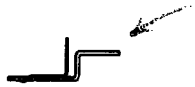
FIG. 88 is a top elevational view of the on-module hanger bracket of FIG. 86.

Referring now to FIGS. 79-83, end panel 22 (and also end panel 24) may include integral hooks 400 instead of or in addition to the slots 34 located at a rear portion 32 of first and second end panels 22, 24. As shown in FIGS. 84 and 85, when attached to top and bottom panels 18, 20, back stop rail 62 and bottom panel 20, the end panels 22, 24 act to support case 26 in a panel-hung condition.

As shown in FIGS. 86-134, storage unit 10 may be installed on a panel or desk system in a variety of ways, as disclosed in further detail below and as disclosed in U.S. Provisional Application Ser. No. 60/940,879, filed May 30, 2007, entitled STORAGE UNIT ATTACHMENT ARRANGEMENT AND METHODS, which is hereby incorporated by reference.

Referring now to FIGS. 86-91, for end panels 22, 24 having multiple slots 34 in the rear portion 32 of end panels 22, 24, hanger brackets 35, 36 are used to suspend case 26 in a panel hung condition. The first and second hanger brackets 35, 36 are mirror images of one another and have like components. The first hooks, or wall-side hooks 40 of the hanger bracket extend from a rear portion of the hanger bracket 35 and are shaped for reception in the slotted hangers 16 in an office furniture unit 12. Second hooks, or case-side hooks 44A, 44B, 44C (collectively referred to as 44) are shaped for reception in the slots 34 in the rear portions 32 of the first and second end panels 22, 24 and support the case 26 when installed in the panel-hung condition against the outer face 46 of office furniture unit 12. Hanger brackets 35, 36 may include an anti-dislodgement clip 418 designed to engage a slotted hanger 16 in office furniture unit 12 and prevent the hanger brackets 35, 36 as well as case 26 from being accidentally removed. It should be understood that any number or configuration of first hooks 40 may be present on the hanger brackets 35, 36 so that the hanger brackets 35, 36 can interface properly with the relevant slotted hanger in the associated furniture unit 12. The lowermost case-side hook 44C includes an anti-dislodgement aperture 420 for receiving an anti-dislodgement clip 422, as will be discussed in greater detail below. Also, the middle case-side hook 44B includes an anti-dislodgement aperture 424 for receiving an anti-dislodgement pin 426 (FIGS. 98 and 105) in a vertical off-module arrangement.

Figure 92:
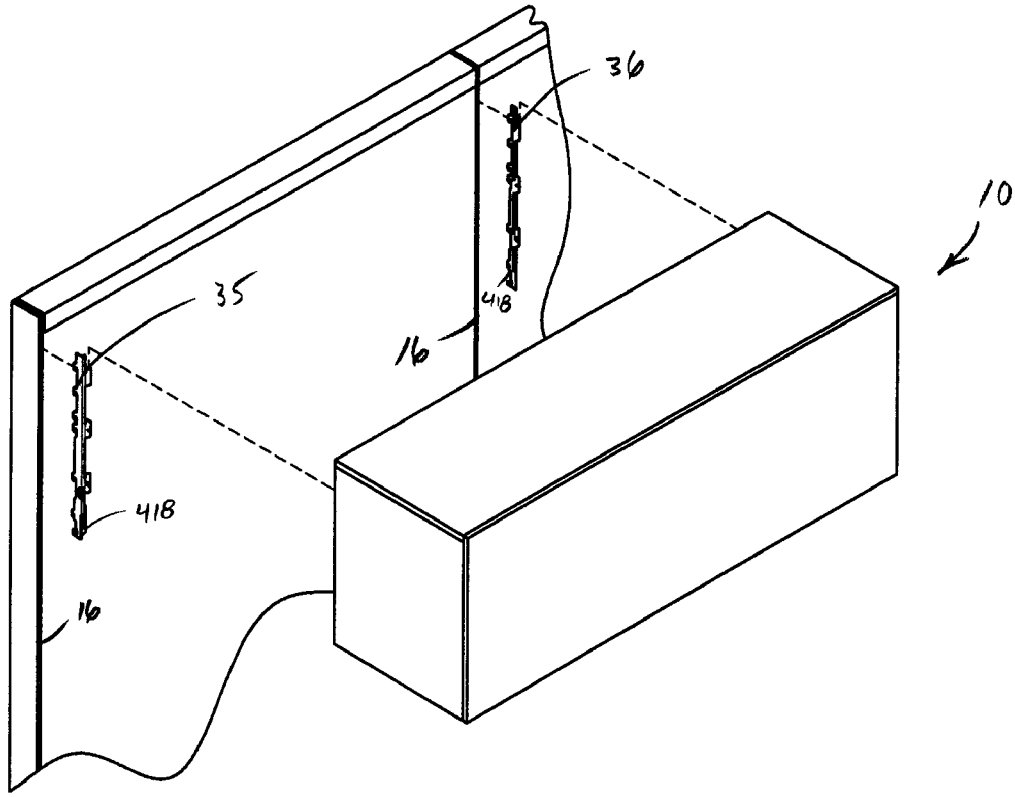
FIG. 92 is a top perspective view of a storage unit assembly of the instant invention prior to being installed in a panel-hung condition with hanger brackets.
Figure 93:
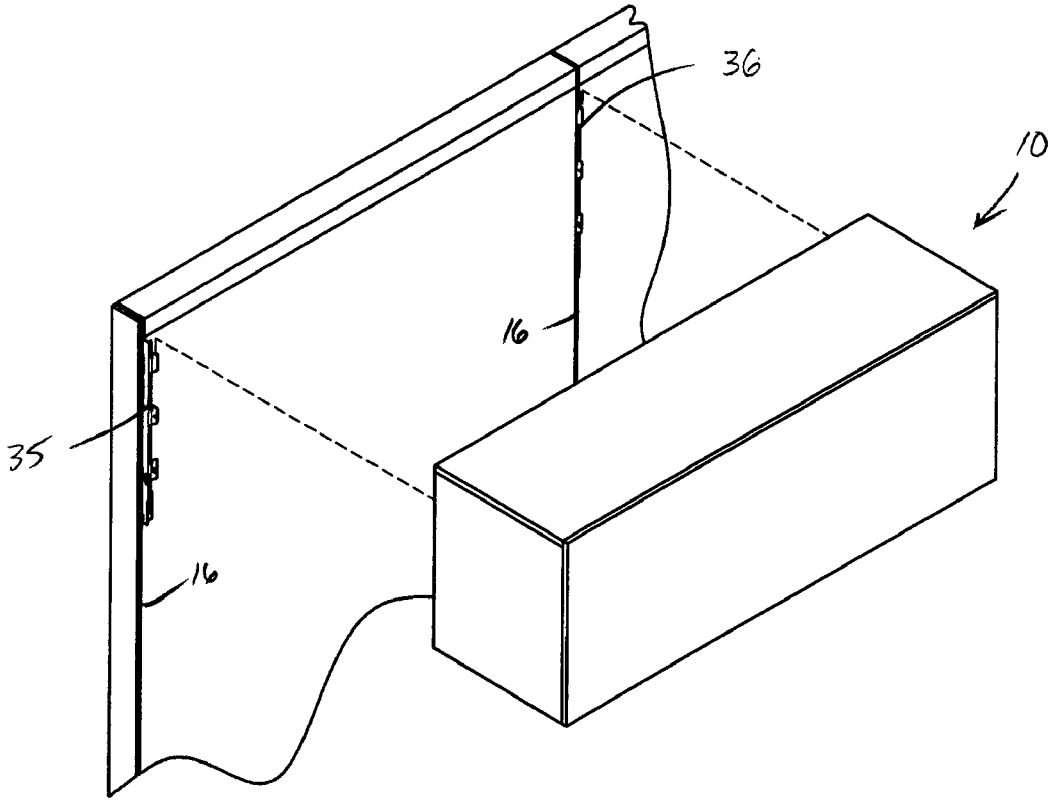
FIG. 93 is a top perspective view of a storage unit assembly of the instant invention prior to being installed in a panel-hung condition with hanger brackets installed.
Figure 94:
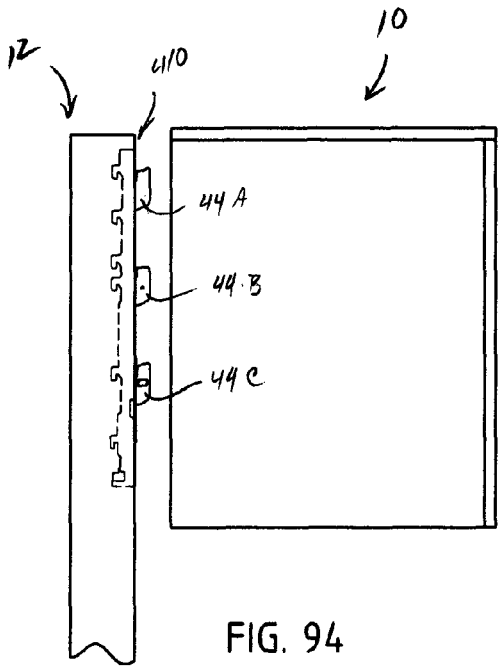
FIG. 94 is a side elevational view of a storage unit assembly of the instant invention prior to being installed in a panel-hung condition with hanger brackets installed.
Figure 95:
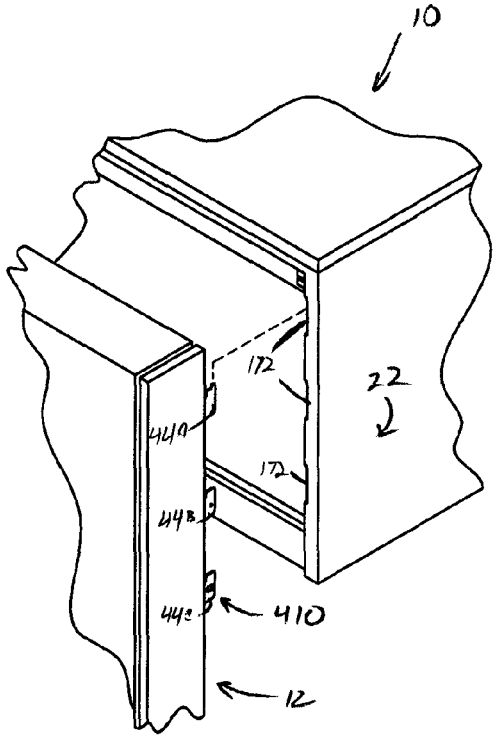
FIG. 95 is a partial rear perspective view of a storage unit assembly of the instant invention prior to being panel-hung with hanger brackets.
Figure 96:
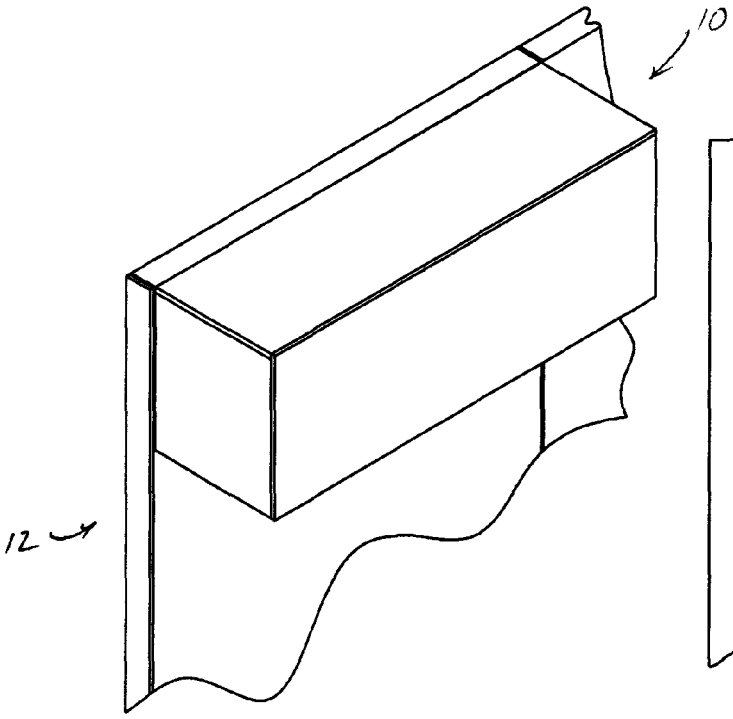
FIG. 96 is a top perspective view of a storage unit assembly in an on-module panel-hung condition.
Figure 97A:
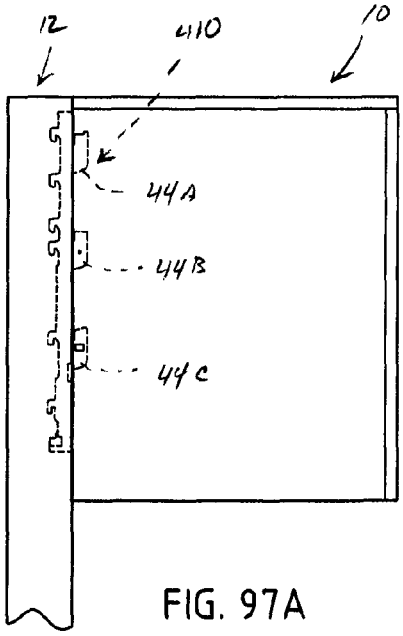
FIG. 97A is a side elevational view of the storage unit assembly in an on-module panel-hung condition.

Referring now to FIG. 92, during installation of storage unit assembly 10 to office furniture unit 12, first and second hanger brackets 35 and 36 are first inserted into the slotted hangers 16 in office furniture unit 12. If an anti-dislodgement clip 418 is present, the same is properly inserted into a slotted hanger 16 to prevent dislodgement of the hanger bracket 35 after installation. After the hanger brackets 35 and 36 have been installed, the storage unit 10 is lined up vertically and horizontally (FIGS. 94 and 95) so that the case-side hooks 44A, 44B, 44C are directly behind the slots 34 in the first and second end panels 22, 24. First and second end panels 22, 24 are then inserted onto the case-side hooks 44A, 44B, 44C and storage unit assembly 10 is allowed to lower onto the hooks 44A, 44B, 44C (FIGS. 96 and 97A).

Figure 97B:
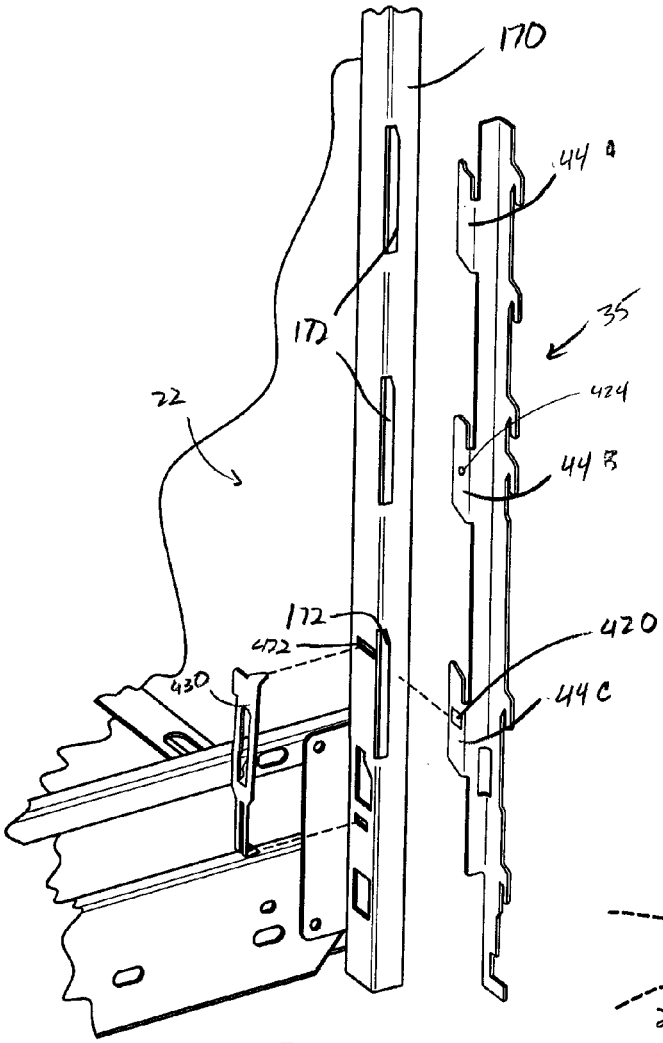
FIG. 97B is a rear exploded perspective view of an end panel; hanger bracket; and anti-dislodgement clip.
Figure 97C:
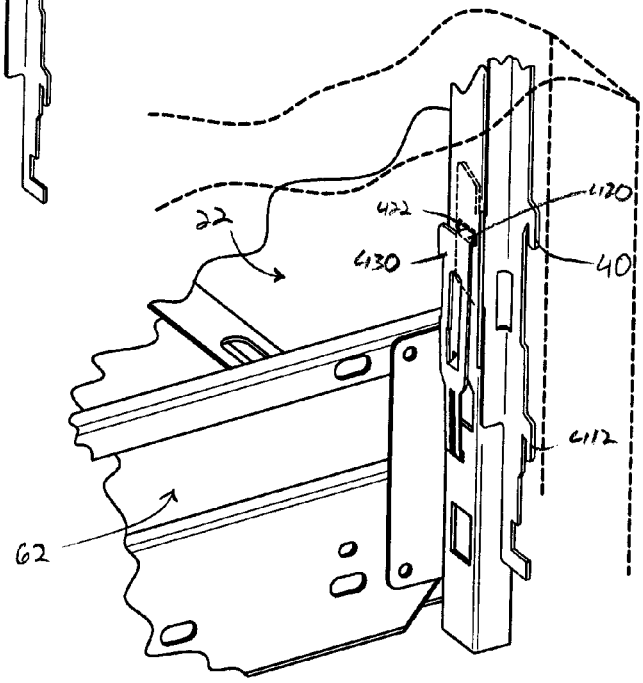
FIG. 97C is a rear perspective view of an end panel engaged with a hanger bracket and anti-dislodgement clip.
Figure 98:
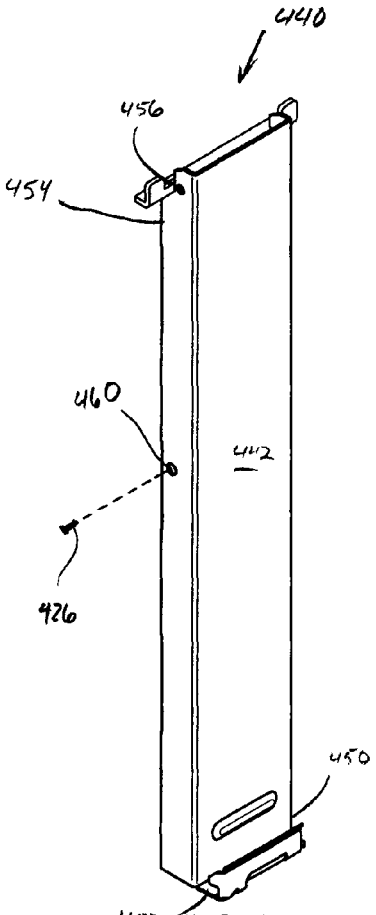
FIG. 98 is a top perspective view of an off-module support bracket of the present invention.
Figure 100:
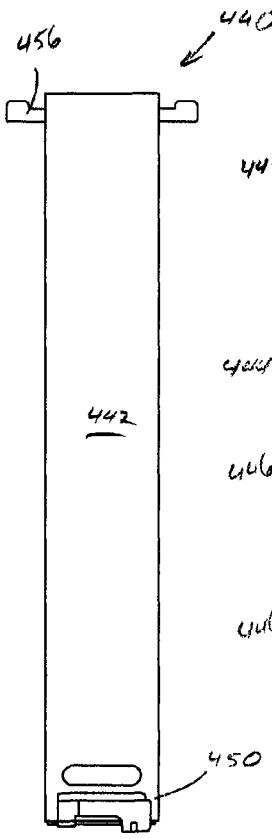
FIG. 100 is a front elevational view of the off-module support bracket of FIG. 98.
Figure 101:
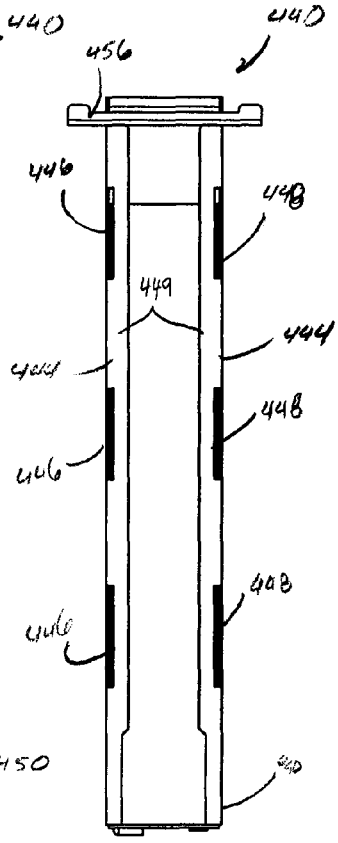
FIG. 101 is a rear elevational view of the off-module support bracket of FIG. 98.
Figure 103:
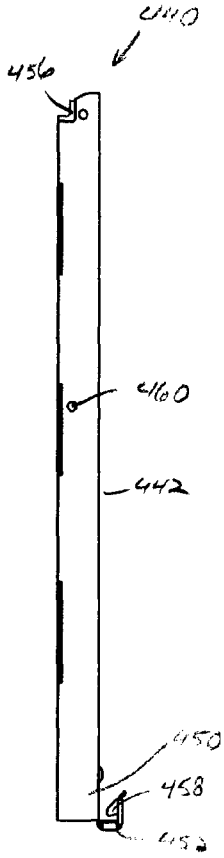
FIG. 103 is a side elevational view of the off-module support bracket of FIG. 98.
Figure 99:
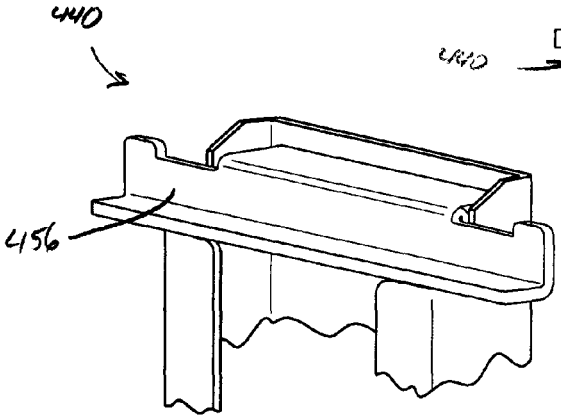
FIG. 99 is an enlarged partial perspective view of a top portion of the off-module support bracket of FIG. 98.
Figure 102:
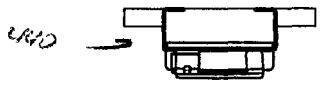
FIG. 102 is a bottom elevational view of the off-module support bracket of FIG. 98.
Figure 104:
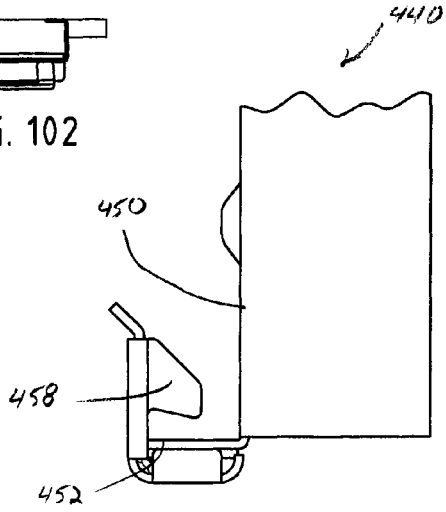
FIG. 104 is an enlarged partial side elevational view of the bottom portion of the off-module support bracket of FIG. 98.

Referring now to FIGS. 97B and 97C, the anti-dislodgement clips 430 on end panels 22, 24 are designed to engage anti-dislodgement aperture 420 of hanger brackets 35, 36 through an aperture 422 in the rear portion 32 of the end panel 22. During installation, the anti-dislodgement clips 430 are simply pulled back against the spring force of the clip 430 and allowed to spring back into aperture 422 and consequently anti-dislodgement aperture 420 when case-side hook 44C of hanger bracket 35 has been fully inserted into bottom slot 34 in the rear portion 32 of end panel 22, as illustrated in FIG. 97C. The same is done with respect to end panel 24 and hanger bracket 36. The anti-dislodgement clips 430 prevent end panels 22, 24 from becoming accidentally dislodged from the hanger brackets 35, 36.

In many instances, a storage unit assembly 10 must be installed in an off-module arrangement. In these situations, a bracket that translates the binder bin from an on-module position to an off-module position is necessary.

FIGS. 98-104 illustrate a vertical off-module support bracket 440. The vertical off-module bracket 440 includes a substantially planar front portion 442 and a rear portion 444 that has two sets of vertically-oriented slots 446, 448 that extend through inwardly extending flanges 449. The two sets of vertically-oriented slots 446, 448 allow the vertical off-module bracket 440 to be used on either side of storage unit assembly 10. The slots 446, 448 receive the case-side hooks 44 of the first and second hanger brackets 35, 36 when storage unit assembly 10 is placed in a vertical off-module panel-hung condition. A forward bottom portion 450 includes a lower support ledge 452 adapted to support the base flange of back stop rail 62 when storage unit assembly 10 is placed in a vertical off-module panel hung condition (FIG. 107B). A forward top portion 454 of the vertical off-module support bracket 440 includes a forward top ledge 456 adapted to provide lateral support to storage unit assembly 10 to prevent the same from rotating off of the lower support ledge 452. A fastener aperture 457 is located in forward top portion 454 on each side of vertical off module bracket 440. Case 26 is hung on the vertical off-module support bracket 440 in a manner which permits case 26 to shift laterally relative to first and second hanger brackets 35, 36. An anti-dislodgement clip 458 is mounted on the forward bottom portion 450 of the vertical off-module support bracket 440 and prevents accidental dislodgement of back stop rail 62 from the lower support ledge 452. Further, an anti-dislodgment aperture 460 in the vertical off-module bracket 440 is designed to receive a pin that also penetrates the anti-dislodgement aperture 424 in the hanger bracket 35, thus preventing the vertical off-module support bracket 440 from being disengaged from the hanger bracket 35.

Figure 105:
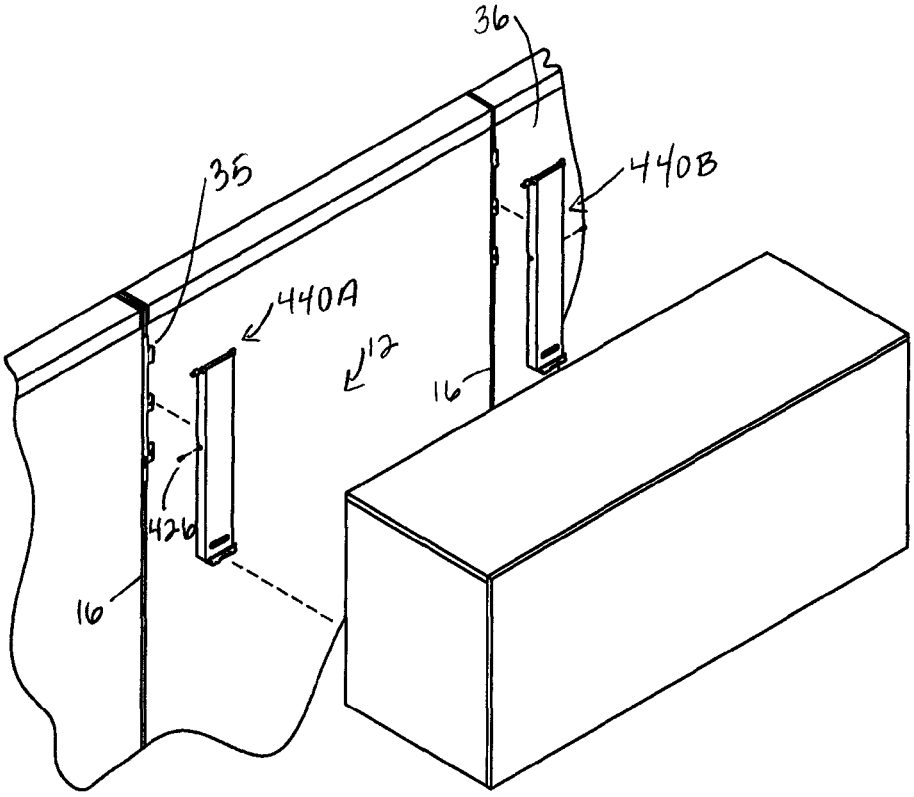
FIG. 105 is a top perspective view of a storage unit assembly of the instant invention prior to being panel hung in a vertical off-module condition.
Figure 106:
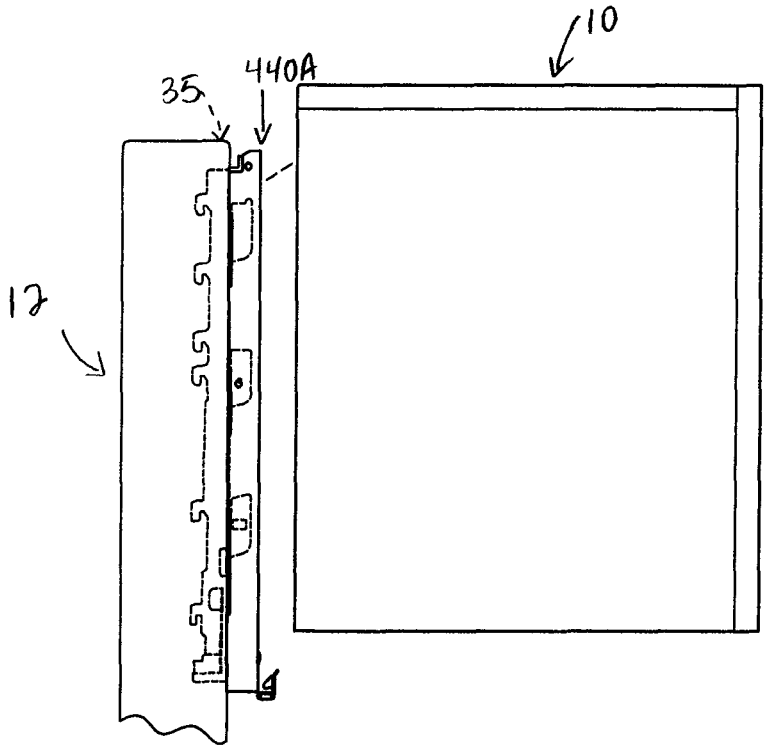
FIG. 106 is a side elevational view of a storage unit assembly prior to being panel hung in a vertical off-module condition.

Referring now to FIGS. 105-107, during installation of storage unit assembly 10 into a vertical off-module condition, first and second hanger brackets 35, 36 are inserted into the slotted hangers 16 in office furniture unit 12. One of the sets of vertically-oriented slots 446, 448 in the rear portion 444 of first and second vertical off-module brackets 440A and 440B are lined up and inserted over the case-side hooks 44A, 44B, 44C of the hanger brackets 35, 36, respectively. The vertical off-module brackets 440A and 440B are allowed to hang from the hanger brackets 35 and 36 and storage unit assembly 10 is rested on the lower support ledge 452 of each vertical off-module bracket 440A, 440B. As the base flange 112 of back stop rail 62 comes to rest against the lower support ledge 452, the forward top ledge 456 abuts the inwardly extending rear flange 198 of the top panel 18. The anti-dislodgement clip 458 of each vertical off-module bracket 440A, 440B snaps over the base flange 112 of back stop rail 62 as storage unit assembly 10 is lowered into place, as shown in FIG. 107B.

FIGS. 108-112 illustrate a top bracket 470 of a horizontal off-module support bracket system 472. The top bracket 470 includes a rear portion 474 with horizontal hooks 476 shaped for reception in horizontal slotted hangers 16 on an associated office furniture unit. A forward top portion 478 has upwardly extending flanges 480 that selectively engage the rear flanges 449 of the vertical off-module support bracket 440. Upwardly extending flanges 480 include fastener apertures that, after installation, align with fastener apertures 457 of vertical off-module bracket 440. The top bracket 470 also includes an anti-dislodgement clip 482.

FIGS. 113-118 show a bottom bracket 490 of the horizontal off-module support bracket system 472. The bottom bracket 490 has side portions 491A and 491B, a rear portion 492 with two small horizontal hooks 494A and a large horizontal hook 494B shaped for reception in horizontal slotted hangers 16 in office furniture unit 12. A forward portion 496 of the bottom bracket 490 includes vertical hooks 498 that can be selectively received in the lowermost of slots 446, 448 in the rear portion 444 of the vertical off-module bracket 440 to detachably support storage unit assembly 10 in a panel-hung condition against the outer face of office furniture unit 12. As shown in FIG. 120A, an anti-dislodgement feature 499 includes a spring joint 500 that connects the side portions 491A and 491B which are spring biased away from one another. Anti-dislodgement feature 499 prevents bottom bracket 490 from being dislodged from the horizontal slotted hangers 16 accidentally, as will be explained in further detail below.

Referring to FIGS. 119-126, during installation, the horizontal off-module bracket system 472, including the top and bottom brackets 470, 490, are first inserted into horizontal slotted hangers 16 in office furniture unit 12 with the top bracket 470 in position directly above bottom bracket 490. Large horizontal hook 494B is first inserted into one of the horizontal slotted hangers and side portions 491A and 491B are pushed toward one another to allow small horizontal hooks 494A to engage slots in slotted hanger 16. Bottom bracket 490 is then rotated laterally until small horizontal hooks 494A are received in adjacent slots in horizontal slotted hanger 16. Large horizontal hook 494B fills an entire slot, while small horizontal hooks 494A do not.

Referring again to FIGS. 119-126, the vertical off-module support bracket 440 is then inserted into the top bracket 470 with the inwardly extending rear flanges 449 sliding behind the upwardly extending flanges 480 of the top bracket 470 of the horizontal off-module bracket system 472, as shown in FIG. 123. The middle and lowermost of the slots 446, 448 of the vertical off-module brackets 440 are then aligned with the vertical hooks 498 of the bottom bracket 490 and inserted thereon. After vertical off-module support bracket 440 is inserted onto bottom bracket 490, bottom bracket 490 cannot be separated from horizontal slotted hanger 16. The vertical off-module bracket 440 prevents spreading of the side portions 491A and 491B from one another and consequently, bottom bracket cannot be removed from slotted hanger 16 while vertical off-module bracket 440 is connected therewith. A mechanical fastener may be secured through an aperture to secure top bracket 470 to vertical off-module bracket 440.

As shown in FIGS. 125 and 126, storage unit assembly 10 is now ready to be installed on the vertical off-module bracket 440 similarly to the manner of installation disclosed with respect to FIGS. 105-107 above.

Alternatively, storage unit assembly 10 may be installed in an up-mounted condition. To install storage unit assembly 10 in an up-mounted condition, up-mount brackets are necessary. As shown in FIGS. 127-130, up-mount bracket 48 has a lower portion 502 shaped for connection with an associated one of office furniture unit 12, and an upper portion 504 adapted to connect with and support the connector brackets at the bottom of case 26 to detachably mount case 26 in an up-mounted condition above the top of a furniture unit. The lower portion of up-mount bracket 48 includes a triangular shape with a lower arcuate flange 506 and a hook portion 508. The hook portion 508 includes a plurality of hooks 510 adapted to engage slotted hangers 16 in office furniture unit 12. The lower arcuate flange 506 can be used to route electrical/communication wires and the arcuate construction minimizes the likelihood of injury to a user that may accidentally contact up-mount bracket 48. The upper portion 504 includes a top horizontal support flange 509 and a top vertical support flange 512. An anti-dislodgement clip 514 may be present on the hook portion 508 to prevent up-mount bracket 48 from being accidentally dislodged.

To install storage unit assembly 10, the hook portion 508 of two up-mount brackets 48 is first installed into the slotted hangers 16 in office furniture unit 12. Connector brackets 98, described above with reference to FIGS. 15-19, of storage unit assembly 10 are then placed on the horizontal support flanges 509 of the up-mount brackets 48 and fastened thereto as shown in FIGS. 133A and 134. Alternatively, storage unit assembly 10 may be installed in an up-mounted condition on a desk/service module assembly 511 as shown in FIG. 133B.

Figure 1:
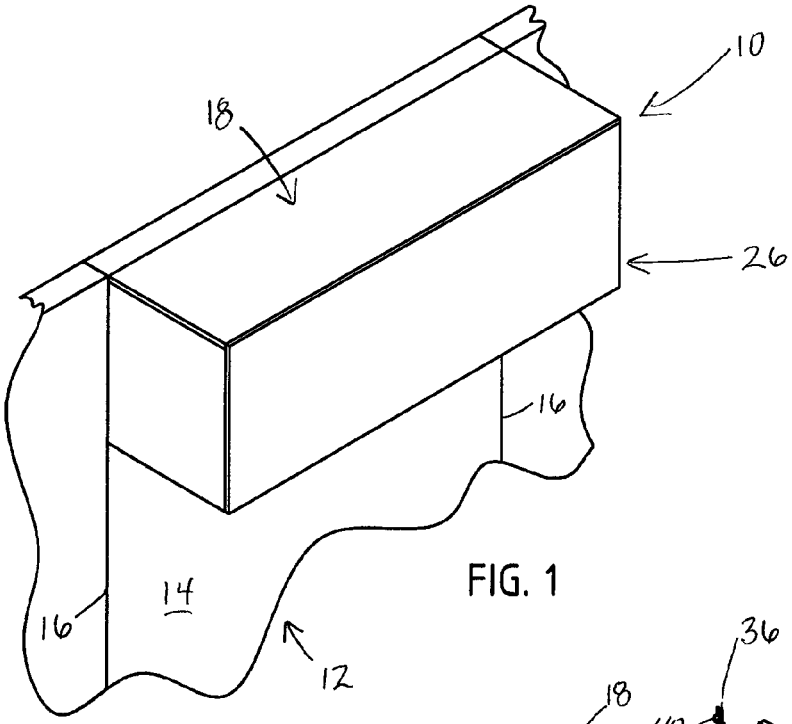
FIG. 1 is a top perspective view of one embodiment of a storage unit assembly of the present invention in a panel-hung condition.
Figure 2:
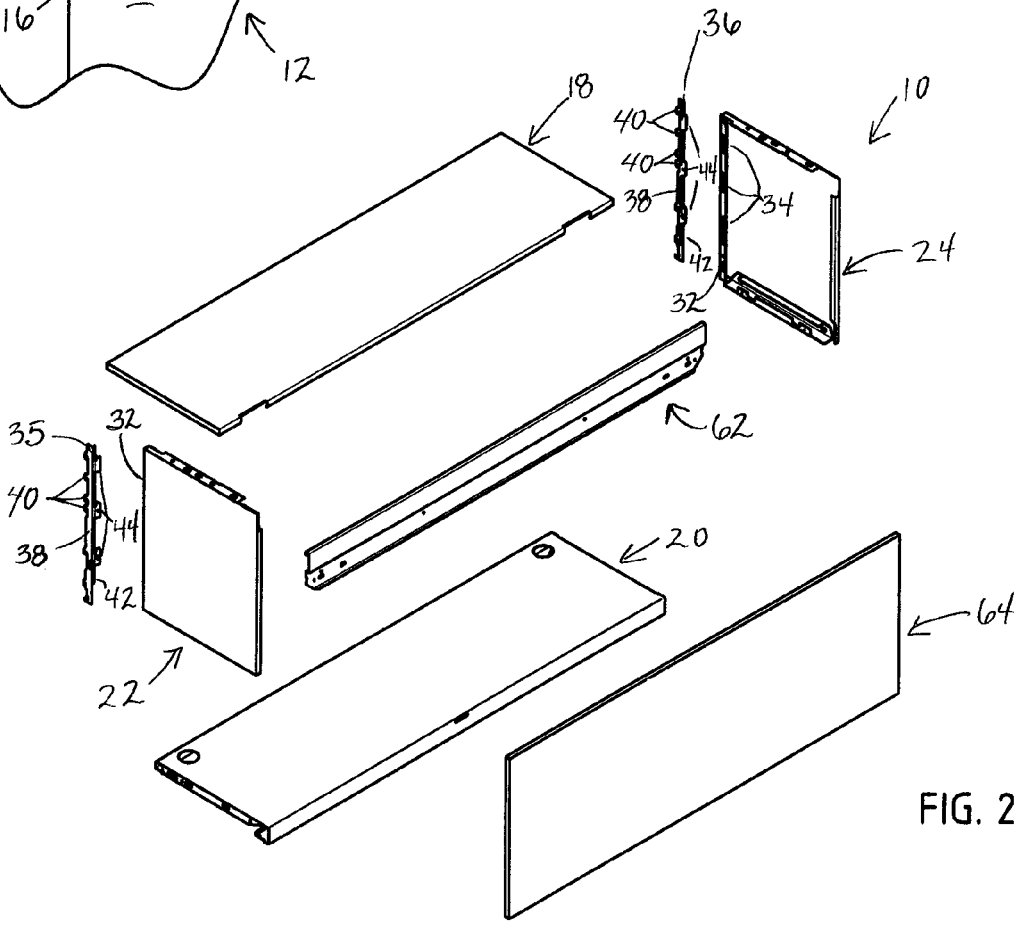
FIG. 2 is an exploded perspective view of the storage unit assembly of FIG. 1.
Figure 3:
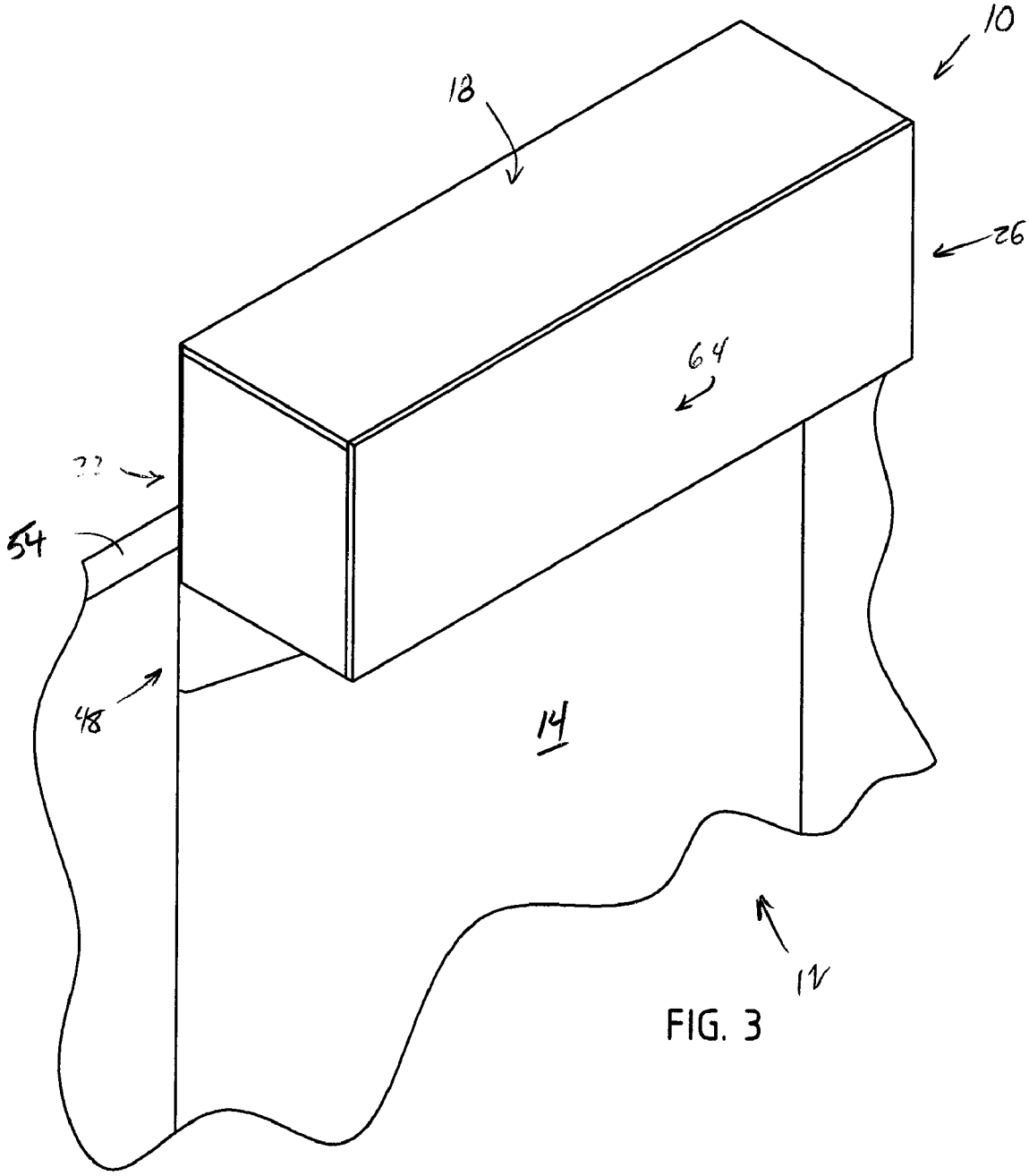
FIG. 3 is a top perspective view of a storage unit assembly in an up-mounted condition.
Figure 4:
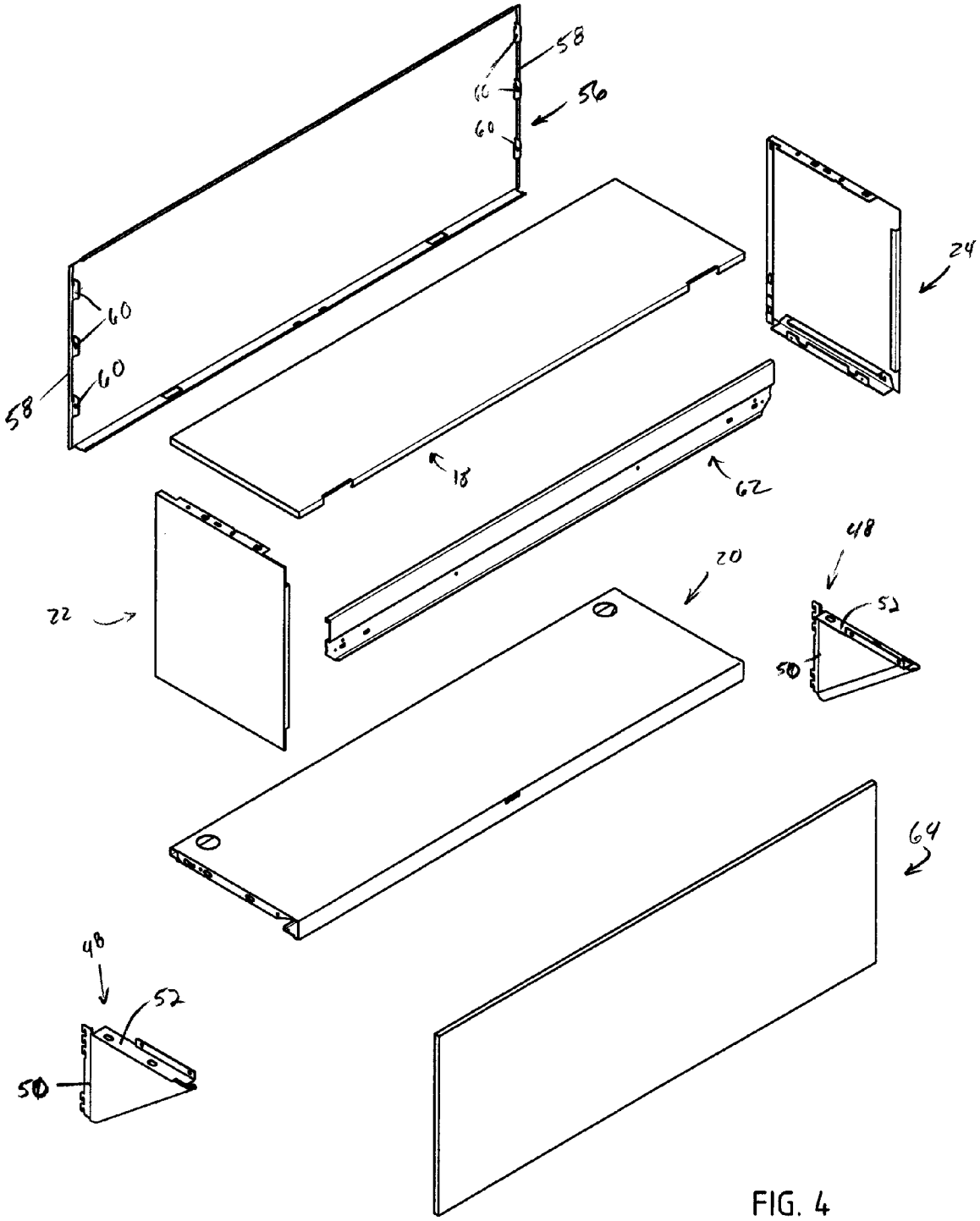
FIG. 4 is an exploded perspective view of the storage unit assembly of FIG. 3.
Figure 5:
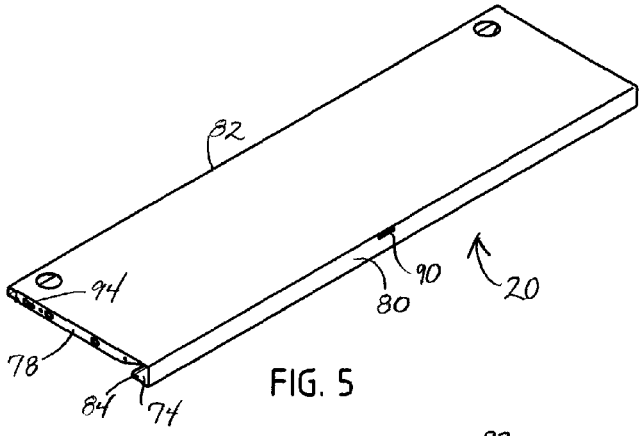
FIG. 5 is a top perspective view of a bottom panel of the instant invention.
Figure 6:
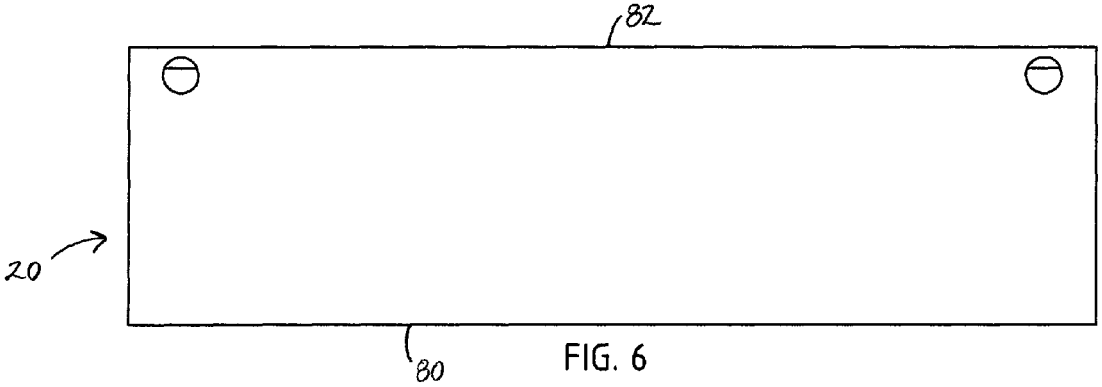
FIG. 6 is a top elevational view of the bottom panel of FIG. 5.
Figure 7:
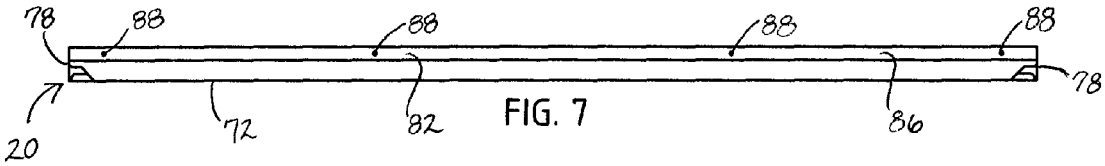
FIG. 7 is a rear elevational view of the bottom panel of FIG. 5.
Figure 8:
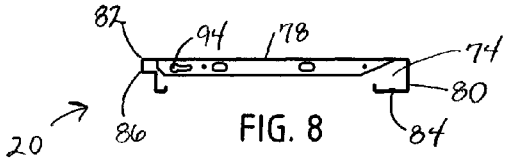
FIG. 8 is a side elevational view of the bottom panel of FIG. 5.
Figure 9:
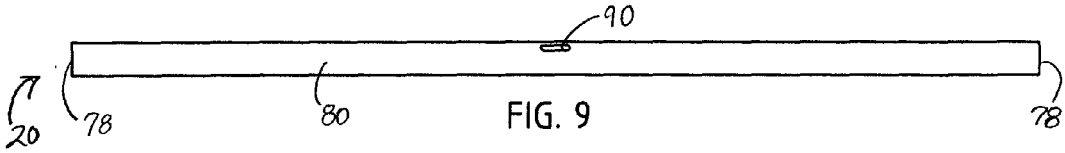
FIG. 9 is a front elevational view of the bottom panel of FIG. 5.
Figure 10:
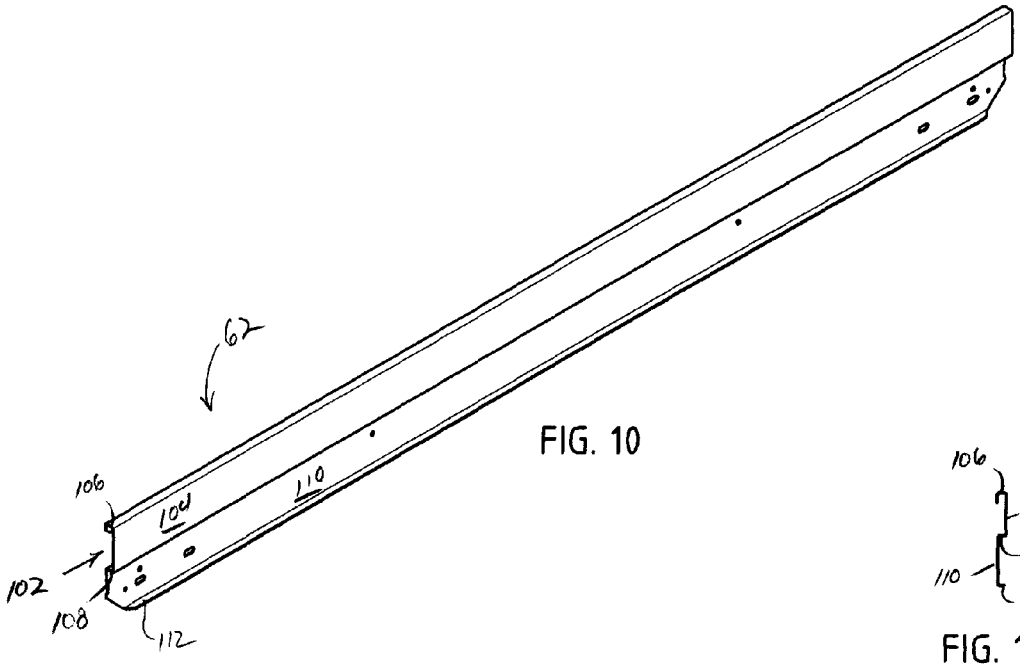
FIG. 10 is a top perspective view of a back stop rail of the instant invention.
Figure 11:
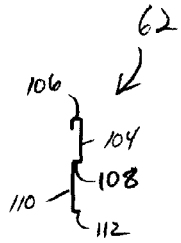
FIG. 11 is a side elevational view of the back stop rail of FIG. 10.
Figure 12:
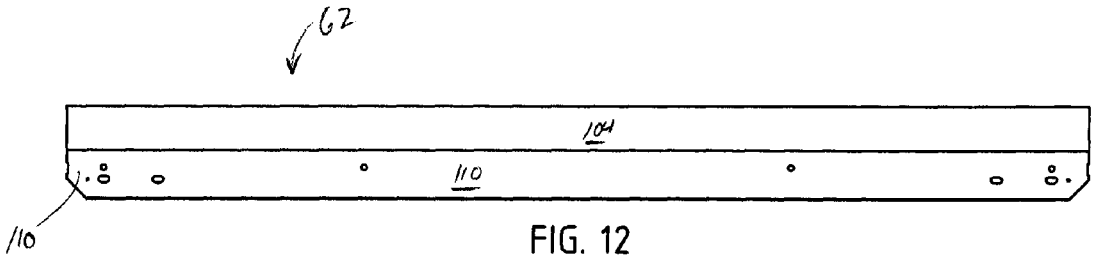
FIG. 12 is a front elevational view of the back stop rail of FIG. 10.
Figure 13:
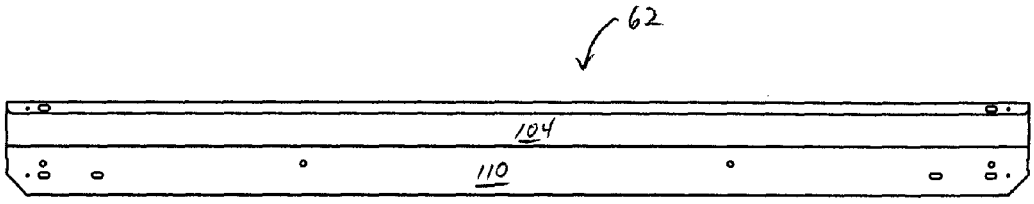
FIG. 13 is a back elevational view of the back stop rail of FIG. 10.

As shown in FIGS. 135-139, a lock assembly 520 includes a lock housing 76 with spring tabs 524 adapted to engage bottom panel socket 74 shown in FIGS. 5 and 8 and located on the underside of bottom panel 20. The lock housing 76 covers the lock assembly 520 and lock arm 92 designed to engage lock apertures 236, 238 in a door 64A, 64B, 64C, or 64D, thereby locking storage unit assembly 10 when not in use.

Referring to FIGS. 135-139, during installation, the lock housing 76 is installed beneath bottom panel 20. The lock housing 76 is inserted so that a key hole 523 extends downwardly through a lock cylinder aperture 530 (FIG. 138) that extends downwardly. During installation, the spring tabs 524 are in abutting contact with the underside of bottom panel 20. As the lock housing 76 is forced into position, spring tabs 524 flex inwardly until the lock assembly 520 projects through the lock cylinder aperture 530 that extends through socket flange 84, at which time spring tabs 524 force lock housing 76 downward and frictionally secure lock housing 76 inside the socket 74.

Referring to FIGS. 140-143, in a dual door assembly 600, a top panel 18' having four cutouts 604 for hinge mechanisms of two doors 64A', 64B', 64C', or 64D' is used. The underside of the top panel 18' includes two quick connect brackets 392 for two anti-racking mechanisms 380. In addition, to supply structural rigidity, a hat channel 606 is secured to the underside of the top panel 18'. FIG. 142 shows a dual door support 608 including multiple guide rails 360 that is used to provide guides for in-the-case constructions. Specifically, the dual door support 608 includes two guide rails 360 connected by a bracket assembly 610 that supports the guide rails 360 adjacent to the underside of top panel 18'. FIG. 143 illustrates the dual door assembly 600 which is similar to the single door construction except it includes two doors 64 and the dual door support 608 as well as the modified top panel 18' with additional cutouts 604 for hinge mechanisms and reinforcing hat channel 606. Note that the cutouts 604 for the hinge mechanisms may not be present in a dual door in-the-case application.

Referring now to FIGS. 149-150, a shelf assembly 701 having no side walls and integral shelving brackets 700 may be supplied to complement the office furniture system. A shelf 703 is included and is substantially similar to the bottom panel 20 but does not include a lock aperture 90. Shelf brackets (shown in FIGS. 144-148) are included and have integral hooks 702 connected at a rearward end 704 of the shelf bracket and also include an anti-dislodgement clip 706. Shelf brackets 700 also include a connector bracket 708 that connects the shelf bracket 700 with the shelf 703. As shown in FIG. 150, the shelf assembly 701 does not include a back stop rail nor side walls.

Referring now to FIGS. 156-157, a second shelf assembly 800 having a shelf 802 with end walls 804 may be used to complement an office furniture setting. The shelf 802 engages connector brackets 807 on the end walls 804. The second shelf assembly 800 also includes a back stop rail 62 and anti-dislodgement clips 806. Back stop rail 62 engages rail brackets 808 attached to the shelf brackets 802.

Referring now to FIGS. 158-161, for a dual door assembly, a support strut 900 is supplied to add structural integrity to case 26 and may be permanently fastened to the rear of storage unit assembly 10. The support strut 900 includes a top engagement portion 902 with a top tab 903A and an abutment portion 903B, a bottom engagement portion 904, and an elongate body 906. Top tab 903A includes a horizontal extension 914, a vertical extension 916 and a horizontally extending distal end 918 that engages a strut aperture 920 (FIG. 32) in the inwardly extending rear flange 198 below top panel 18. The horizontally extending distal end of top tab 903A is inserted into the strut aperture 920 and the inwardly extending rear flange 198 rests on the abutment portion 903B. The bottom engagement portion 904 includes a flat downwardly extending flange 922 offset from the elongate body 906. A fastener aperture 924 that extends through the bottom engagement portion 904 receives a mechanical fastener 928 secured in a receiving aperture 926 in back stop rail 62.

FIGS. 162-165 illustrate a support strut 940 may be used for transporting storage unit assembly 10. The support strut 940 includes a top engagement portion 942 with a cam surface 943A, and an abutment portion 943B, a bottom engagement portion 944, and an elongate body 946. Cam surface 943A is rotated into place which results in cam surface 943A being inserted into a strut aperture 920 (FIG. 32) and the inwardly extending rear flange 198 of case 26 rests on the abutment portion 943B. The bottom engagement portion 944 includes a flat downwardly extending flange 947 offset from the elongate body 946. A fastener receiver 948 having an open portion 950 receives a mechanical fastener 952 secured in a receiving aperture 956 in back stop rail 62.

A method for making a storage unit assembly for office furniture units of the type having a like construction with slotted hangers extending along outer faces thereof includes forming bottom panel 20 to abuttingly support objects thereon. Top panel 18 is formed in a shape to cover at least a portion of bottom panel 20. Top panel 18 is positioned in a generally parallel, spaced apart relationship with bottom panel 20. First and second end panels 22, 24 are formed with rear portions 32 having a plurality of vertically spaced slots 34 therein. First and second end panels 22, 24 are positioned at opposite ends of top and bottom panels 18, 20 and are interconnected to define rigid, box-shaped case 26 having generally rigid bottom portion 28 and generally open back portion 30. First and second hanger brackets 35, 36 are formed, each having rear portion 38 with first hooks 40 shaped for reception in the slotted hangers 16 of a first selected one of the office furniture units 12, and a forward portion 42 with second hooks 44 shaped for reception in the slots 34 in rear portions 32 of first and second end panels 22, 24. First hooks 40 on first and second hanger brackets 35, 36 are inserted into the slotted hangers 16 on the first selected furniture unit. Second hooks 44 on the first and second hanger brackets 35, 36 are inserted into slots 34 in rear portions 32 of first and second end panels 22, 24 to detachably support case 26 in a panel-hung condition against the outer face 14 of the first selected office furniture unit. An up-mount bracket 48 is formed with a lower portion 52 shaped for connection with a second selected one of the office furniture units, and an upper portion 54 shaped for connection with the bottom portion 28 of case 26. Lower portion 52 of the up-mount bracket 48 is mounted with the second selected furniture unit. The upper portion 54 of the up-mount bracket 48 is connected with bottom portion 28 of case 26 to detachably mount case 26 in an up-mounted condition above a top portion 54 of the second selected furniture unit. A removable back panel 56 is formed in a shape to enclose at least a portion of the open back portion 30 of case 26, and has side portions 58 with outwardly protruding hooks 60 shaped for reception in slots 34 in rear portions 32 of first and second end panels 22, 24. Hooks 60 on the back panel 56 are inserted into slots 34 in rear portions 32 of first and second end panels 22, 24 to detachably connect back panel 56 with case 26 and enclose at least that portion of the open back portion 30 of case 26 disposed above top portion 54 of the second selected office furniture unit when the case is in the up-mounted condition.

An anti-dislodgement clip 430 can be mounted on the case 26 adjacent to one of the first and second end panels 22, 24. The second hooks 44 on said first hanger bracket 35 are engaged in the panel-hung condition, and the hooks 60 on the back panel 56 are engaged in the up-mounted condition. The back stop rail 62 is formed and is configured to extend along a rearward portion of the bottom panel 20 between the first and second end panels 22, 24. The back stop rail 62 is connected with the bottom panel 20 and the first and second end panels 22, 24 to rigidify the case 26, and the back stop rail 62 is positioned to project upwardly from the bottom panel 20 to retain objects on the bottom panel 20. At least one accessory is provided and is configured to equip the interior portion of the case 26 and may be detachably connected with the back stop rail 62.

The first off-module support bracket 440 is formed having a rear portion 444 thereof with slots 446, 448 selectively receiving therein the second hooks 44 of the first and second hanger brackets 35, 36 in a vertical off-module panel-hung condition, a forward bottom portion 450 thereof abuttingly supporting thereon the bottom panel 20 of the case 26, and a forward top portion 454 thereof connected with the top panel 18 of the case 26 in a manner which permits the case 26 to shift laterally relative to the first and second hanger brackets 35, 36. The second off-module support bracket 472 is formed and includes a top bracket 470 having a rear portion 474 with horizontal hooks 476 shaped for reception in horizontal ones of the slotted hangers 16 on an associated one of the office furniture units 12, a top portion 478 with an upwardly extending flange 480 selectively engaging the top panel 18 of the case 26, a bottom bracket 490 having a rear portion 492 with horizontal hooks 494A, 494B shaped for reception in horizontal ones of the slotted hangers 16 in the associated one of the office furniture units 12, and a forward portion 496 with vertical hooks 498 selectively received in the slots 446, 448 in the rear portion 32 of the first and second end panels 22, 24 to detachably support the case 26 in a panel-hung condition against the outer face of the associated one of the office furniture units 26.

The socket 74 is formed in the bottom panel 20 along the bottom edge thereof and a lock housing 76 is formed with spring flanges 524 that frictionally engage adjacent portions of the socket 74 to securely retain the lock housing 76 in the bottom panel 20. A generally open front portion 80 in the case 26 is formed and disposed opposite the generally open back portion 30. The door 64A, 64B, 64C, 64D is operably connected with the case 26 to selectively enclose the generally open front portion 80 of the case 26. The over-the-case door support mechanism 312 is formed and the first portion the mechanism 312 is connected with the case 26 and the second portion of the mechanism 312 is connected with the door 64A, 64B, 64C, 64D to permit shifting the door 64A, 64B, 64C, 64D between the closed position over the open front portion 80 of the case 26 and an open position outside of the case 26 over the top panel 18. The in-the-case door support mechanism 361 is formed and a first portion of the mechanism 361 is connected with the case 26 and a second portion of the mechanism 361 is connected to the door 64" to permit shifting the door 64" between the closed position over the open front of the case 26 and the open position inside of the case 26 portion under the top panel 18.

The anti-racking mechanism 380 is formed and a first portion of the mechanism 380 is connected with the door 64" and a second portion of the mechanism 380 with the case 26 to alleviate binding of the door 64" when the same is shifted between the open and closed positions. A quick connect bracket 392 is formed and connects the second portion of the anti-racking mechanism 380 with the case 26.

The door dampener 370 is formed with the housing 371 pivotally attached to a top portion of the door 64" and a rod portion 372 pivotally attached to an interior portion of the case 26. A door 64" open assist 398 is provided having a longitudinally resilient construction with one end operably connected with the door 64" and the opposite end operably connected with the case 26 to assist shifting the door 64" from the closed position to the open position. A rigid reinforcing strut 900 is provided and is positioned along a medial portion of the back panel 56, and an upper end of the strut 900 is detachably connected with the top panel 18 and a lower end of the strut 900 with the bottom panel 20 to stiffen the case 26.

It is to be understood that variations and modifications can be made to the aforementioned structure without departing from the concepts of the present invention, and further it is to be understood that such concepts are intended to be covered by the following claims unless these claims by their language expressly state otherwise.

The invention claimed is:

1. A storage unit assembly for office furniture units of the type having an outer face with slotted hangers extending therealong, comprising:

a bottom panel operably positioned in a generally horizontal orientation, and shaped to abuttingly support objects thereon;

a top panel disposed above and generally parallel with said bottom panel, and shaped to cover at least a portion of said bottom panel;

first and second end panels disposed at opposite ends of said top and bottom panels and connected therewith to define a rigid, box-shaped case having a generally rigid bottom portion and a generally open back portion; said first and second end panels having rear portions with a plurality of vertically spaced apart slots disposed therein;

first and second hanger brackets each having a rear portion with first hooks shaped for reception in the slotted hangers of an associated one of the office furniture units, and a forward portion with second hooks selectively received in said slots in said rear portions of said first and second end panels to detachably support said case in a panel-hung condition against the outer face of the associated one of the office furniture units;

an up-mount bracket having a lower portion shaped for connection with an associated one of the office furniture units, and an upper portion connected with and supporting said bottom portion of said case to detachably mount said case in an up-mounted condition above a top portion of the associated one of the furniture units; and a removable back panel shaped to enclose at least a portion of said open back portion of said case, and having side portions with outwardly protruding hooks selectively received in said slots in said rear portions of said first and second end panels to detachably connect said back panel with said case and enclose at least that portion of said open back portion of said case disposed above the top portion of the associated one of the office furniture units when said case is in said up-mounted condition.

2. A storage unit assembly as set forth in claim 1, including:

an anti-dislodgement clip mounted on said case adjacent to one of said first and second end panels, and engaging said second hooks on said first hanger bracket in said panel-hung condition, and said hooks on said back panel in said up-mounted condition.

3. A storage unit assembly as set forth in claim 1, including:

a back stop rail extending along a rearward portion of said bottom panel between said first and second end panels; said back stop rail is connected with said bottom panel and said first and second end panels to rigidify said case, and projects upwardly from said bottom panel to retain objects thereon.

4. A storage unit assembly as set forth in claim 1, including:

a pair of connector brackets mounted on inside surfaces of said first and second end panels, and engaging said opposite ends of said bottom panel to rigidly interconnect said first and second end panels.

5. A storage unit assembly as set forth in claim 1, including:

a pair of clips mounted on top surfaces of said first and second end panels, and engaging said opposite ends of the top panel to interconnect said first and second end panels.

6. A storage unit assembly as set forth in claim 1, wherein:

said panel-hung condition defines an on-module panel-hung condition and includes a first off-module support bracket having a rear portion thereof with slots selectively receiving therein said second hooks of said first and second hanger brackets in a vertical off-module panel-hung condition, a forward bottom portion thereof abuttingly supporting thereon said back stop rail, and a forward top portion thereof connected with said top panel of said case in a manner which permits said case to shift laterally relative to said first and second hanger brackets.

7. A storage unit assembly as set forth in claim 6, wherein:
said panel-hung condition defines an off-module panel-hung condition and includes
a second off-module support bracket including a top bracket having a rear portion with horizontal hooks shaped for reception in horizontal ones of the slotted hangers on an associated one of the office furniture units, a top portion with an upwardly extending flange selectively engaging said first off-module support bracket, a bottom bracket having a rear portion with horizontal hooks shaped for reception in horizontal ones of the slotted hangers in the associated one of the office furniture units, and a forward portion with vertical hooks selectively received in said slots in said rear portion of said first off-module bracket to detachably support said case in a panel-hung condition against the outer face of the associated one of the office furniture units.

8. A storage unit assembly as set forth in claim 1, wherein:
said bottom panel includes a socket positioned along a bottom edge thereof; and including
a lock housing having spring flanges that frictionally engage adjacent portions of said socket to securely retain said lock housing in said bottom panel.

9. A storage unit assembly as set forth in claim 1, wherein:
said case includes a generally open front portion disposed opposite said generally open back portion; and including:
a door operably connected with said case, and shaped to selectively enclose said generally open front portion of said case.

10. A storage unit assembly as set forth in claim 9, including:
an over-the-case door support mechanism having a first portion thereof connected with said case and a second portion thereof connected with said door, and configured to permit shifting said door between a closed position over said open front portion of said case and an open position outside of said case over said top panel.

11. A storage unit assembly as set forth in claim 9, including:
an in-the-case door support mechanism having a first portion thereof connected with said case and a second portion thereof connected with said door, and configured to permit shifting said door between a closed position over said open front of said case and an open position inside of said case under said top panel.

12. A storage unit assembly as set forth in claim 9, wherein:
said door comprises one of a plurality of different door constructions, including:
at least one solid door construction;
at least one curved front door construction; and
at least one picture frame door construction.

13. A storage unit assembly as set forth in claim 1, including:
an anti-racking mechanism having a first portion thereof operably connected with said door and a second portion thereof operably connected with said case, and configured to alleviate binding of said door when the same is shifted between said open and closed positions; and
a quick connect bracket connecting said second portion of said anti-racking mechanism with said case.

14. A storage unit assembly as set forth in claim 1, including:
a door dampener having a cylinder portion thereof pivotally attached to a top portion of said door, and a piston portion thereof pivotally attached to an interior portion of said top panel.

15. A storage unit assembly as set forth in claim 1, including:
a door open assist having a longitudinally resilient construction with one end thereof operably connected with said door and the opposite end thereof operably connected with said case to assist shifting said door from said closed position to said open position.

16. A storage unit assembly as set forth in claim 1, including:
a rigid reinforcing strut disposed along a medial portion of said back panel, and having an upper end thereof detachably connected with said top panel and a lower end thereof detachably connected with said bottom panel to stiffen said case.

17. A storage unit assembly as set forth in claim 1, wherein:
said rear portions of said first and second end panels define generally flat rear edges through which said slots extend.

18. A storage unit assembly as set forth in claim 1, wherein:
said first and second end panels have a formed, one-piece construction with said rear edges formed integral therein.

19. A storage unit assembly as set forth in claim 1, wherein:
said back panel includes an upper lip that extends inwardly from an upper portion of said back panel, and further includes a lower flange that extends inwardly and substantially orthogonally from a lower portion of said back panel.

20. A storage unit assembly as set forth in claim 19, wherein:
said upper lip of said back panel engages said top panel and said lower flange extends below said case proximate a pair of connector brackets mounted on inside surfaces of said first and second end panels when said case is in said up-mounted condition.

21. A storage unit assembly as set forth in claim 1, wherein:
said first and second end panels include a front flange extending therealong, wherein said front flange includes a lower edge adapted to receive and retain a front portion of said bottom panel.

22. A storage unit assembly as set forth in claim 1, wherein:
said top panel includes side flanges that extend below said top panel and which include clip apertures adapted to engage a pair of clips mounted on top surfaces of said first and second end panels and further includes a detent stop aperture for engaging a detent stop on said top surfaces of said first and second end panels.

23. In an office furniture unit having an outer face with slotted hangers extending therealong, the improvement of a removable storage unit assembly, comprising:
a bottom panel operably positioned in a generally horizontal orientation along said office furniture unit;
a top panel disposed above and generally parallel with said bottom panel;
first and second end panels disposed at opposite ends of said top and bottom panels and connected therewith to define a rigid, box-shaped case having a generally open back portion; said first and second end panels having rear portions with a plurality of vertically spaced apart slots disposed therein;
a back stop rail extending along a rearward portion of said bottom panel between said first and second end panels; said back stop rail is connected with said bottom panel and said first and second end panels to rigidify said case; and
first and second hanger brackets each having a rear portion with first hooks selectively received in said slotted hangers of said office furniture units, and a forward portion with second hooks selectively received in said slots in said rear portions of said first and second end panels to detachably support said case in a panel-hung condition against said outer face of said office furniture unit;

wherein said panel-hung condition defines an on-module panel-hung condition and includes a first off-module support bracket having a rear portion thereof with slots selectively receiving therein said second hooks of said first and second hanger brackets in a vertical off-module panel-hung condition, a forward bottom portion thereof abuttingly supporting thereon said back stop rail, and a forward top portion thereof connected with said top panel of said case in a manner which permits said case to shift laterally relative to said first and second hanger brackets.

24. A storage unit assembly as set forth in claim 23, including: an anti-dislodgement clip mounted on said case adjacent to one of said first and second end panels, and engaging said second hooks on an adjacent one of said hanger brackets in said panel-hung condition.

25. A storage unit assembly as set forth in claim 23, wherein:

said panel-hung condition defines an off-module panel-hung condition and includes a second off-module support bracket including a top bracket having a rear portion with horizontal hooks shaped for reception in horizontal ones of the slotted hangers on an associated one of the office furniture units, a top portion with an upwardly extending flange selectively engaging said first off-module support bracket, a bottom bracket having a rear portion with horizontal hooks shaped for reception in horizontal ones of the slotted hangers in the associated one of the office furniture units, and a forward portion with vertical hooks selectively received in said slots in said rear portion of said first off-module bracket to detachably support said case in a panel-hung condition against the outer face of the associated one of the office furniture units.

* * * * *